US009220995B2

(12) United States Patent
Maxam

(10) Patent No.: US 9,220,995 B2
(45) Date of Patent: Dec. 29, 2015

(54) SYSTEM AND METHOD FOR CONSTRUCTING A SET OR A STAGE

(71) Applicant: Insta-Place LLC, Los Angeles, CA (US)

(72) Inventor: Noel Roger Maxam, Los Angeles, CA (US)

(73) Assignee: INSTA-PLACE LLC, Larkspur, CO (US)

( * ) Notice: Subject to any disclaimer, the term of this patent is extended or adjusted under 35 U.S.C. 154(b) by 0 days.

(21) Appl. No.: 14/300,020

(22) Filed: Jun. 9, 2014

(65) Prior Publication Data

US 2014/0283459 A1 Sep. 25, 2014

Related U.S. Application Data

(63) Continuation-in-part of application No. 13/606,731, filed on Sep. 7, 2012, now Pat. No. 8,756,867.

(60) Provisional application No. 61/837,607, filed on Jun. 20, 2013.

(51) Int. Cl.

| | |
|---|---|
| ***E04H 3/24*** | (2006.01) |
| ***A63J 1/02*** | (2006.01) |
| ***E04C 2/52*** | (2006.01) |
| ***E04H 3/22*** | (2006.01) |

(52) U.S. Cl.

CPC . *A63J 1/02* (2013.01); *E04C 2/521* (2013.01); *E04H 3/22* (2013.01); *E04H 3/24* (2013.01)

(58) Field of Classification Search

CPC ..... A63H 3/52; A63J 1/028; E04B 1/34321; E04C 2/34; E04H 3/24

USPC ..... 52/6, 7, 79.1, 126.4, 262, 270, 281, 52/284, 311.1, 311.2; 446/105, 106, 108, 446/109

See application file for complete search history.

(56) References Cited

U.S. PATENT DOCUMENTS

| | | | | |
|---|---|---|---|---|
| 984,322 | A | 2/1911 | Van Sant | |
| 1,022,020 | A | 4/1912 | Craig | |
| 1,147,823 | A | 7/1915 | Smith | |
| 2,052,178 | A | 8/1936 | Holden | |
| 2,703,487 | A * | 3/1955 | Ossoinack | 52/592.3 |

(Continued)

OTHER PUBLICATIONS www.macksennettstage.com/flats.html, Scenery Flats, Aug. 23, 2007.

*Primary Examiner* — Jeanette E Chapman
*Assistant Examiner* — Daniel Kenny
(74) *Attorney, Agent, or Firm* — Knobbe, Martens, Olson & Bear LLP

(57) ABSTRACT

A wall module assembly usable to make interchangeable scenery, the module comprising a first support member having a first end, a second end, a first main surface, and a second main surface, a second support member having a first end, a second end, a first main surface, and a second main surface, a plurality of panel members interchangeably and removably supported by at least one of the first support member and the second support member, adjacent at least one of the first main surface and the second main surface of the first and/or second support member, and a plurality of connection members supported by the first end of the first support member and configured to be removably received within openings formed in the second end of the second support member positioned adjacent to the first support member.

21 Claims, 35 Drawing Sheets

(56) References Cited

U.S. PATENT DOCUMENTS

| | | | | |
|---|---|---|---|---|
| 2,880,470 | A * | 4/1959 | Pickersgill | 52/272 |
| 2,942,879 | A | 6/1960 | Izenour | |
| 3,447,274 | A | 6/1969 | Davidson | |
| 4,744,189 | A | 5/1988 | Wilson | |
| 5,015,117 | A | 5/1991 | Pawlicki | |
| 5,375,641 | A | 12/1994 | Schlueter | |
| 5,519,971 | A * | 5/1996 | Ramirez | 52/220.2 |
| 5,626,926 | A | 5/1997 | Roberts | |
| 6,106,186 | A | 8/2000 | Taipale | |
| 6,122,880 | A * | 9/2000 | Kolb et al. | 52/592.6 |
| 2006/0150530 | A1 | 7/2006 | Davey | |
| 2006/0160467 | A1 | 7/2006 | Brock | |

* cited by examiner

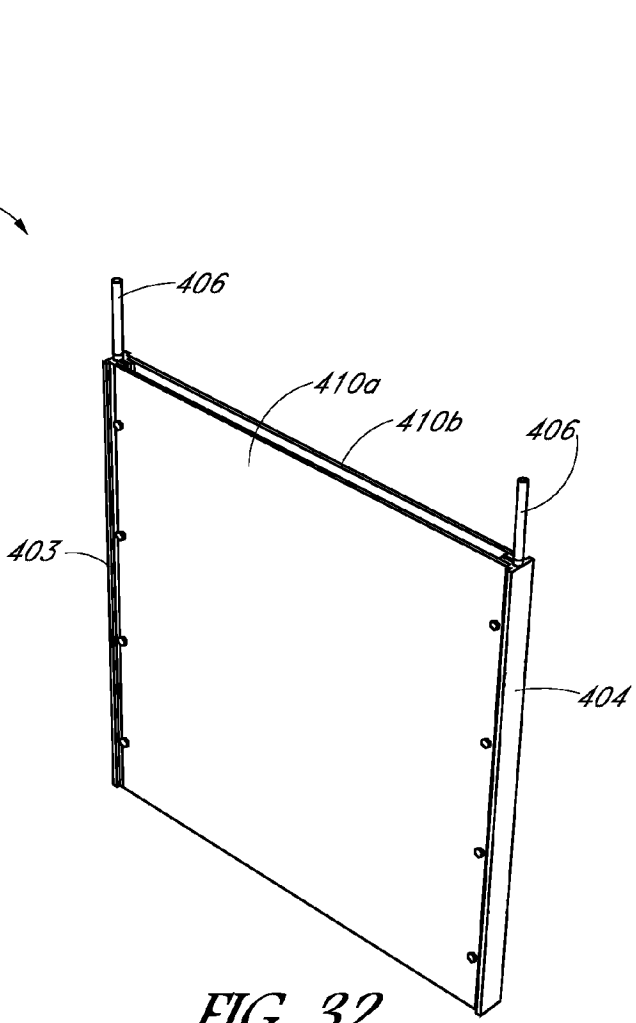
FIG. 32
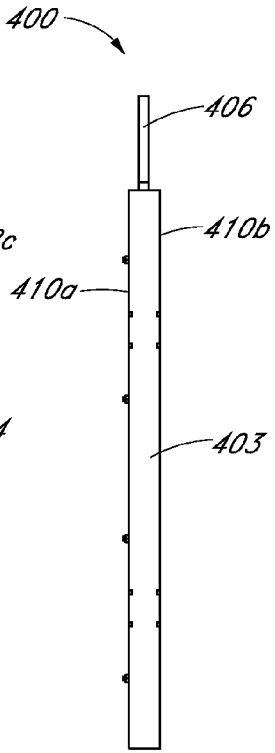
FIG. 31
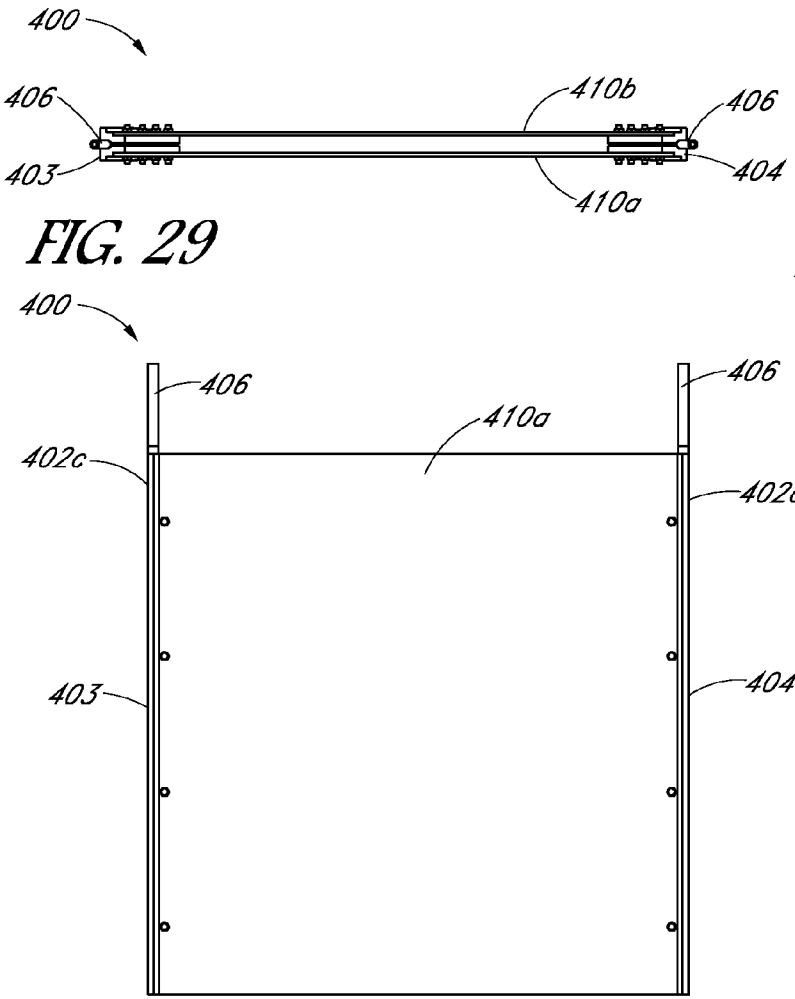
FIG. 30
FIG. 29

SYSTEM AND METHOD FOR CONSTRUCTING A SET OR A STAGE

CROSS-REFERENCE TO RELATED APPLICATIONS

Any and all applications for which a foreign or domestic priority claim is identified in the Application Data Sheet as filed with the present application, are hereby incorporated by reference in their entirety under 37 CFR 1.57.

BACKGROUND OF THE DISCLOSURE

1. Field of the Disclosure

Some embodiments of the present disclosure relate to sets and/or stages, such as in a theater, film or television production, and more particularly, to interchangeable set and/or stage scenery elements equipped for quick and inexpensive reuse and reorganization.

2. Description of the Related Art

In a typical set and/or stage (collectively referred to herein as a stage for simplicity) construction, numerous specific stage elements such as doors, windows and walls are provided. Each element is typically used for a single purpose and is difficult to move and set up. For example, separate wall elements must be created and moved for masonry walls, wood walls and plaster walls. It is time consuming and expensive to create, set up and break down elaborate set elements.

Once put together, the set elements are often joined together to form a unified structure. The structure is typically kept together and moved as a unit in and out of a theater or stage which is time consuming and expensive. Moreover, the use of a unified set structure that is moved as a unit typically requires specialized moving equipment as well as a large facility for storing the structure when it is not being used.

Therefore, there is a need for an improved system and method for constructing stage scenery.

SUMMARY OF SOME EMBODIMENTS OF THE DISCLOSURE

Accordingly, the present disclosure relates to an interchangeable kit usable to make interchangeable scenery that remedies the shortcomings of the prior art. The kit, according to an embodiment, can have a plurality of wall units, including at least a first wall unit and a second wall unit. Each of the first wall unit and the second wall unit can have a first face painted, textured or covered to simulate a first surface; a second face painted, textured or covered to simulate a second surface, the second surface being different than the first surface; and a plurality of first connector elements. The kit also can have at least one aperture unit having a first face painted, textured or covered to simulate a first door or window, or having an operable first door or window; a second face painted, textured or covered to simulate a second door or window, or having an operable second door or window, the second door or window being different than the first door or window and a plurality of second connector elements. A given connector element in the first plurality of connector elements can be configured to connect a given wall unit to at least one other wall unit or aperture unit, and a given connector element in the second plurality of connector elements can be configured to connect a given aperture unit to at least one other aperture or wall unit.

The first face of at least one wall unit can be painted, textured or covered to simulate an interior surface and the second face of the wall unit can be painted, textured or covered to simulate an exterior surface. The first face of the aperture unit can be painted, textured or covered to simulate an interior window or door and the second face of the aperture unit can be painted, textured or covered to simulate an exterior window or door. Optionally, the first face of the plurality of wall units can be painted, textured or covered to simulate at least one of the group consisting of wood, brick, stucco, plaster and wallpaper. Optionally, the aperture unit can be configurable as at least two of the group consisting of a single hinged door, double hinged doors, a sliding door, a pocket door and elevator doors.

Additionally, the aperture unit can be configured to store multiple doors or windows of different types within a receiving area between a first wall of the aperture unit and a second wall of the aperture unit. In an additional embodiment, at least one of the first face and the second face of each of the plurality of wall units further comprises a plurality of fasteners for attaching a panel to the wall unit; and the kit can have at least one panel coupleable to at least one wall unit. In another embodiment, at least one of the first face and the second face of each of the plurality of wall units can have a plurality of relief pieces for attaching an insert to the wall unit; and wherein the kit can have at least one insert coupleable to at least one wall unit.

In an additional embodiment, there can be hooks on at least one of a top and a bottom of each wall unit and on at least one of a top and a bottom of the door and window unit, the hooks being strong enough to allow for the wall unit and the door and window unit to be picked up by the hooks. In another embodiment, there can be spindle holes in at least one of a top and a bottom of each wall unit and in at least one of a top and a bottom of the door and window unit. The spindle holes can be configured for the insertion of a spindle such that each of the plurality of wall units and the door and window unit can be rotatable to change the orientation of the first face and the second face. Optionally, each of the plurality of wall units and the aperture unit can be prewired for attaching lights. Further, the wall modules or wall units can have one or more stubs on an upper surface therefor to support lights. For example, the lights may be equipped with clamps or the like which may be clamped on to or otherwise removably attached to the stubs. The lights can be used for decoration purposes or can be used simply to illuminate a space defined by the wall modules and/or wall units, and/or the wall modules and/or wall units. For example, the lights may be used to illuminate actors in a set defined by the wall modules and/or wall units.

In an additional embodiment, the kit also can have a plurality of floor units, each floor unit having a first face with a first design; a second face with a second design thereon, the second design being different than the first design; and a plurality of connector slots. Connectors can be removably slidable in the connector slots to removably couple the plurality of floor units together. Optionally, at least one of the first face and the second face of the floor units can be painted, colored or textured to simulate at least one of the group consisting of marble, stone, brick, cement, asphalt, wood plank, tile and linoleum.

In an embodiment, the first plurality of connector elements and the second plurality of connector elements comprise connector slots configured to removably receive connector devices to removably couple the plurality of wall units and the at least one aperture unit. Optionally, the first plurality of connector elements and the second plurality of connector elements comprise snaps. Additionally, at least a portion of the first connector elements and the second connector elements can comprise magnets. Optionally, at least one wall unit can have a green screen. In an additional embodiment of the present disclosure, at least one of the first wall unit and the second wall unit further comprises a third face painted, textured or covered to simulate a third surface, the third surface being different than the first surface and the second surface.

In an additional embodiment, the kit further comprises at least one stair unit, the stair unit having a lower base; a plurality of stairs coupled to each other, at least one stair being coupled to the lower base; and an upper base coupled to at least one of the stairs. At least one of the lower base and the upper base further comprise a plurality of connector elements. Optionally, the kit also can have at least one landing unit coupleable to the upper base of the stair unit.

Some embodiments of the present disclosure are also directed to a method for interchangeably constructing a stage. The method, according to an embodiment, can have the steps of: providing a kit having a plurality of wall units, each wall unit having: a first face painted, textured or covered to simulate a first surface; a second face painted, textured or covered to simulate a second surface, the second surface being different than the first surface; and a plurality of connector slots; at least one aperture unit comprising: a first face painted, textured or covered to simulate a first door or window; a second face painted, textured or covered to simulate a second door or window, the second door or window being different than the first door or window; and a plurality of connector slots; and a plurality of connectors removably mountable in the wall unit connector slots and the aperture unit connector slots to removably couple the plurality of wall units and the at least one aperture unit. The method further includes the steps of coupling at least two of the plurality of wall units to each other using the connectors; and coupling the window and door unit to at least one of the wall units using the connectors.

In an additional embodiment, a bottom of each wall unit can have a spindle hole and the method further includes the steps of: mounting at least one wall unit on a spindle; rotating the wall unit to change the orientation of the wall unit; and removing the at least one wall unit from the spindle. Optionally, the kit further comprises a plurality of floor units each floor unit having: a first face having a first design thereon; a second face having a second design thereon, the second design being different than the first design; and a plurality of connector slots; and wherein the method further comprises: placing the plurality of floor units proximal to the plurality of wall units and the window and door unit; and removably connecting the plurality of floor units to each other. Optionally, the method further comprises the steps of: uncoupling the floor units from each other; turning over a plurality of the floor units; and re-coupling the floor units to each other.

In an additional embodiment, the kit further comprises at least one stair unit and at least one landing unit; and the method further comprises: positioning the at least one stair unit proximal to at least one wall unit; and connecting the at least one landing unit to the stair unit.

An additional embodiment is directed to an interchangeable stage kit having a plurality of wall units, each wall unit further having: a first face painted, textured or covered to simulate a first surface; a second face painted, textured or covered to simulate a second surface, the second surface being different than the first surface; and a plurality of connector slots. The kit also can have a plurality of aperture units, each aperture unit having: a first face painted, textured or covered to simulate a first door or window; a second face painted, textured or covered to simulate a second door or window, the second door or window being different than the first door or window; and a plurality of connector slots.

The kit also can have a plurality of floor units, each floor unit further comprising: a first face having a first design thereon; a second face having a second design thereon, the second design being different than the first design; and a plurality of connector slots. The kit also can have a plurality of connectors removably mountable in the wall unit connector slots, the aperture unit connector slots and the floor unit connector slots to removably couple the plurality of wall units, the at least one aperture unit and the floor units. In an additional embodiment, the kit also can have at least one stair unit, the stair unit having: a lower base; a plurality of stairs coupled to each other, at least one stair being coupled to the lower base; and an upper base coupled to at least one of the stairs; wherein the lower base and the upper base further comprise a plurality of connector slots.

Any of the features, components, or details of any of the arrangements or embodiments disclosed in this application, including those summarized above and those described in greater detail below, can be interchangeably combinable with any other features, components, or details of any of the arrangements or embodiments disclosed herein to form new arrangements and embodiments.

BRIEF DESCRIPTION OF THE DRAWINGS

Embodiments of the present disclosure will now be described hereinafter, by way of example only, with reference to the accompanying drawings in which:

FIGS. 29, 30, 31, and 32, are a top view, front view, side view, and isometric view, respectively, of the embodiment of the wall module illustrated in FIG. 28B.

DETAILED DESCRIPTION OF THE PREFERRED EMBODIMENTS

In the following description of the preferred embodiments, reference is made to the accompanying drawings, which show by way of illustration, specific embodiments which may be practiced. Wherever possible, the same reference numbers will be used throughout the drawings to refer to the same or like parts. It is to be understood that other embodiments can be utilized and structural and functional changes can be made without departing from the scope of the present disclosure.

Figure 1B:
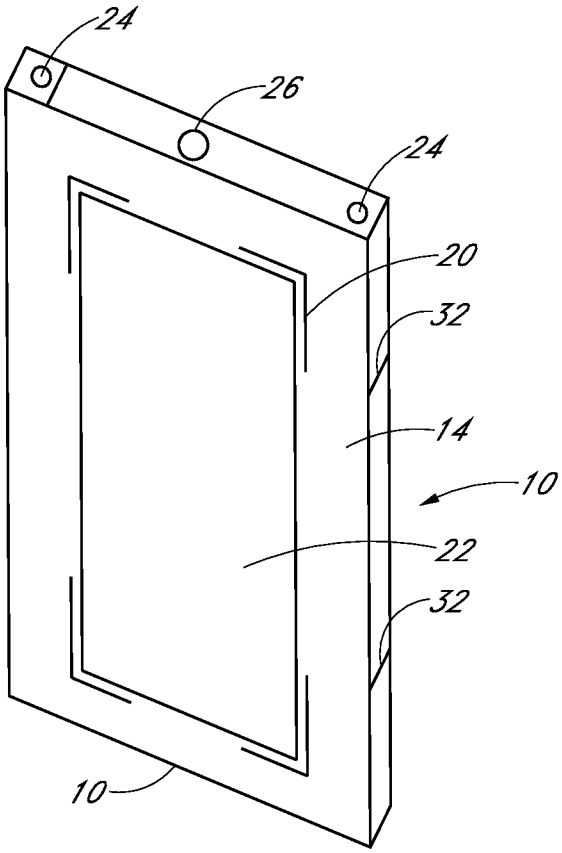
FIG. 1B is a schematic drawing of the wall unit of FIG. 1A turned over and around.
Figure 1A:
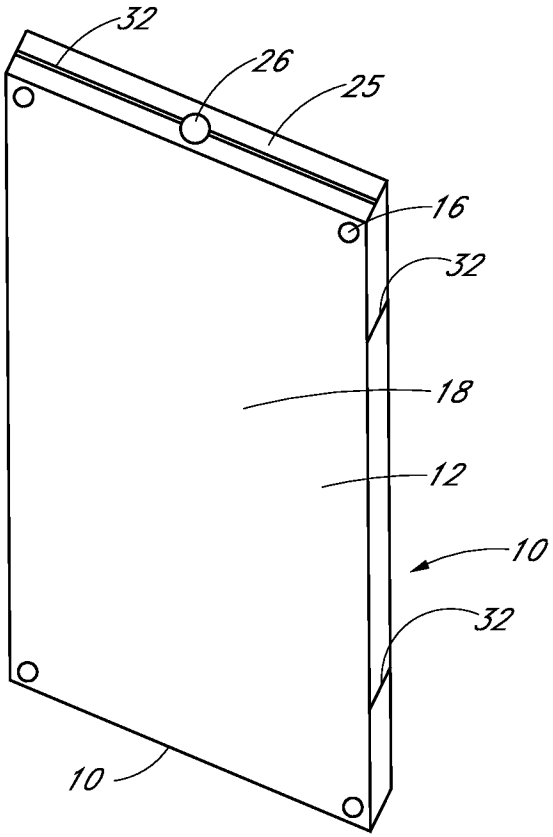
FIG. 1A is a schematic drawing of a wall unit according to an embodiment of the present disclosure.

Some embodiments are directed to a system and method for constructing a set that utilizes modular components, such as modular wall units, door units, flooring units and stair units. A modular wall unit 10 according to an embodiment of the present disclosure is shown in FIGS. 1A and 1B. The wall unit 10 can be used for creating an interior or exterior wall. The wall unit can have a first face 12 and a second face 14. In any embodiments disclosed herein, a first face and/or a second face of a wall module or unit (such as, without limitation, the first face 12 and/or the second face 14 of the modular wall unit 10) can be painted, textured or covered to simulate a surface, for example wood, brick, stucco, plaster or wallpaper.

In any embodiments disclosed herein, a first face and/or a second face (such as, without limitation, the first face 12 and/or the second face 14 of the modular wall unit 10) can have a plurality of fasteners 16, such as for example rivets, snaps, hook and loop fasteners, magnets, any other suitable removable or non-removable fasteners, and/or any combination of the foregoing for attaching panels 18 to the face. The panels can simulate a surface such as wood, brick, stucco, plaster or wallpaper and can be, for example, painted or pre-printed. Additionally, one or both faces can have a plurality of relief pieces 20 for holding an insert 22, such as a fabric piece to simulate a wall material.

Figure 2:
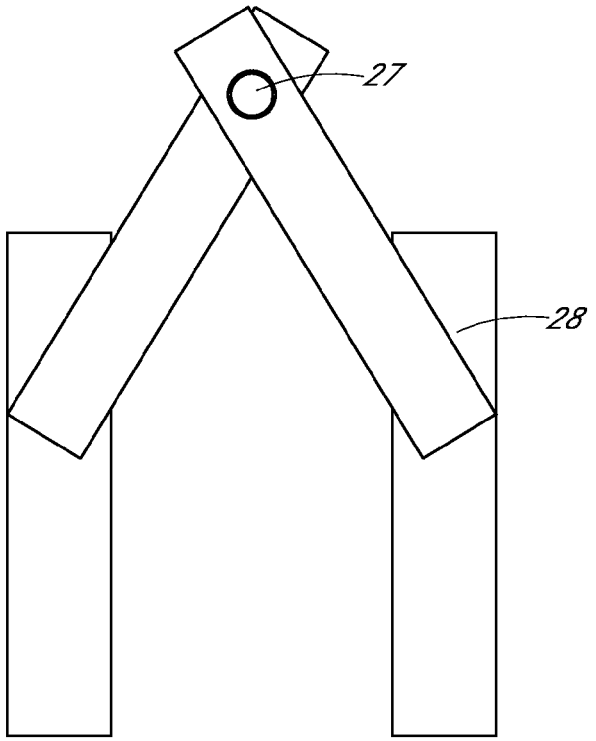
FIG. 2 is a schematic drawing of a spindle and forklift attachment usable with the wall unit of FIG. 1A.

Additionally, any wall units embodiments disclosed herein, including without limitation the wall unit 10, can have fasteners, such as riggable hooks 24, for allowing the modular wall to be lifted in and out of location, such as by a crane or a forklift. Alternatively, instead of hooks, magnets, tethers, or any other coupling devices can be used for allowing the wall unit 10 to be lifted in and out of location. Additionally, any wall unit embodiments disclosed herein, including without limitation, the wall unit 10, can have a spindle hole 26 in the top 25 or a bottom for fitting of a spindle 27 such as shown in FIG. 2.

The spindle 27 can be mounted on a studio floor or on a forklift using a forklift assembly 28 and rotatably fit within a spindle hole of any of the wall units disclosed herein for allowing the wall unit 10 to be rotated on the spindle to change viewing from the first face 12 to the second face 25 or from the second face 14 to the first face 12. In any embodiments, the wall unit 10 can be raised using riggable hooks 24, positioned on spindle 27, rotated 180 degrees until facing the opposite direction, lifted off of the spindle using the riggable hooks 24, the spindle 27 removed and the wall unit 10 placed back down.

In any embodiments, one face of the wall unit 10 can be configured as an interior wall and the other face of the wall unit 10 configured as an exterior wall. The wall unit 10 can be covered with a slipcover to simulate a surface, for example wood, brick, stucco, plaster or wallpaper. The wall unit of any embodiment disclosed herein can be painted or covered to have the appearance of three-dimensional architectural features, such as columns and bookcases on at least one side. In an additional embodiment, one side of the wall unit can be painted or covered as a green screen for use in virtual sets. In an embodiment, the wall unit 10 can be prewired for attaching lights or other fixtures to the wall unit 10.

Figure 3:
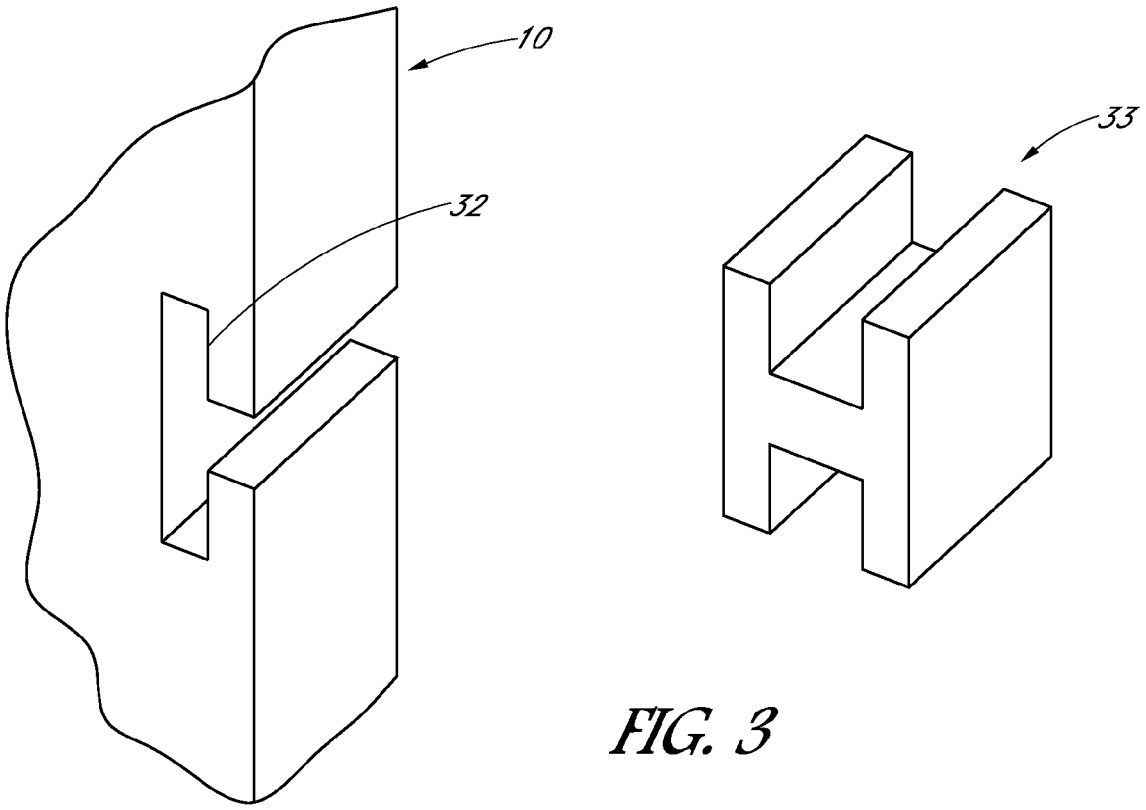
FIG. 3 is a schematic drawing of an enlarged view of a connector slot of the wall unit of FIG. 1A and a connector configured for use with the connector slot.

In an embodiment, as shown in FIGS. 1A, 1B and 3, each of the wall units can have a plurality of connector slots 32 for coupling wall panels to each other, such as for creating differently sized wall assemblies, and for attaching the wall panels to other components. The use of connector slots 32 with connectors 33 that slidably engage in the connector slots allows for quick joining of wall panels to each other and to other components without the use of specialized tools. When not in use, if necessary, plugs can be placed in the connector holes to hide the connector holes. Connectors can be created for joining adjacent components in a plane, such as the connector shown in FIG. 3, or at an angle, such as about ninety-degrees to form a corner. Alternatively, other coupling devices and fasteners such as magnets, brackets or snaps can be used for joining wall units 10 to each other and to other components.

The wall units 10 can be configured as flat or curved pieces; the use of curved wall units of different radii allows for the creation of curved structures, such as turrets. When not in use, the wall units 10 can be stacked and moved, for example, on pallets or in standard containers. This saves storage space and eases crating and shipping. In some embodiments, the structure of the wall units 10 can be made to be weight bearing, sturdy and safe. In any embodiments disclosed herein, the internal structure (including any of the support members disclosed below) of any wall unit embodiments disclosed herein can be made from one or more of, for example, wood (e.g., medium-density fibreboard (MDF)), plastic or other composite material (e.g., plastic laminated MDF), fiberglass, aluminum, steel, and any combination thereof. The faces or panels of any wall units can be made with any suitable covering material and can be made with at least one of, for example, wood, MDF, pressboard or particle board, aluminum, steel, glass, plastic, and multi-vinyl castings.

An aperture unit 40 according to an embodiment of the present disclosure is shown in FIG. 3. The aperture unit can be used for creating an interior or exterior door or window. The aperture unit can have a first face 42 and a second face 44. The first face 42 and/or the second face 44 can be painted, textured or covered to simulate a surface, such as for example wood, brick, stucco, plaster or wallpaper. In an embodiment, the first face 42 can be configured as an interior surface and the second face 44 can be configured as an outside surface. In an additional embodiment, the first face 42 or the second face 44 can be painted or covered as a green screen for use in virtual sets.

The first face 42 or the second face 44 of any embodiments disclosed herein can have a plurality of fasteners 46, such as for example rivets, snaps, hook and loop fasteners, magnets, and/or any combination of the foregoing, for attaching panels 48 to the face. The panels 48 can simulate a surface such as wood, brick, stucco, plaster or wallpaper. Additionally, the panels can simulate an architectural feature such as different types of doors or windows. The panels can be, for example, painted or pre-printed. The aperture unit can have functional doors and windows that can open and close. The aperture unit 40 can be used to simulate, for example, plastic (such as polyvinyl chloride or vinyl) windows, aluminum windows, wood windows, interior doors with panel inserts and exterior doors with panel inserts. Likewise, the aperture unit 40 can be used to simulate, for example, hinged or sliding doors, pocket doors, dutch doors, elevators and closets.

The front and back of the functional doors and windows can be different types or the same type. Also, for a given door, each side of the door can appear to be an exterior door with different styles, each side of the door can appear to be an interior door with different styles, or one side of the door can appear to be an exterior door with one style, and the other side of the door can appear to be an interior door with a different style.

Additionally, the first face 42 and the second face 44 can have a plurality of relief pieces 50 for holding an insert, such as a fabric piece to simulate a door or window material. In an additional embodiment, the door and window unit 40 can be prewired for connection of lights, such as lamps. Optionally, frosted glass panels can be held in the plurality of relief pieces 50 and backlit, such as by LED's to further simulate a frosted glass door.

The aperture unit 40 can be configured as a single or double hinge door. To facilitate multiple configurations, the aperture unit 40 can have two holes 52 for insertion of door hardware, each hole being fillable with a matched plug 54 to hide the hole if desired. Likewise, to facilitate multiple configurations, the aperture unit 40 can have a removable molding mountable on the door and window unit to hide door hinges 56. The use of the removable molding(s) along with matched plugs allows for the door and window unit to be used a single door set element or a regular wall instead of a double door.

In an embodiment, the aperture unit 40 can have a thickness suitable to, and be configured to, accommodate a pocket door slider 58. The aperture unit 40 can have riggable hooks 60, such as on a top 62 for allowing the aperture unit to be lifted in and out of location, such as by a crane or a forklift. Alternatively, instead of hooks, magnets or other coupling devices can be used for allowing the aperture unit 40 to be lifted in and out of location. Additionally, the aperture unit 40 can have a spindle hole 64 in the top 62 or a bottom for fitting of a spindle (not shown). The spindle can be mounted on a studio floor or on a forklift and rotatably fit within the spindle hole 62 for allowing the aperture unit 40 to be rotated on the spindle to change viewing from the first face 42 to the second face 44 or from the second face 44 to the first face 42. Multiple doors of different types can be stored in a pocket in the wall unit 10 or in a pocket in the aperture unit 40 and different doors can be removed from the pocket and used with the aperture unit 40 depending on the desired appearance for the set.

Figure 4:
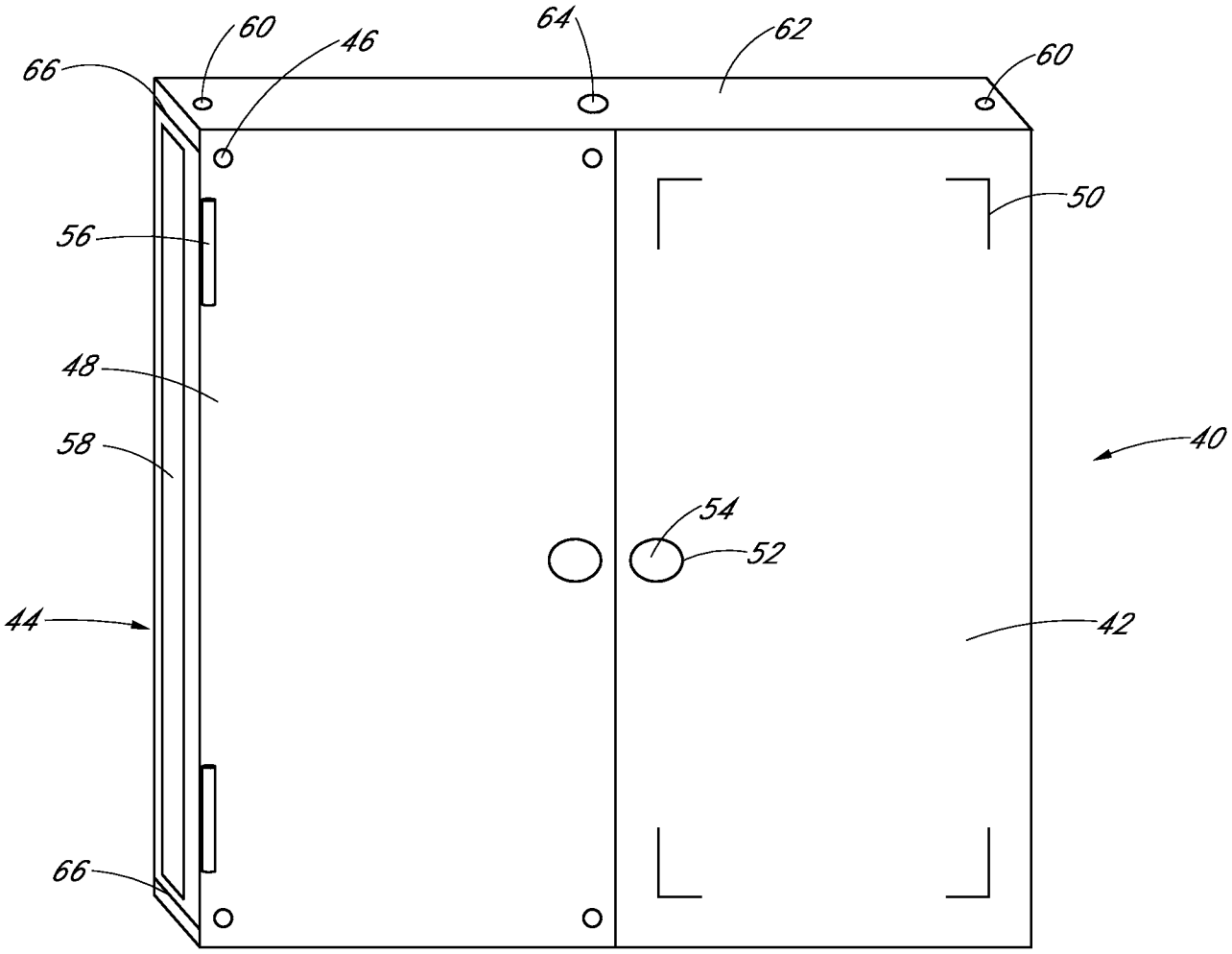
FIG. 4 is a schematic drawing of a door unit according to an embodiment of the present disclosure.

In an embodiment, as shown in FIG. 4, each of the aperture units 40 can have a plurality of connector slots 66 for coupling window and door units 40 to each other and to wall units 10. The use of connector slots 66 with connectors 33 that slidably engage in the connector slots 66 allows for quick joining of window and door panels 40 to each other and to other components without the use of specialized tools. When not in use, if necessary, plugs can be placed in the connector holes to hide the connector holes. Connectors can be created for joining adjacent components in a plane, such as the connector shown in FIG. 3, or at an angle, such as about ninety-degrees to form a corner. Alternatively, other coupling devices and fasteners such as magnets, brackets or snaps can be used as connector elements for joining aperture units 40 to each other and to other components.

In an embodiment, one face of the aperture unit 40 can be configured as an interior window or door and the other face of the aperture unit 40 configured as an exterior window or door. The aperture unit 40 can be covered with a slipcover to simulate a surface, such as wood, brick, stucco, plaster or wallpaper, as well as architectural features such as various types of windows or doors. The aperture unit 40 can be painted or covered to have the appearance of three-dimensional architectural features, such as columns and bookcases on at least one side.

In an additional embodiment, one side of the aperture unit 40 can be painted or covered as a green screen for use in virtual sets. Multiple windows of different types can be stored in a pocket in the wall unit 10 or in a pocket in the aperture unit 40 and different windows can be removed from the pocket and used in the aperture unit 40 depending on the desired appearance for the set.

When not in use, the aperture units 40 can be stacked and moved, for example, on pallets or in standard containers. This saves storage space and eases crating and shipping. The structure of the aperture units 40 can be made to be weight bearing, sturdy and safe. The internal structure of the aperture units 40 can be made from one or more of, for example, wood, aluminum and steel. The faces of the aperture units 40 can be made with any suitable material and can be made with at least one of, for example, wood, MDF, aluminum, steel, glass, plastic and multi-vinyl castings.

In an alternative embodiment of the present disclosure, the wall units 10 and the aperture units 40 can have more than 2 faces. For example, the wall units and/or window units 40 can be formed as cubes with 6 different faces. The cubes can be rotated to form 6 different sets.

Figure 5B:
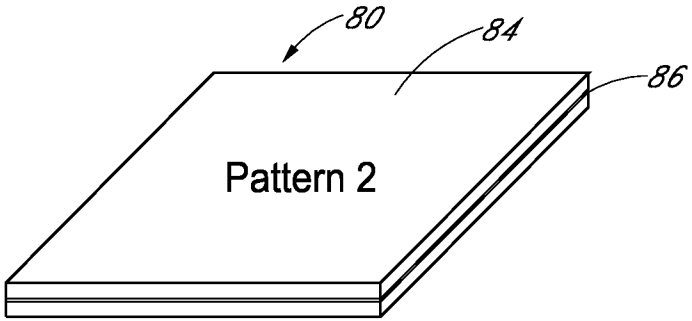
FIG. 5B is a schematic drawing of the floor unit of FIG. 5A turned over.
Figure 5A:
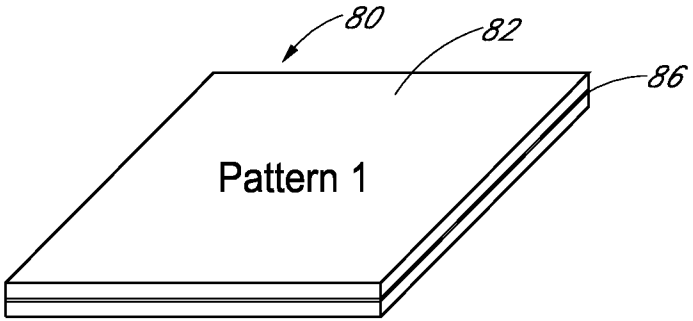
FIG. 5A is a schematic drawing of a floor unit according to an embodiment of the present disclosure.

A modular floor unit 80 according to another embodiment of the present disclosure is shown in FIGS. 5A and 5B. Any embodiments of the modular floor unit 80 can have any of the features, materials, components, sizes, or other details or combinations thereof of any other embodiments disclosed herein. The floor unit 80 can be used for creating an interior or exterior floor. The floor unit 80 can have a first face 82 and a second face 84. Each face can be painted, colored or textured to simulate a surface, such as for example marble, stone, brick, cement, asphalt, wood plank, tile or linoleum.

In a preferred embodiment, a first photograph can be printed on the first face 82 and a second different photograph can be printed on the second face 84. Each photograph can simulate a surface such as for example marble, stone, brick, cement, asphalt, wood plank, tile or linoleum. Some embodiments of the modular floor unit can made from, for example, vinyl or other plastic or composite materials, fiberglass, wood, or any other suitable material or combination of the foregoing.

In any embodiments, the internal structure of the modular floor unit can be made from one or more of, for example, wood, aluminum and steel. The faces of the modular floor unit can be made with any suitable material and can be made with at least one of, for example, wood, concrete, brick and multi-vinyl castings.

The floor unit 80 can be made in numerous different sizes and shapes. In some embodiments, the floor unit can be square and can have a size from approximately 4 inches by approximately 4 inches to approximately 4 feet by approximately 4 feet in size. As used herein, the term approximately is meant to represent a range of 10% greater than or less than the stated value, unless otherwise defined herein. In any embodiments disclosed herein, the floor unit can be magnetized for removable attachment to an undersurface such as a sheet of steel. In any embodiments, each floor unit 80 can have a connector slot 86 along each face. In some embodiments, the connector slots 86 can be configured similarly to the connector slots in the wall units 10 and the window and door units 40.

Figure 7:
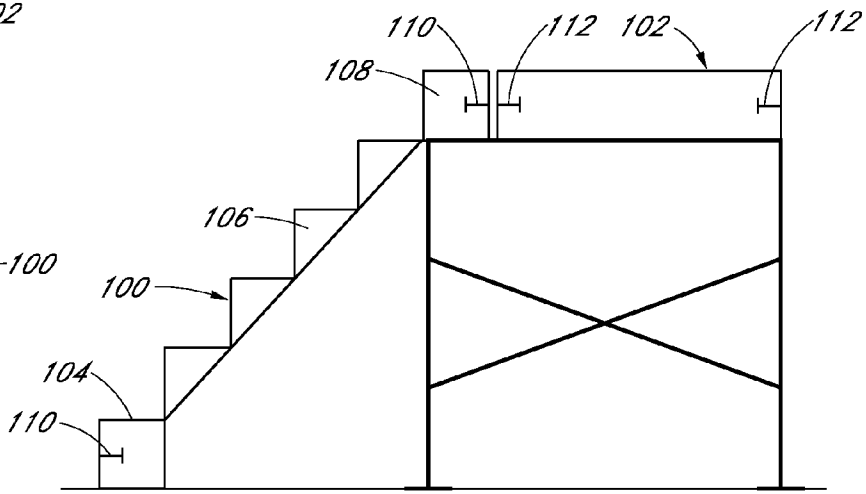
FIG. 7 is a cross-sectional view of the stair unit of FIG. 6.
Figure 6:
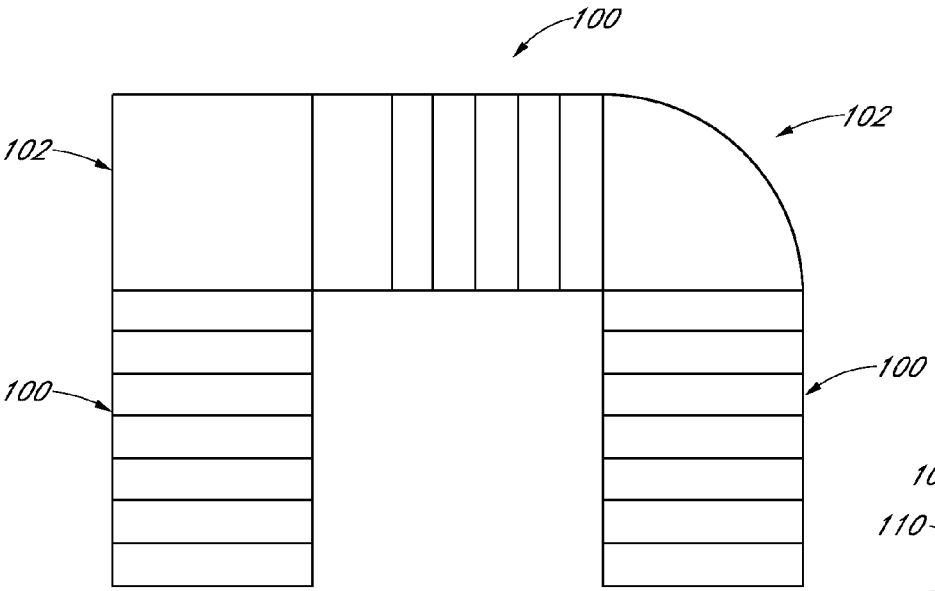
FIG. 6 is a schematic drawing of a stair unit according to an embodiment of the present disclosure.

Embodiments of a modular stair unit 100 and a modular landing unit 102 are shown in FIGS. 6 and 7. The stair unit 100 and landing unit 102 can be used for creating an interior or exterior stairway. The stair unit 100 and the landing unit 102 can each be painted, textured or covered to simulate a surface, such as for example wood, brick, marble or cement.

The stair unit 100 can have a lower base 104, a series of steps 106 and an upper base 108. The size of the lower base 104 and the upper base 108 can be varied and can be configured to be the same size as one of the steps. The number and sizes of the steps 106 can be varied for different types of stairways. In an embodiment, the stair unit can have between about 2 and about 20 stairs, preferably between about 5 and about 15 stairs, and more preferably between about 6 and about 12 stairs. The stair unit 100 can be held upright by resting the lower base 104 on the ground, a stage, or a first riser and the upper base on a higher riser or other support. Alternatively, the stair unit 100 can have supports and can stand upright without a riser or other support.

The stair unit 100 can have a connector slot 110 on the lower base 104 and the upper base 108 for connection to one or more additional stair units 100, landing units 102 or other components. Alternatively, other coupling devices and fasteners such as magnets, brackets or snaps can be used for joining stair units 100 to each other and to other components.

The stair unit 100 can be prewired to accommodate lights. The stair unit can also be fitted with holes in the lower base 104, the upper base 108 and one or more stairs 106 for the attachment of railings and/or banisters.

The stair units 100 can be made to be weight bearing, sturdy and safe. The internal structure of the stair units 100 can be made from one or more of, for example, wood, aluminum and steel. The faces of the stairs and bases can be made with any suitable covering material and can be made with at least one of, for example, wood, glass and brick.

Landing unit 102 can be placed adjacent to the stair unit lower base 104 or upper base 108. The landing unit 102 can have a variety of different shapes, such as for example, square, rectangular, semicircular or pie shaped. The landing unit 102 can have a connector slot 112 on each of its sides for connection to one or more stair units 100 or to additional landing units 102. Alternatively, other coupling devices and fasteners such as magnets, brackets or snaps can be used for joining landing units 102 to each other and to other components.

The landing unit 102 can be prewired to accommodate lights. The structure of the landing units 102 can be made to be weight bearing, sturdy and safe. The internal structure of the landing units 102 can be made from one or more of, for example, wood, aluminum and steel. The landing units 102 can be covered with any suitable covering material such as, for example, wood, glass, brick, carpet and vinyl castings.

A plurality of wall units 10 and window and door units 40 and connectors 33 can be manufactured and/or sold as a kit. The kit can be unpacked and the wall units 10 and window and door units 40 can be connected to each other as needed using the connectors 33 to form a stage as desired. Optionally, the kit further includes floor units 80, which can be placed adjacent to the wall units 10 and the window and door units 40 and coupled to each other using the connectors 33. Optionally, the kit further includes a plurality of stair units 100 and landing units 102, which can be placed adjacent to the wall units and the window and door units 40 and coupled to each other using the connectors 33.

After the stage is put together using the connectors, if it becomes desirable to change the stage, the wall units and the window and door units can have panels, insets, or covers changed. Additionally, the door units and the window and door units can be rotated 180 degrees. Additionally, the floor units can be flipped over. Additionally, the configuration of the stair units and the landing units can be changed.

In some embodiments, the wall units 10, window and door units 40 can be configured as a standard newsroom on one face and a living room on the other face, thereby allowing the wall units 10 and window units 40 to be rotated 180 degrees to change from the newsroom set to the living room set. As an additional example of the use of some embodiments disclosed herein, wall units 10, window and door units 40 and floor units 80 can be used to simulate the interior of the Oval Office of the White House on one face and an exterior of the White House on the other face, thereby allowing the wall units 10, window units 40 and floor units 80 to be rotated 180 degrees to change a set from the interior of the Oval Office to the exterior of the White House.

Figure 8C:
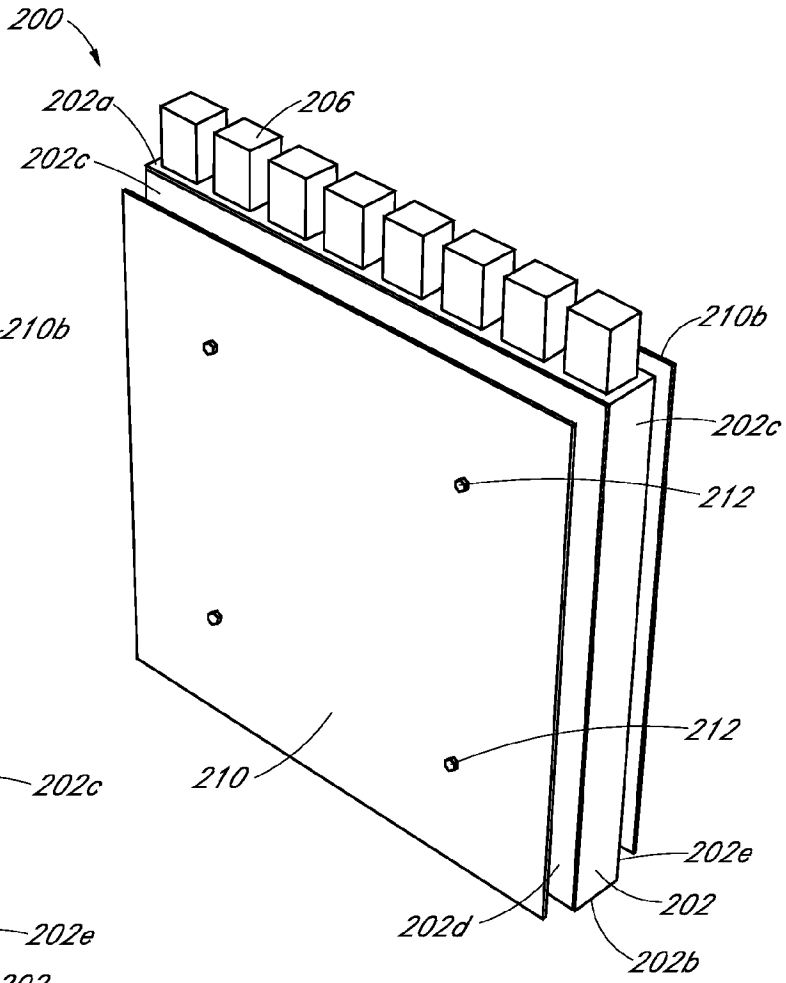
FIGS. 8A, 8B, and 8C illustrate additional embodiments of a wall module of varying size and configurations.
Figure 8B:
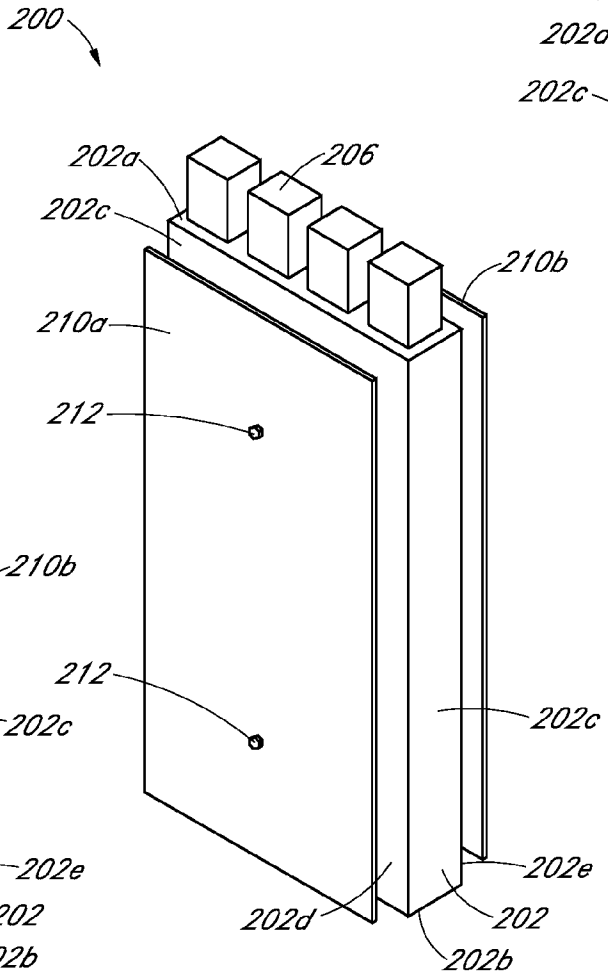
Figure 8A:
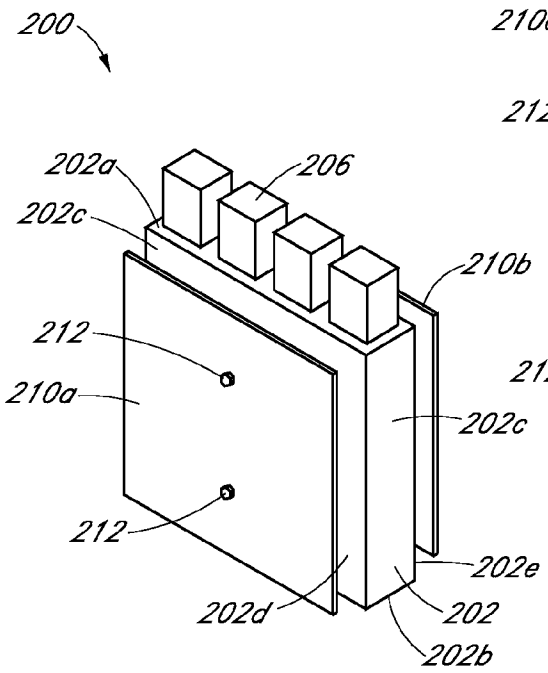
Figure 12:
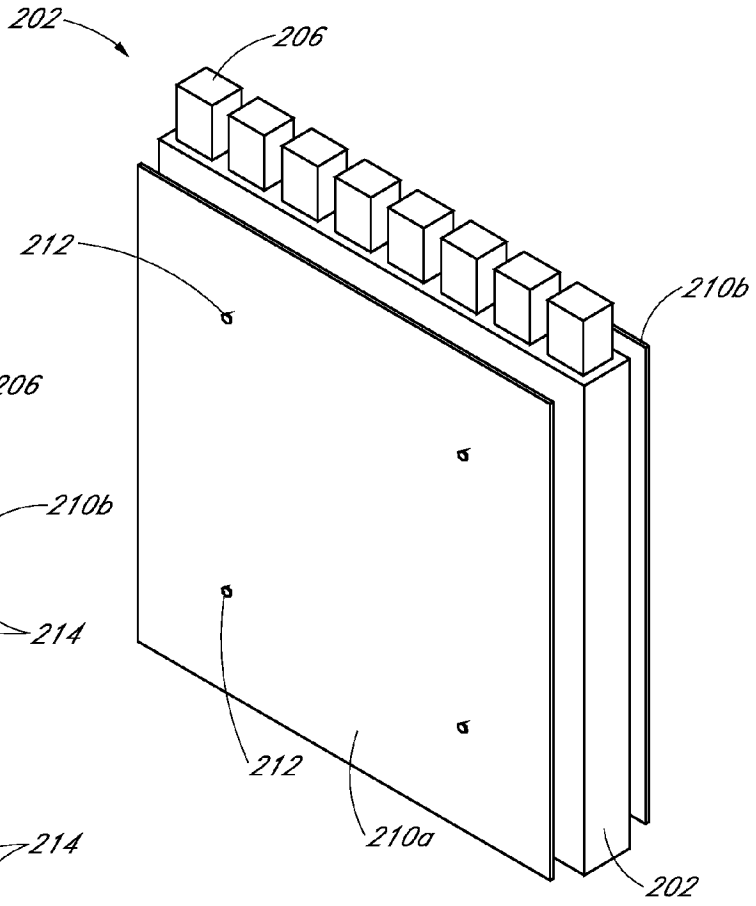
FIGS. 9, 10, 11, and 12, are a top view, front view, side view, and isometric view, respectively, of the embodiment of the wall module illustrated in FIG. 8C.
Figure 13:
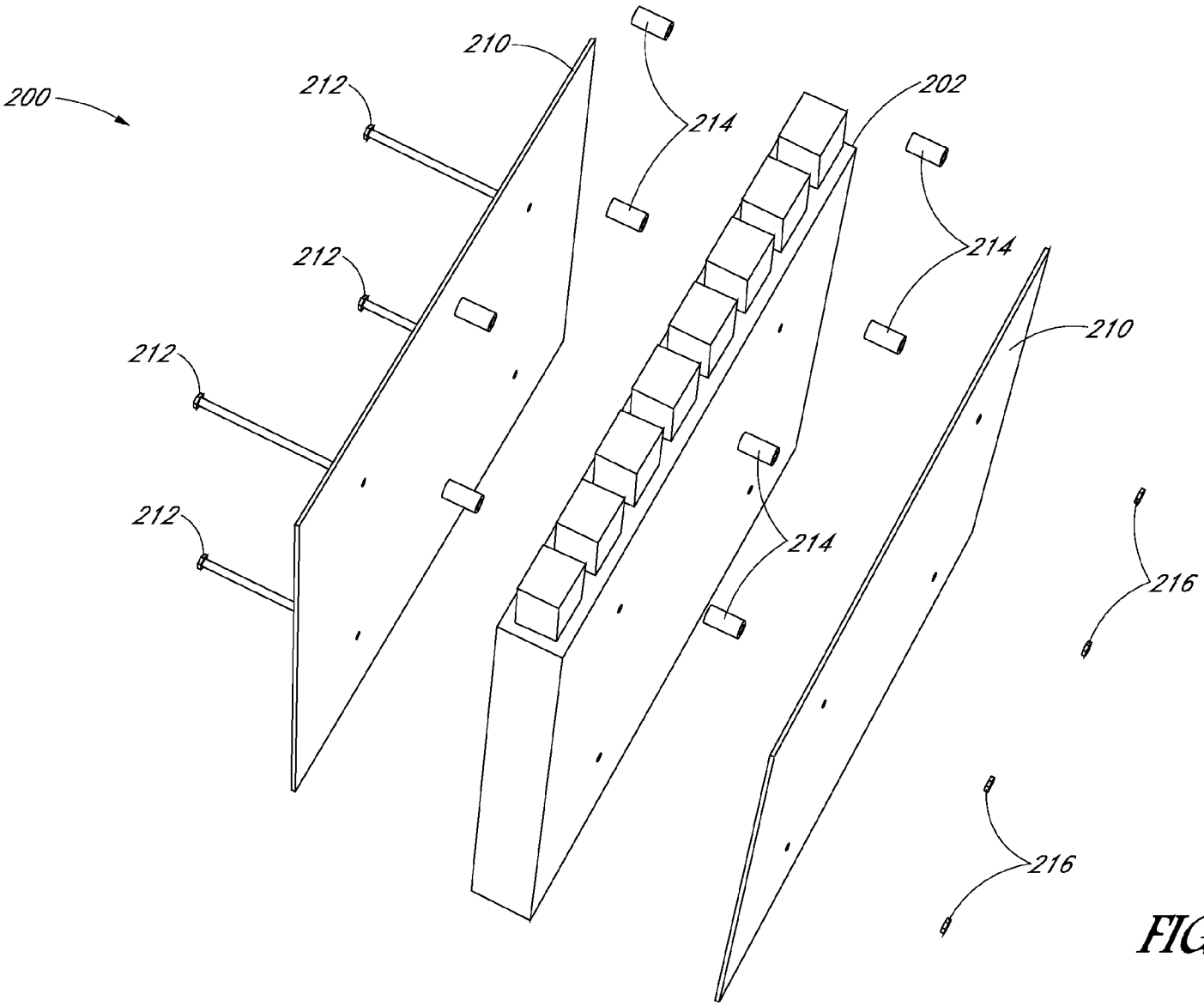
FIG. 13 is an exploded assembly view of the embodiment of the wall module illustrated in FIG. 8C.

FIGS. 8A, 8B, and 8C illustrate additional embodiments of a wall module 200 of varying sizes and configurations. FIGS. 9, 10, 11, and 12, are a top view, front view, side view, and isometric view, respectively, of the embodiment of the wall module 200 illustrated in FIG. 8C. FIG. 13 is an exploded assembly view of the embodiment of the wall module 200 illustrated in FIG. 8C. Any embodiments of the wall modules disclosed herein, including without limitation 200 illustrated in FIGS. 8A, 8B, and 8C can have any of the same features, materials, components, sizes, or other details or configurations of any other wall module embodiments disclosed herein. In any embodiments, the wall modules 200 in any of FIGS. 8A, 8B, and 8C can have the same features and components, but can have a varying size. For example, the wall module embodiment 200 illustrated in FIG. 8A, or any other wall modules disclosed herein, can be approximately 1.5 feet by approximately 1.5 feet, the wall module embodiment 200 illustrated in FIG. 8B can be approximately 3 feet tall by 1.5 feet wide, and the wall module embodiment 200 illustrated in FIG. 8C can be approximately 3 feet tall by 3 feet wide. Additionally, any wall module embodiments disclosed herein can have any of the combination of the foregoing sizes, or any other desired size either greater than or less than the aforementioned ranges. For example and without limitation, any of the wall modules can be approximately 10 feet tall by 2 feet wide, or approximately 12 feet tall by 2 feet wide, or approximately 2 feet tall by 10 or 12 feet or more wide.

The wall module 200 can have a support member 202, one or more connector members 206, and one or more cover members 210 (also referred to herein as panels or panel members) supported by the support member 202. One or both main surfaces of any panels disclosed herein can be painted, covered, or otherwise decorated, as similarly described elsewhere herein. The connector members 206 can be configured to be supported by the support member 202 on an upper surface or portion 202*a* of the support member 202. Any number of connector members 206 can be used, depending on the size of the wall module, and the size and/or number of connector members 206 can be used. For example, the wall module embodiment 200 illustrated in FIG. 8A can have four connector members 206, or from two to six connector members 206. The wall module embodiment 200 illustrated in FIG. 8C can have eight connector members 206, or between two or three and ten or more connector members 206. In some embodiments, the connector member 206 can be positioned at both of the two end portions of the support member 202. Additionally, a connector member 206 can be positioned near the middle of the support member 202.

The connector members 206 can be configured to be received within complementary sized openings (not illustrated) formed in or positioned at a lower edge 202*b* of the support member 202 so that a plurality of support members 202 can be interconnected to form a larger wall structure. As with any of the embodiments described above, the support members 202 can be used to support display panels, facades, or other aesthetic components. As will be described in greater detail below, any of the support members 202 can have recesses, cuts, openings, weight relief features, or other similar features formed therein to reduce the weight of the support members without unacceptably compromising the stiffness of the support members.

Additionally, in any embodiments disclosed herein, the support members can be configured to support pre-painted panel members which can be painted to represent landscape or scenery, wall structures, indoor or outdoor walls, or any other suitable picture or illustration. The panel members can be made from wood, fiberglass, plastic, cloth or other textiles, vinyl, plastic, or any other suitable material or combination of materials. Additionally, the support members can be configured to support one or more continuous panel members configured to continuously extend across multiple wall modules, or across one or more wall units entirely, and optionally conceal seams, openings (e.g., hand grips), coupling devices (e.g., screws, bolts, etc.) of a wall module or between the wall modules. This enables multiple modules to appear as a single structure. The panel members may also extend downwards to conceal wheels or the like mounted to the wall modules. Tensioning members or devices can be positioned along the edges or at the corners of the panel members (e.g., where they are not visible at a typical camera height) and can be used to stretch or tension the panels to remove or reduce any folds, wrinkles, or other similar undulations in the panel members, without marring the panels.

Additionally, in any embodiments, any number of connector members 206 can be positioned on or supported by one or more of the side surfaces 202*c* of the support member 202 so that the support members 202 can be interconnected in a lateral direction as well to provide removable connections between a plurality of laterally arranged wall modules 200. For example, openings can be formed in the side portions 202*c* of any of the support members 202, wherein the connector members 206 can be slidably or otherwise removably supported within the openings. When it is desired to interconnect one or more wall modules 200, one or more connector members 206 can be inserted within the openings formed in an upper surface, lower surface, and/or either of the side surfaces of the support member 202, to interconnect two or more wall modules.

As described above, in any embodiments, the connector members 206 can be removably supported within openings (not illustrated) formed in the support member 202. Additionally or alternatively, one or more of the connector members 206 can be non-removably supported by the support member 202, or can be integrally formed with the support member 202. Additionally, any embodiments of the wall module 200 wherein the connector members 206 are removably supported by the support member 202, the wall modules 200 can be configured such that the connector members 206 are inhibited from sliding out of the openings formed in the support member 202. This can be accomplished using any number of suitable features, including without limitation hook and loop fasteners, detents and complementary protrusions (depressable or otherwise), magnets, or any combination of the foregoing.

Additionally, as illustrated in FIG. 8, one or more panels 210 can be supported by the support member 202. For example, and without limitation, a first panel 210*a* can be supported on a first surface 202*d* (which can be a front facing surface) of the support member 202. Additionally, a second panel 210*b* can be supported on a second surface 202*e* (which can be a rear facing surface) of the support member 202. In some embodiments, as in the illustrated embodiment, the panels 210 can be removably attached to or supported by the support member 202 using bolts, screws, press-fit, hook and loop fasteners, or other similar fasteners 212. Additionally, in any embodiments disclosed herein, the panels 210 can be supported by the support member 202 using hook and loop fasteners, latches, hooks, nails, or any other suitable fasteners.

Figure 11:
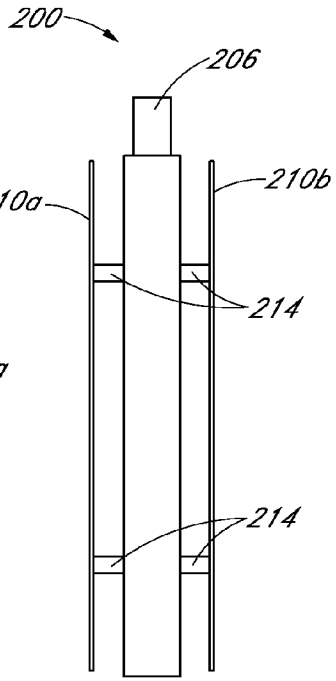
Figure 9:
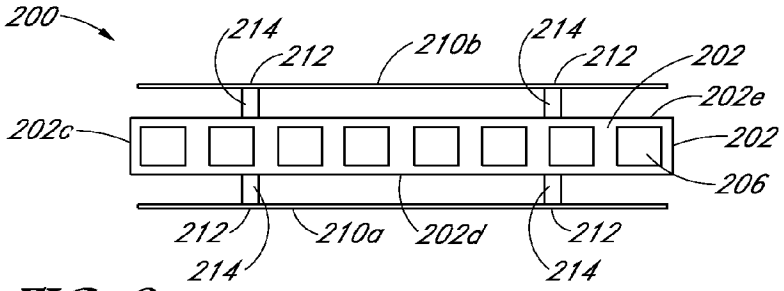
Figure 10:
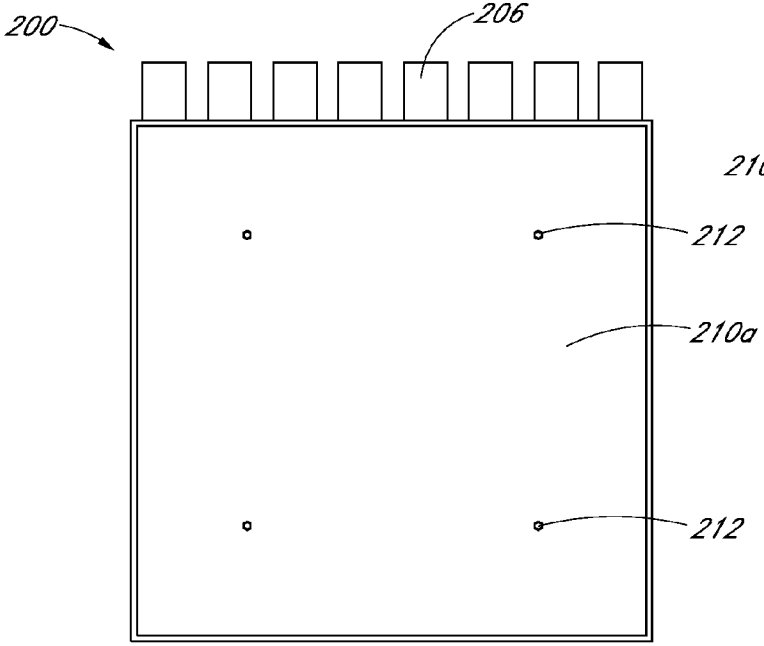

In some embodiments, as shown most clearly in FIGS. 9, 11, and 13, one or more tubes or spacer members 214 can be positioned between the panels 210 and the support member 202 to widen the wall module 210 and/or to provide spacing between the panels 210 and the support member 202. In some embodiments, the fasteners 212 can be threadably received within threaded openings formed in the support member 202. Alternatively, as illustrated in FIG. 13, the fasteners 212 can pass through openings in the panel 210 and the support member 202 and then be threadably received by one or more threaded fasteners 216, which can be threaded nuts, or other similar fasteners.

Figure 14B:
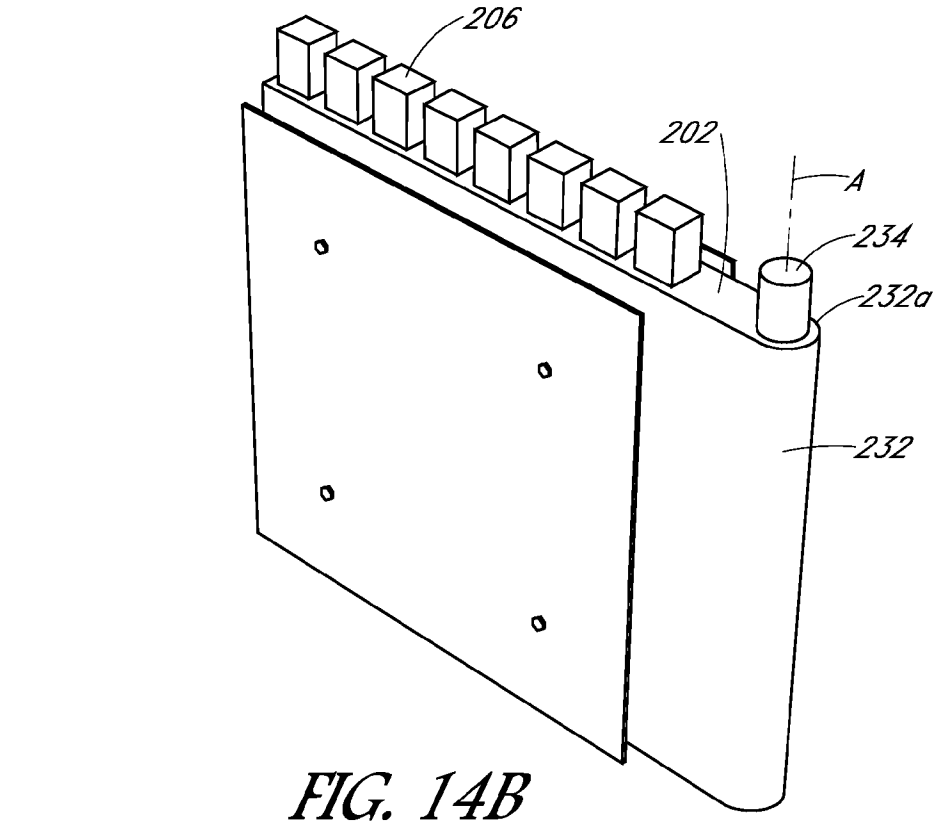
FIGS. 14A-14B are isometric views of additional embodiments of the wall module.
Figure 14A:
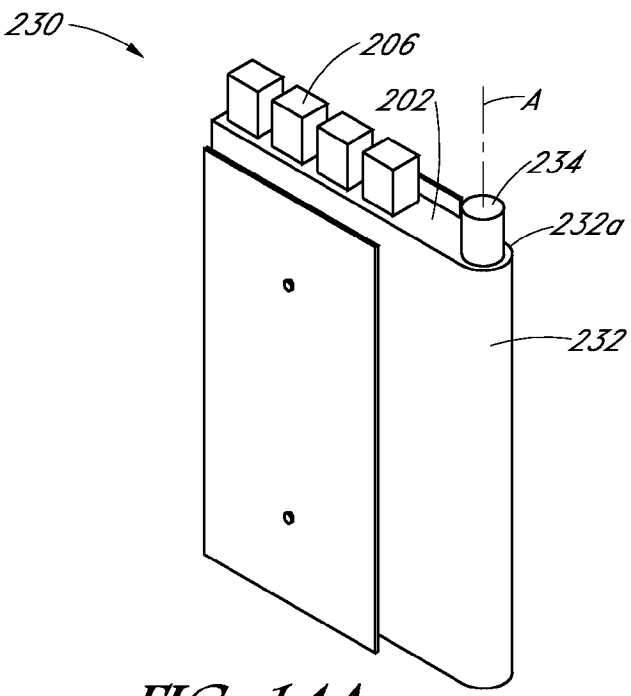

FIGS. 14A and 14B are isometric views of another embodiment of a wall module 230 of variable size. With reference to FIG. 14, any of the wall module embodiments disclosed herein can be configured to have a rotation element or module 232 (also referred to herein as a rotation member) removably or non-removably attached to or integrally formed with the support member 202 configured to permit the module 230 to rotate about an axis A through a centerline of a rotation pin or shaft 234 positioned on an upper surface 232*a* of the rotation member 232. The rotation member 232 can be configured such that the rotation pin or shaft 234 can be received within a complementary shaped recess formed in or positioned at or adjacent to a bottom surface of an adjoining support member 202 of a wall module 200 or wall module 230 having a rotation element 232.

Figure 15:
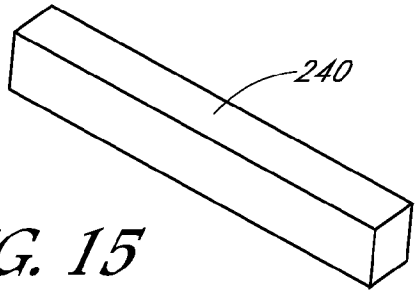
FIG. 15 is an isometric view of a cap member that can be supported on a top surface of any of the support members disclosed herein.

FIG. 15 is an isometric view of a cap member 240 that can be supported on a top surface of any of the support members 202 disclosed herein. The cap member 240 can be used to cover and/or conceal any of the connection members 206. In some embodiments, the cap member 240 can also help hold adjoining support members 202 together, bridging the gap between such support members 202.

Figure 16:
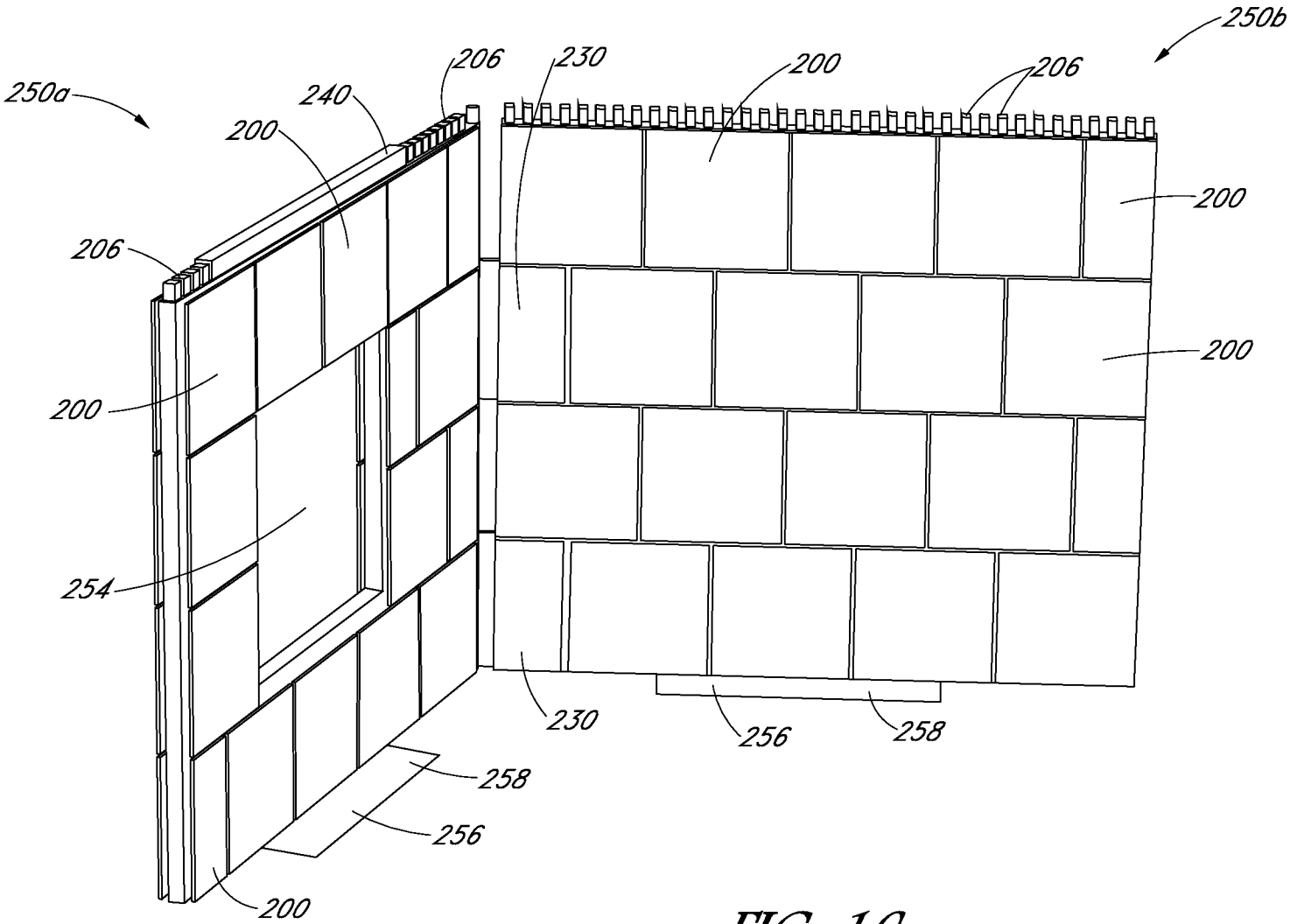
FIGS. 16 and 17 are isometric views of a front and a rear side, respectively, of a first assembled wall structure and a second assembled wall structure, that can be interconnected.
Figure 17:
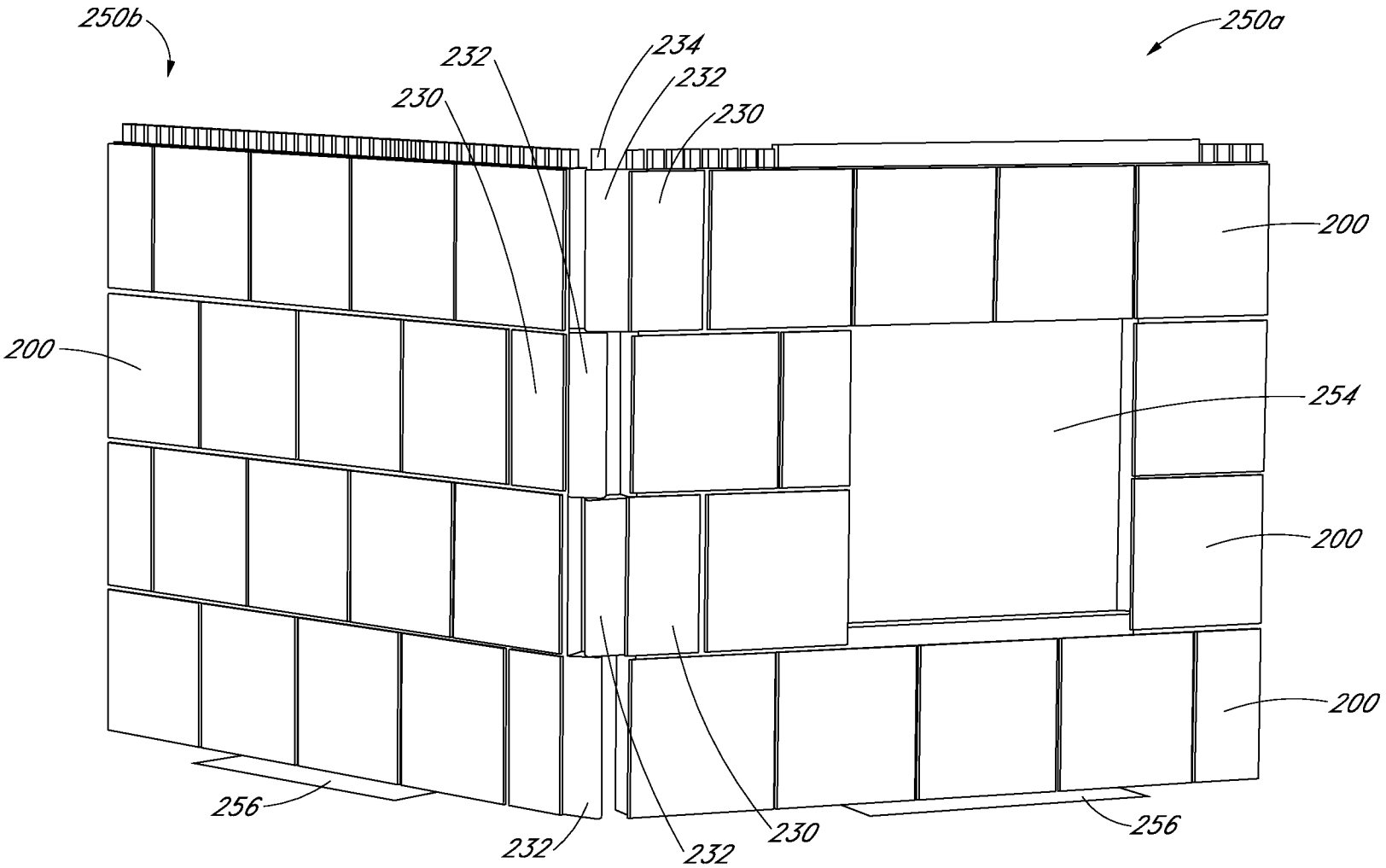

FIG. 16 is an isometric view of a first assembled wall structure 250*a* and a second assembled wall structure 250*b*, that can be interconnected. The assembled wall structures 250 can be comprised of any combination of the wall modules 200, 230 (or any other wall modules disclosed herein) or otherwise, interconnected to form a structurally stable wall structure. In some embodiments, the wall modules 200, 230 (or any other wall modules disclosed herein) can be positioned and interconnected so as to form an opening or window 254 in the wall structure 250, such as the first wall structure 250*a*.

Additionally, in some embodiments, one or more floor support members 256 can be used to support the wall structures 250 in a vertical position or at any suitable angle. In some embodiments, the floor support members 256 can engage or attach to the support members 202 of any of the wall modules to provide a stable connection to the wall module. The floor support members 256 can have a base portion 258 that can be wider than a width of the wall modules, and can have a vertical portion (not shown) that can overlap and/or engage with the support members 202.

Figure 18C:
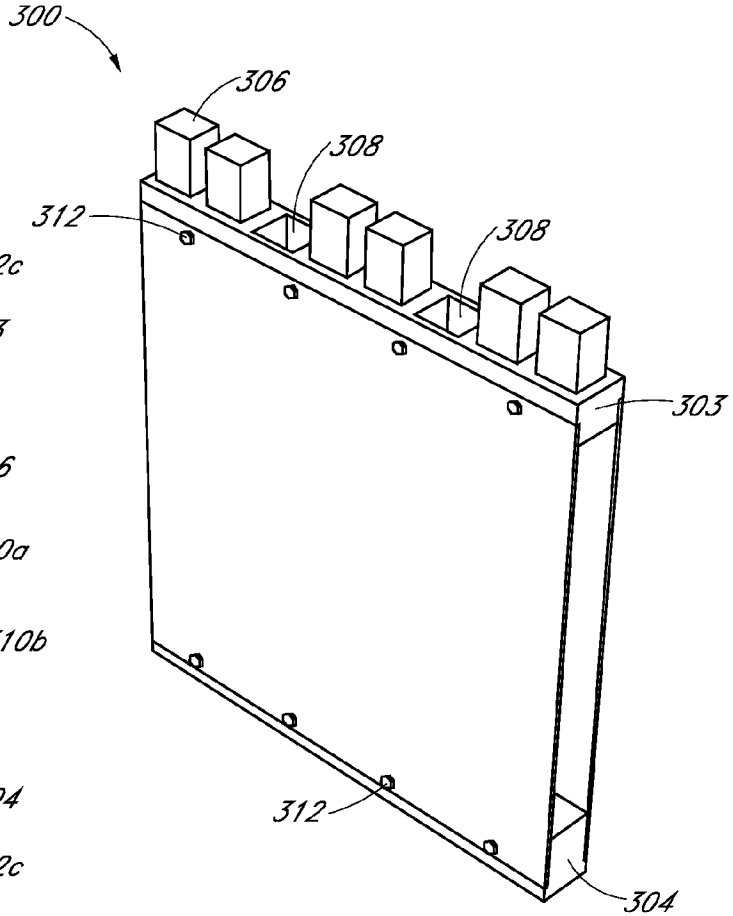
FIGS. 18A, 18B, and 18C illustrate additional embodiments of a wall module of varying size and configurations.
Figure 18B:
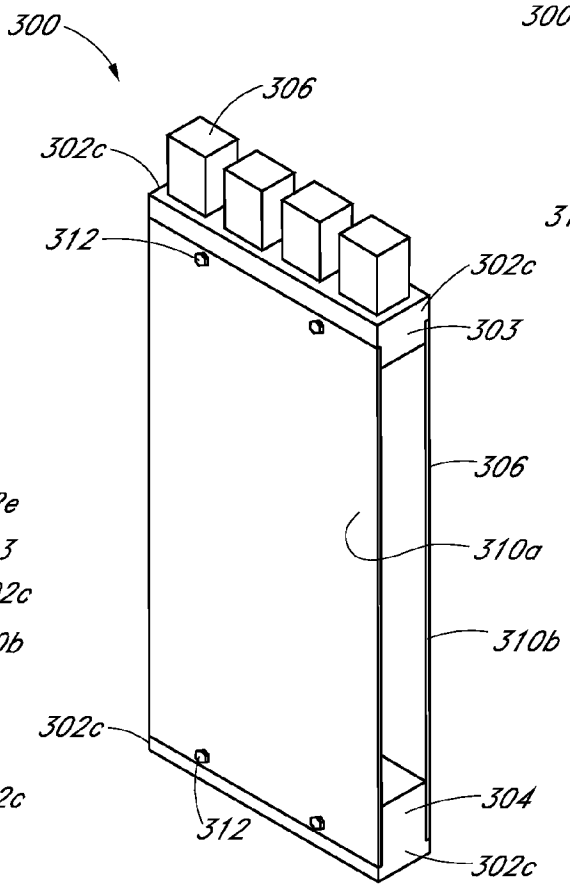
Figure 18A:
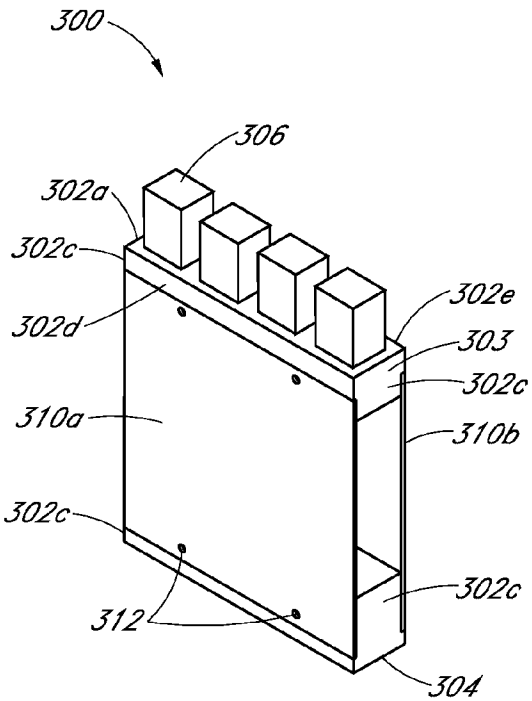
Figure 19:
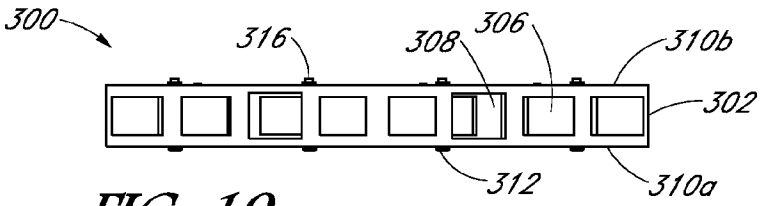
FIGS. 19, 20, 21, and 22, are a top view, front view, side view, and isometric view, respectively, of the embodiment of the wall module illustrated in FIG. 18C.
Figure 20:
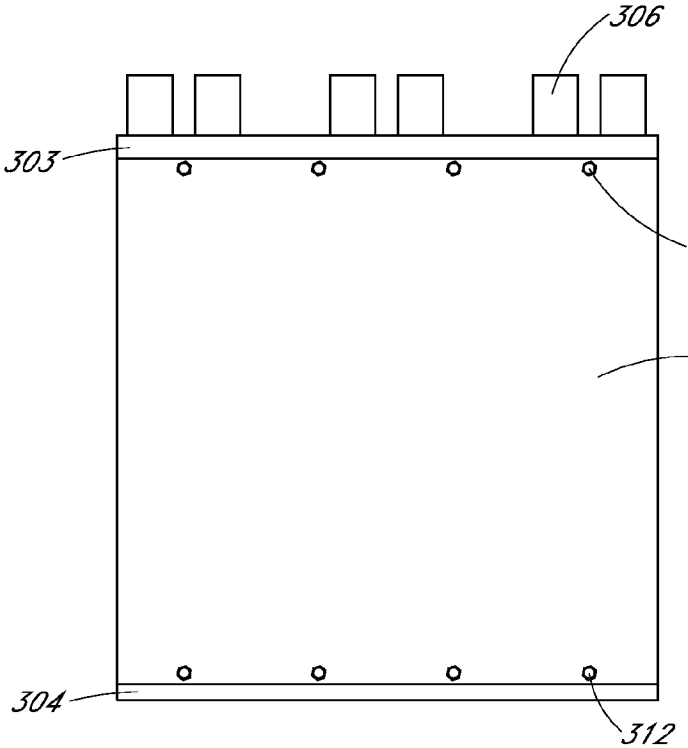
Figure 23:
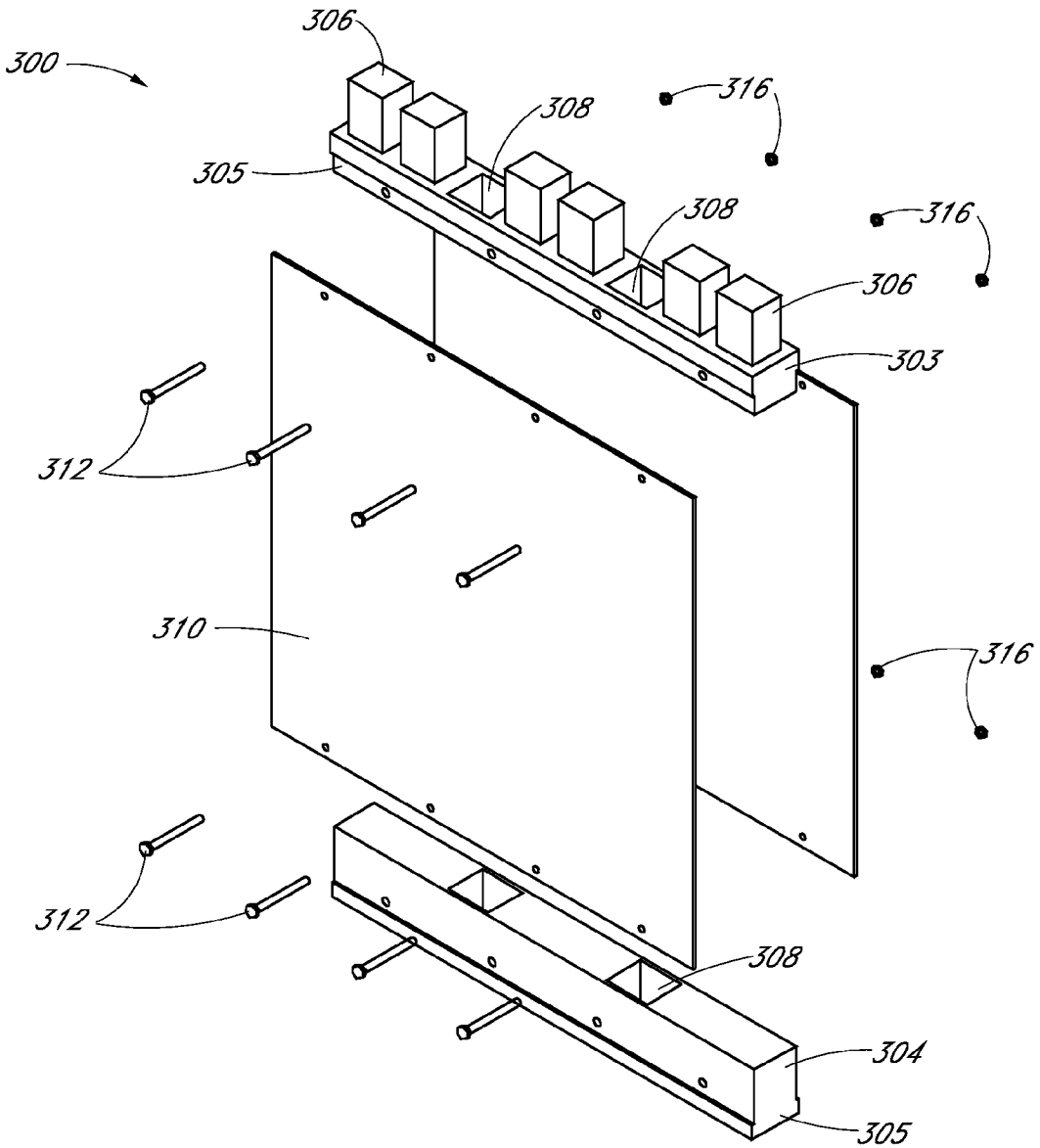
FIG. 23 is an exploded assembly view of the embodiment of the wall module illustrated in FIG. 18C.

FIGS. 18A, 18B, and 18C illustrate additional embodiments of a wall module 300 of varying sizes and configurations. FIGS. 19, 20, 21, and 22, are a top view, front view, side view, and isometric view, respectively, of the embodiment of the wall module 300 illustrated in FIG. 18C. FIG. 23 is an exploded assembly view of the embodiment of the wall module 300 illustrated in FIG. 18C. Any embodiments of the wall modules disclosed herein, including without limitation 300 illustrated in FIGS. 18A, 18B, and 18C, can have any of the same features, materials, components, sizes, or other details or configurations of any other wall module embodiments disclosed herein, including without limitation the wall module 200 discussed above. In any embodiments, the wall modules 300 in any of FIGS. 18A, 18B, and 18C can have the same features and components, but can have a varying size. For example, the wall module embodiment 300 illustrated in FIG. 18A can be approximately 1.5 feet by approximately 1.5 feet, the wall module embodiment 300 illustrated in FIG. 18B can be approximately 3 feet tall by 1.5 feet wide, and the wall module embodiment 300 illustrated in FIG. 18C can be approximately 3 feet tall by 3 feet wide. Additionally, any wall module embodiments disclosed herein can have any of the combination of the foregoing sizes, or any other desired size either greater than or less than the aforementioned ranges.

The wall module 300 can have a support member 302, one or more connector members 306, and one or more cover members 310 (also referred to herein as panels or panel members) supported by the support member 302. The connector members 306 can be configured to be supported by the support member 302 on an upper surface or portion 302*a* of the support member 302. Any number of connector members 306 can be used, depending on the size of the wall module, and the size and/or number of connector members 306 can be used. For example, the wall module embodiment 300 illustrated in FIG. 18A can have four connector members 306, or from two to six connector members 306. The wall module embodiment 300 illustrated in FIG. 18C can have eight connector members 306, or between two or three and ten or more connector members 306. In some embodiments, the connector member 306 can be positioned at both of the two end portions of the support member 302. Additionally, a connector member 306 can be positioned near the middle of the support member 302.

The connector members 306 can be configured to be received within complementary sized openings 308 formed in or positioned at a lower edge 302*b* of the support member 302 so that a plurality of support members 302 can be interconnected to form a larger wall structure. As with any of the embodiments described above, the support members 302 can be used to support display panels (such as, but not limited to, cover members 310), facades, or other aesthetic components. As will be described in greater detail below, any of the support members 302 can have recesses, cuts, openings, weight relief features, or other similar features formed therein to reduce the weight of the support members without unacceptably compromising the stiffness of the support members.

Additionally, in any embodiments, any number of connector members 306 can be positioned on or supported by one or more of the side surfaces 302*c* of the support member 302 so that the support members 302 can be interconnected in a lateral direction as well to provide removable connections between a plurality of laterally arranged wall modules 300. For example, openings can be formed in the side portions 302*c* of any of the support members 302, wherein the connector members 306 can be slidably or otherwise removably supported within the openings. When it is desired to interconnect one or more wall modules 300, one or more connector members 306 can be inserted within the openings formed in an upper surface, lower surface, and/or either of the side surfaces of the support member 302, to interconnect two or more wall modules.

As described above, in any embodiments, the connector members 306 can be removably supported within openings 308 or otherwise formed in the support member 302. Additionally or alternatively, one or more of the connector members 306 can be non-removably supported by the support member 302, or can be integrally formed with the support member 302. Additionally, any embodiments of the wall module 300 wherein the connector members 306 are removably supported by the support member 302, the wall modules 300 can be configured such that the connector members 306 are inhibited from sliding out of the openings formed in the support member 302. This can be accomplished using any number of suitable features, including without limitation hook and loop fasteners, detents and complementary protrusions (depressable or otherwise), magnets, or any combination of the foregoing.

With reference to FIGS. 18A-18C, in some embodiments, the support member 302 can have an upper or first support element 303 positioned at an upper or first end of the module 300 and a lower or second support element 304 positioned at a lower or second end of the module 300. In some embodiments, the first support element 303 and the second support element 304 can be spaced apart from one another and only be interconnected by the panels 310. However, in some embodiments, one or more vertical support elements (not illustrated) can be positioned between the first support element 303 and the second support element 304 to provide vertical stability to the support member 302. Such vertical supports can be bolted to, integrally formed with, or otherwise supported by the first support element 303 and the second support element 304. For example, in some embodiments, the vertical support can have end portions positionable within the openings 308 formed in the first support element 303 and/or the second support element 304.

Additionally, as illustrated in FIG. 18, one or more panels 310 can be supported by the support member 302. For example, and without limitation, a first panel 310*a* can be supported on a first surface 302*d* (which can be a front facing surface) of the support member 302. Additionally, a second panel 310*b* can be supported on a second surface 302*e* (which can be a rear facing surface) of the support member 302. In some embodiments, as in the illustrated embodiment, the panels 310 can be removably attached to or supported by the support member 302 using bolts, screws, press-fit, hook and loop fasteners, or other similar fasteners 312. Additionally, in any embodiments disclosed herein, the panels 310 can be supported by the support member 302 using hook and loop fasteners, latches, hooks, nails, or any other suitable fasteners.

In some embodiments, the fasteners 312 can be threadably received within threaded openings formed in the support member 302. Alternatively, as illustrated in FIG. 23, the fasteners 312 can pass through openings in the panel 310 and the support member 302 then be threadably received by one or more threaded fasteners 316, which can be threaded nuts, or other similar fasteners.

Figure 21:
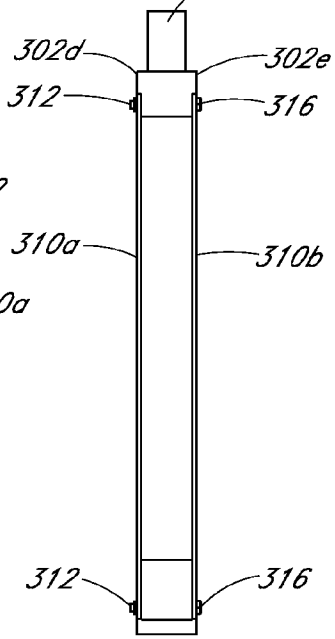
Figure 22:
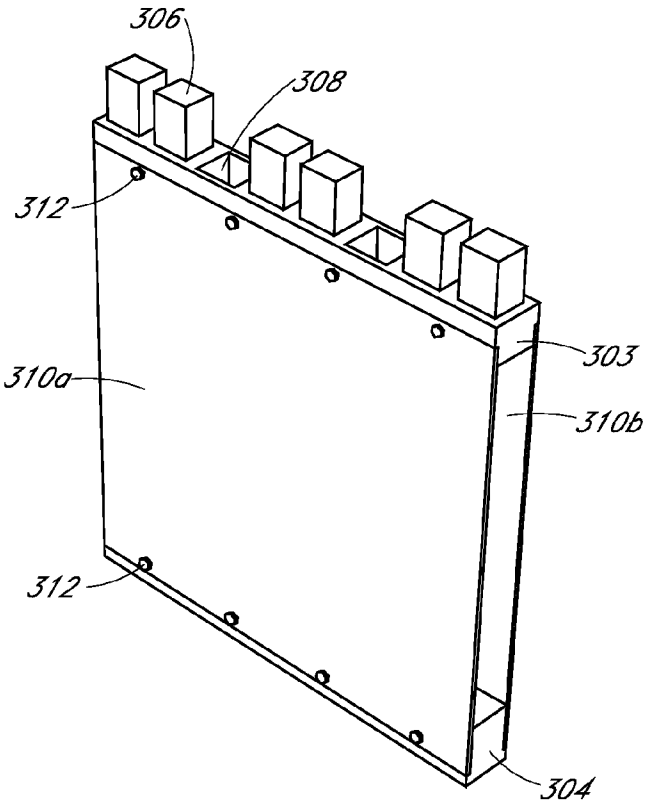

In some embodiments, as shown most clearly in FIGS. 21 and 23, recesses 305 can be formed in the front face 302*d* and rear face 302*e* of the support member 302 (either or both of the first support element 303 and the second support element 304) so that the panels 310 can be recessed relative to an outside surface of the support member 302. For example, in some embodiments, the recess can have a thickness approximately equal to a thickness of any panel member that may be supported by the support member 302.

Figure 24:
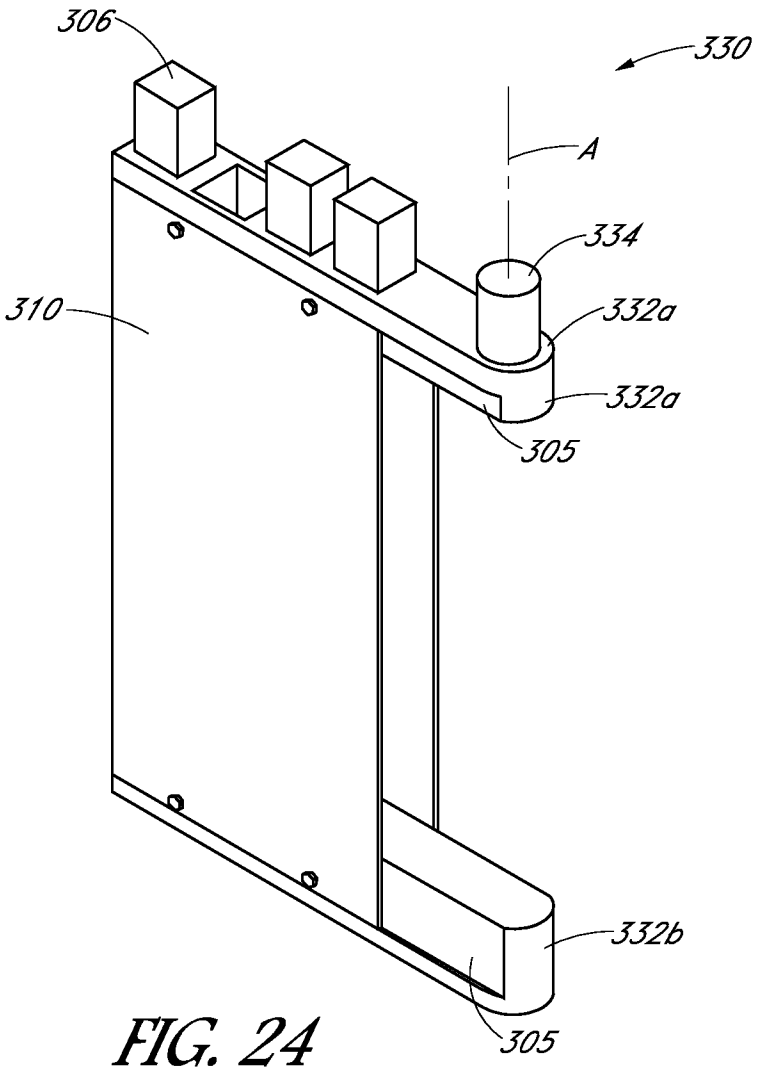
FIG. 24 is an isometric view of another embodiment of the wall module.

With reference to FIG. 24, any of the wall module embodiments disclosed herein can be configured to have a rotation element or module 332 (also referred to herein as a rotation member) removably or non-removably attached to or integrally formed with the support member 302 configured to permit the module 330 to rotate about an axis A through a centerline of a rotation pin or shaft 334 positioned on an upper surface 332*a* of the rotation member 332. The rotation member 332 can be configured such that the rotation pin or shaft 334 can be received within a complementary shaped recess formed in or positioned at or adjacent to a bottom surface of an adjoining support member 302 of a wall module 300 or wall module 330 having a rotation element 332.

Figure 25:
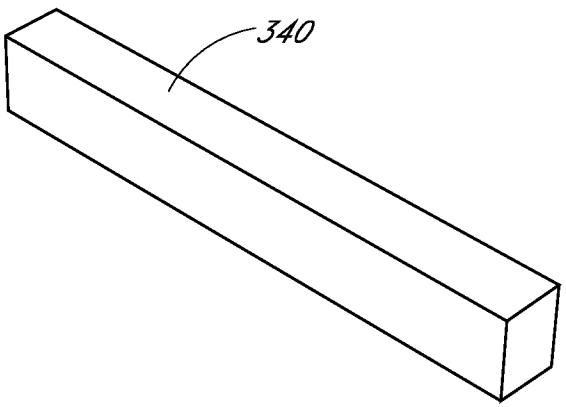
FIG. 25 is an isometric view of a cap member that can be supported on a top surface of any of the support members disclosed herein.

FIG. 25 is an isometric view of a cap member 340 that can be supported on a top surface of any of the support members 302 disclosed herein. The cap member 340 can be used to cover and/or conceal any of the connection members 306. In some embodiments, the cap member 340 can also help hold adjoining support members 302 together, bridging the gap between such support members 302.

Figure 26:
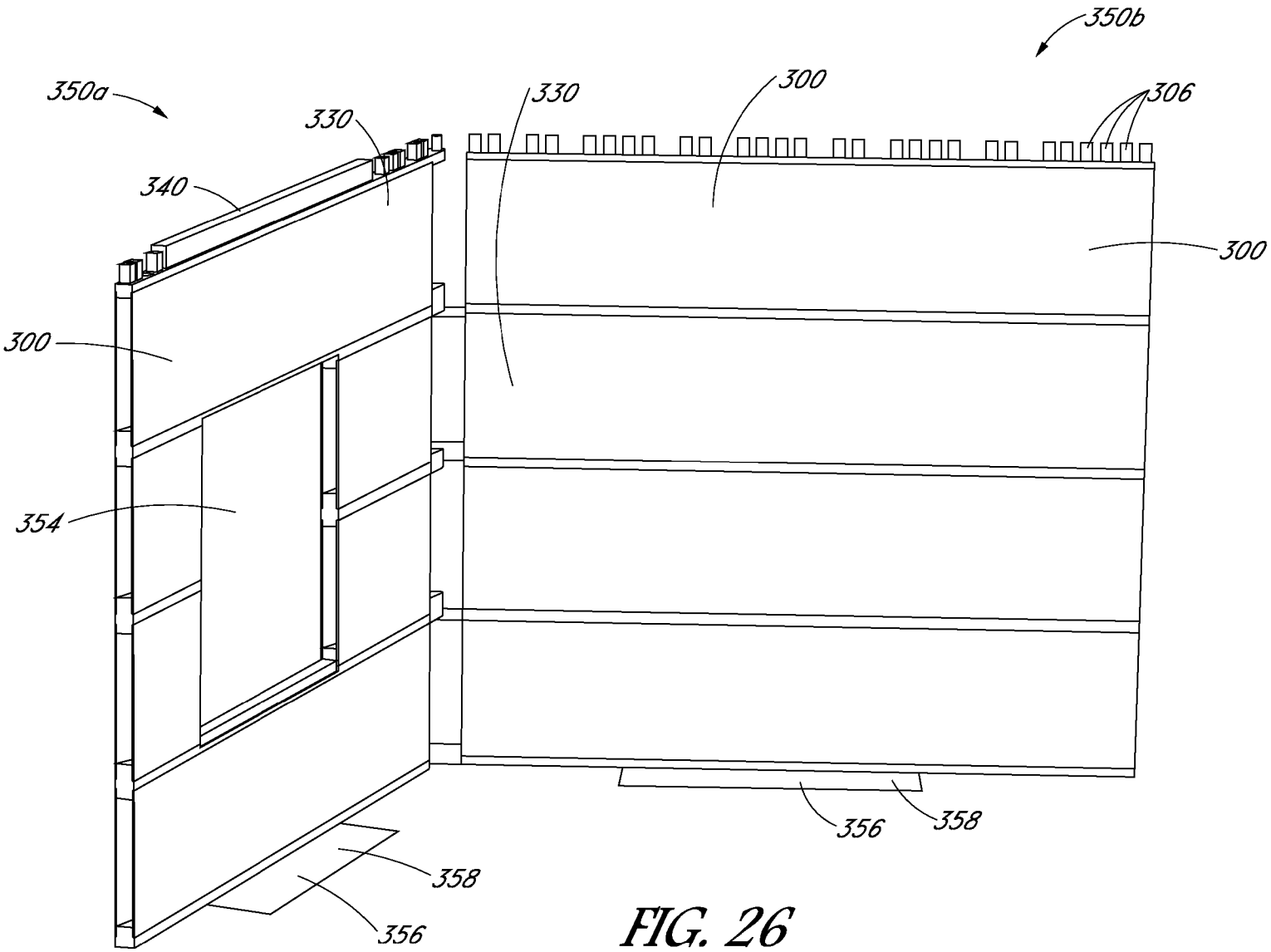
FIGS. 26 and 27 are isometric views of a front and a rear side, respectively, of a first assembled wall structure and a second assembled wall structure, that can be interconnected.
Figure 27:
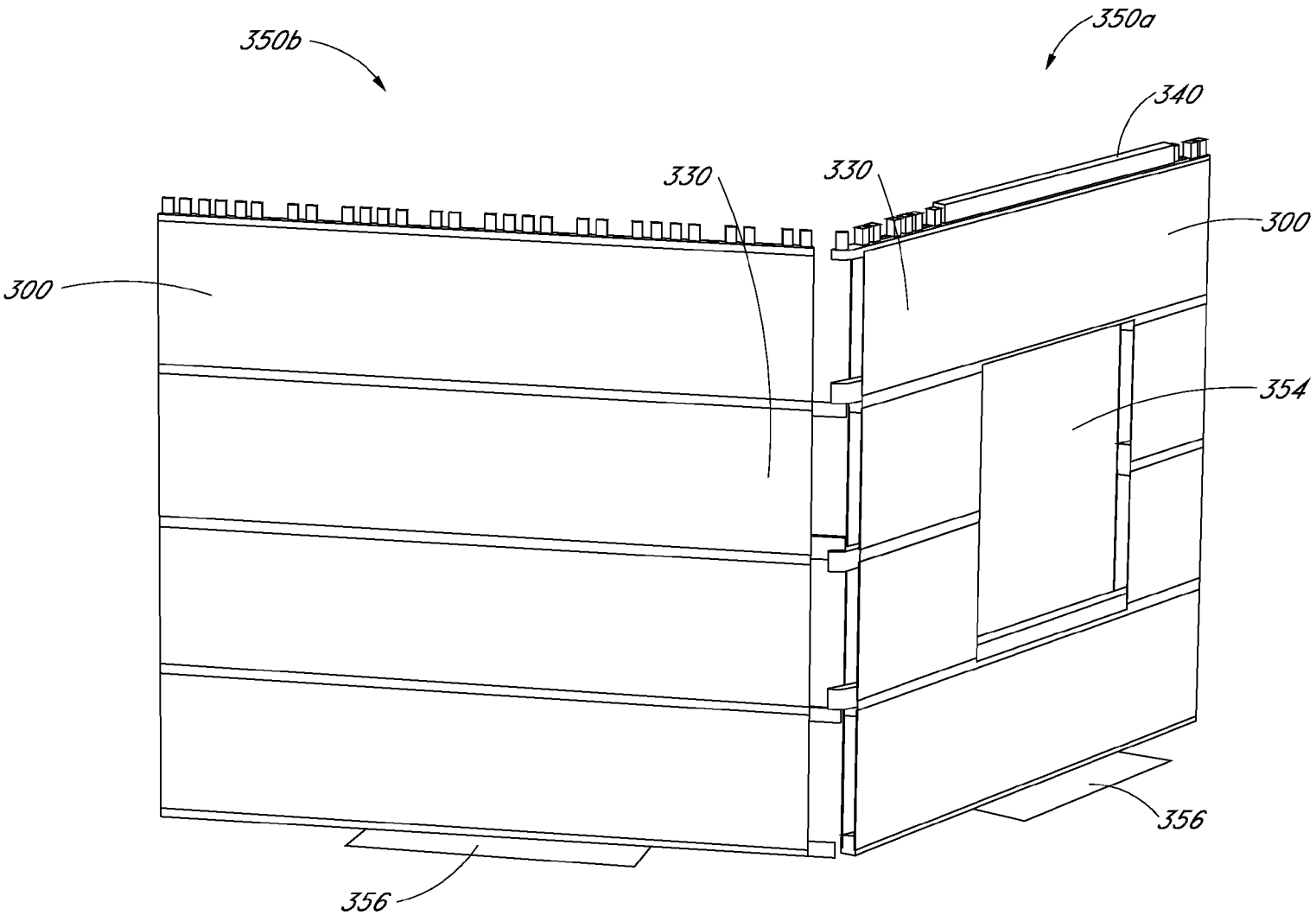

FIG. 26 is an isometric view of a first assembled wall structure 350*a* and a second assembled wall structure 350*b*, that can be interconnected. The assembled wall structures 350 can be comprised of any combination of the wall modules 300, 330 (or any other wall modules disclosed herein) or otherwise, interconnected to form a structurally stable wall structure. In some embodiments, the wall modules 300, 330 (or any other wall modules disclosed herein) can be positioned and interconnected so as to form an opening or window 354 in the wall structure 350, such as the first wall structure 350*a*.

Additionally, in some embodiments, one or more floor support members 356 can be used to support the wall structures 350 in a vertical position or orientation, or at any suitable angular orientation. In some embodiments, the floor support members 356 can engage or attach to the support members 302 of any of the wall modules to provide a stable connection to the wall module. The floor support members 356 can have a base portion 358 that can be wider than a width of the wall modules, and can have a vertical portion (not shown) that can overlap and/or engage with the support members 302.

Figure 28B:
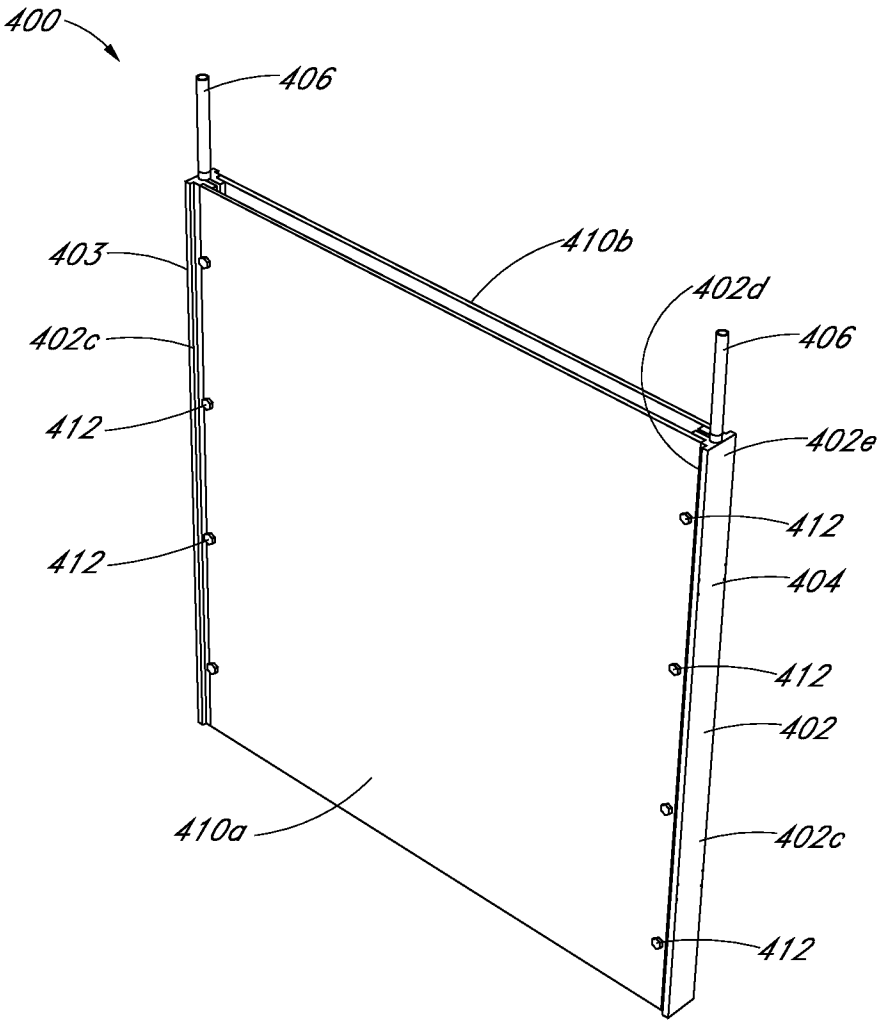
FIGS. 28A and 28B illustrate additional embodiments of a wall module of varying size and configurations.
Figure 28A:
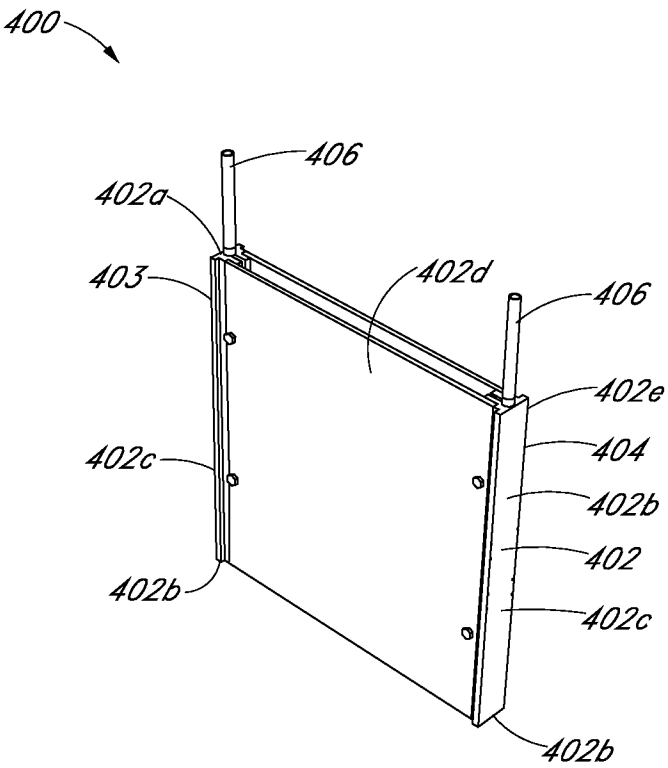
Figure 33:
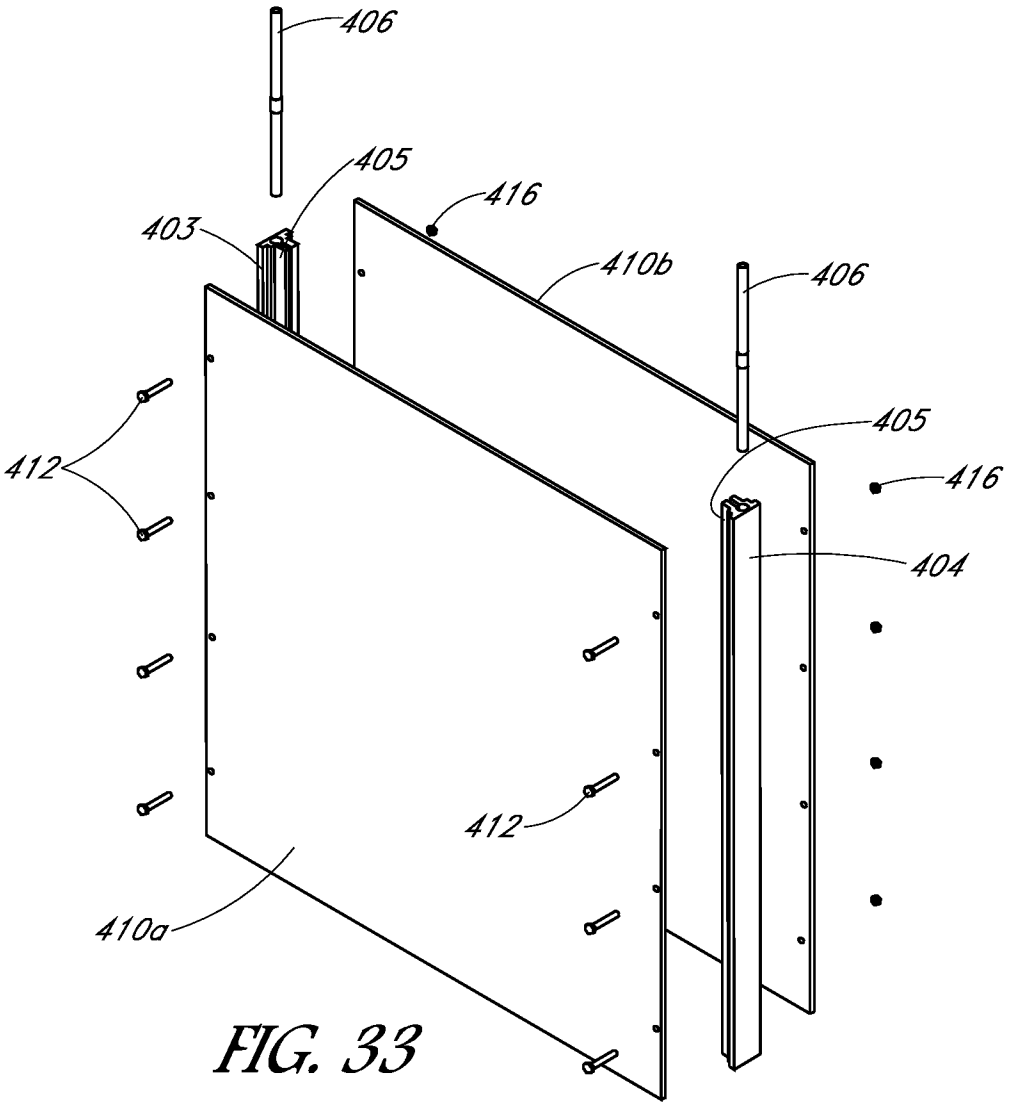
FIG. 33 is an exploded assembly view of the embodiment of the wall module illustrated in FIG. 28B.

FIGS. 28A and 28B illustrate additional embodiments of a wall module 400 of varying sizes and configurations. FIGS. 29, 30, 31, and 32, are a top view, front view, side view, and isometric view, respectively, of the embodiment of the wall module 400 illustrated in FIG. 28B. FIG. 33 is an exploded assembly view of the embodiment of the wall module 400 illustrated in FIG. 28B. Any embodiments of the wall modules disclosed herein, including without limitation 400 illustrated in FIGS. 28A and 28B, can have any of the same features, materials, components, sizes, or other details or configurations of any other wall module embodiments disclosed herein, including without limitation the wall module 200 or the wall module 300 discussed above. In any embodiments, the wall modules 400 in any of FIGS. 28A and 28B can have the same features and components, but can have a varying size. For example, the wall module embodiment 400 illustrated in FIG. 28A can be approximately 1.5 feet by approximately 1.5 feet, and the wall module embodiment 400 illustrated in FIG. 28B can be approximately 3 feet or more tall by 3 feet or more wide. Additionally, any wall module embodiments disclosed herein can have any of the combination of the foregoing sizes, or any other desired size either greater than or less than the aforementioned ranges.

The wall module 400 can have a support member 402, one or more connector members 406, and one or more cover members 410 (also referred to herein as panels or panel members) supported by the support member 402. The connector members 406 can be configured to be supported by the support member 402 on an upper surface or portion 402*a* of the support member 402. Any number of connector members 406 can be used, depending on the size of the wall module, and the size and/or number of connector members 406 can be used. For example, the wall module embodiment 400 illustrated in FIG. 28A can have two connector members 406. In some embodiments, the connector member 406 can be positioned at both of the two end portions of the support member 402. Additionally, in some embodiments, a connector member 406 can be positioned near the middle of the support member 402.

The connector members 406 can be configured to be received within complementary sized openings 408 formed in or positioned at a lower edge 402*b* of the support member 402 so that a plurality of support members 402 can be interconnected to form a larger wall structure. As with any of the embodiments described above, the support members 402 can be used to support display panels (such as, but not limited to, cover members 410), facades, or other aesthetic components. As will be described in greater detail below, any of the support members 402 can have recesses, cuts, openings, weight relief features, or other similar features formed therein to reduce the weight of the support members without unacceptably compromising the stiffness of the support members.

Additionally, in any embodiments, any number of connector members 406 can be positioned on or supported by one or more of the side surfaces 402*c* of the support member 402 so that the support members 402 can be interconnected in a lateral direction as well to provide removable connections between a plurality of laterally arranged wall modules 400. For example, openings can be formed in the side portions 402*c* of any of the support members 402, wherein the connector members 406 can be slidably or otherwise removably supported within the openings. When it is desired to interconnect one or more wall modules 400, one or more connector members 406 can be inserted within the openings formed in an upper surface, lower surface, and/or either of the side surfaces of the support member 402, to interconnect two or more wall modules.

As described above, in any embodiments, the connector members 406 can be removably supported within openings 408 or otherwise formed in the support member 402. Additionally or alternatively, one or more of the connector members 406 can be non-removably supported by the support member 402, or can be integrally formed with the support member 402. Additionally, any embodiments of the wall module 400 wherein the connector members 406 are removably supported by the support member 402, the wall modules 400 can be configured such that the connector members 406 are inhibited from sliding out of the openings formed in the support member 402. This can be accomplished using any number of suitable features, including without limitation hook and loop fasteners, detents and complementary protrusions (depressable or otherwise), magnets, or any combination of the foregoing.

With reference to FIGS. 28A-28B, in some embodiments, the support member 402 can have a first side support element 403 positioned at a first side (which can be a left side) of the module 400 and a second support element 404 positioned at a second side (which can be a right side) of the module 400. In some embodiments, the first support element 403 and the second support element 404 can be spaced apart from one another and only be interconnected by the panels 410. However, in some embodiments, one or more lateral support members (not illustrated) can be positioned between the first support element 403 and the second support element 404 to provide lateral stability to the support member 402 and, hence, the wall module 400. Such lateral supports can be bolted to, integrally formed with, or otherwise supported by the first support element 403 and the second support element 404. For example, in some embodiments, the lateral support or supports can have end portions positionable within openings formed in the first and/or second support elements 403, 404.

Additionally, as illustrated in FIG. 28, one or more panels 410 can be supported by the support member 402. For example, and without limitation, a first panel 410*a* can be supported on a first surface 402*d* (which can be a front facing surface) of the support member 402. Additionally, a second panel 410*b* can be supported on a second surface 402*e* (which can be a rear facing surface) of the support member 402. In some embodiments, as in the illustrated embodiment, the panels 410 can be removably attached to or supported by the support member 402 using bolts, screws, press-fit, hook and loop fasteners, or other similar fasteners 412. Additionally, in any embodiments disclosed herein, the panels 410 can be supported by the support member 402 using hook and loop fasteners, latches, hooks, nails, or any other suitable fasteners.

In some embodiments, the fasteners 412 can be threadably received within threaded openings formed in the support member 402. Alternatively, as illustrated in FIG. 33, the fasteners 412 can pass through openings in the panel 410 and the support member 402 then be threadably received by one or more threaded fasteners 416, which can be threaded nuts, or other similar fasteners.

In some embodiments, as shown most clearly in FIGS. 31 and 33, recesses 405 can be formed in the front face 402*d* and rear face 402*e* of the support member 402 (either or both of the first support element 403 and the second support element 404) so that the panels 410 can be recessed relative to an outside surface of the support member 402. For example, in some embodiments, the recess can have a thickness approximately equal to a thickness of any panel member that may be supported by the support member 402.

Figure 34:
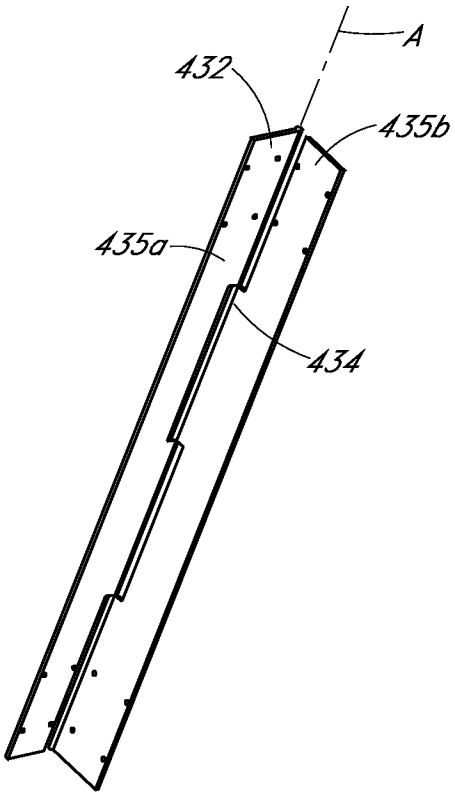
FIG. 34 is an isometric view of an embodiment of a hinge member.

FIG. 34 is an isometric view of an embodiment of a hinge member 432 that can be used with any of the wall module embodiments disclosed herein, including without limitation, wall module 430. The hinge 432 can be removably or non-removably attached to the side portions of any of the wall modules disclosed herein. The hinge member 432 is configured to rotate about an axis A through a centerline of a rotation pin or shaft 434 positioned between and coupling two plates or panels 435*a*, 435*b* of the hinge member.

Figure 35:
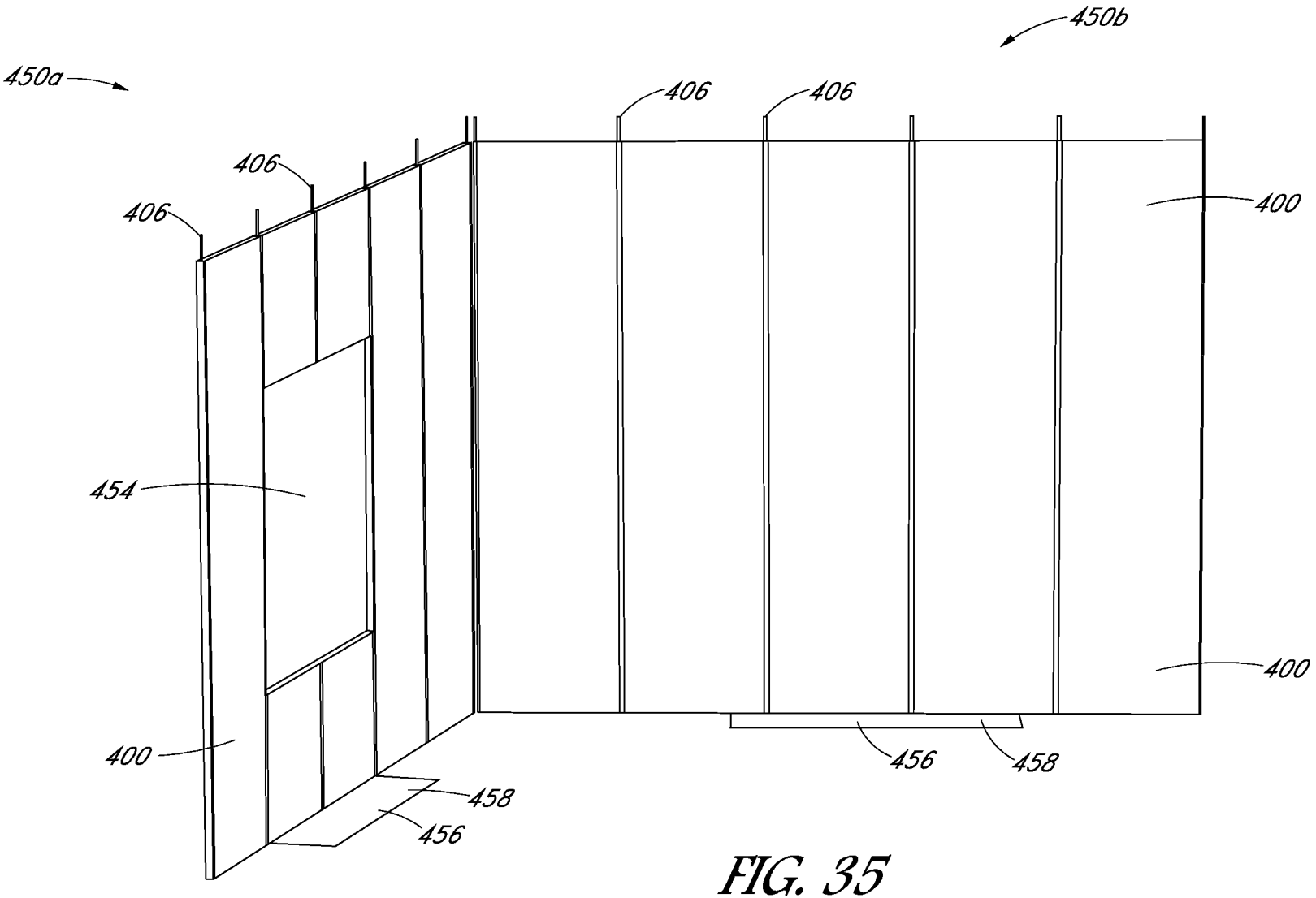
FIGS. 35 and 36 are isometric views of a front and a rear side, respectively, of a first assembled wall structure and a second assembled wall structure, that can be interconnected.
Figure 36:
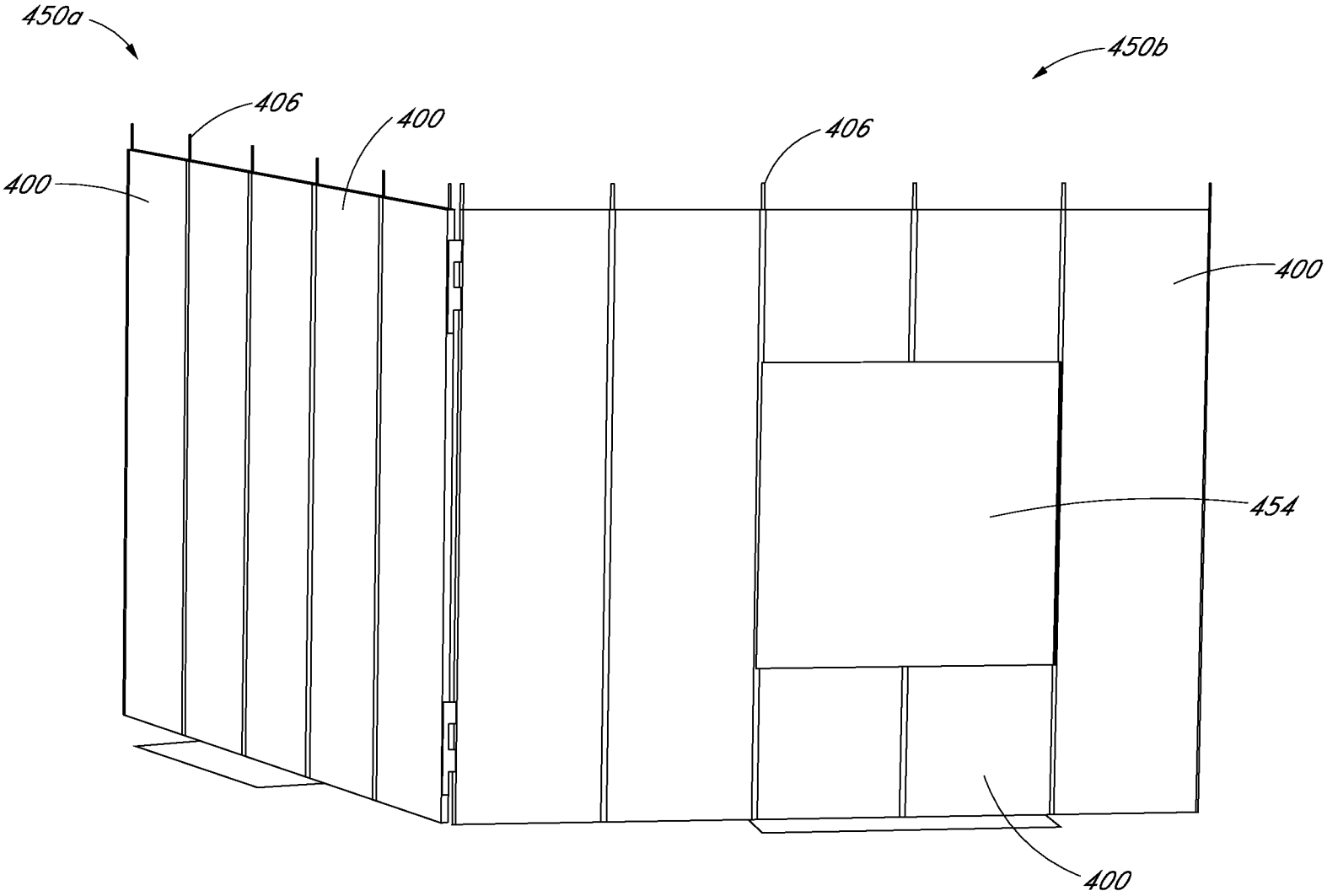

FIG. 35 is an isometric view of a first assembled wall structure 450*a* and a second assembled wall structure 450*b*, that can be interconnected. The assembled wall structures 450 can be comprised of any combination of the wall modules 400 (or any other wall modules disclosed herein of varying sizes) or otherwise, interconnected to form a structurally stable wall structure 450. In some embodiments, the wall modules 400 (or any other wall modules disclosed herein) can be positioned and interconnected so as to form an opening or window 454 in the wall structure 450, such as the first wall structure 450*a*. Any embodiments disclosed herein can have multiple openings or windows formed in the wall structures.

Additionally, in some embodiments, one or more floor support members 456 can be used to support the wall structures 450 in a vertical position or orientation, or at any suitable angular orientation. In some embodiments, the floor support members 456 can engage or attach to the support members 402 of any of the wall modules to provide a stable connection to the wall module. The floor support members 456 can have a base portion 458 that can be wider than a width of the wall modules, and can have a vertical portion (not shown) that can overlap and/or engage with the support members 402 and/or panels.

Figure 37C:
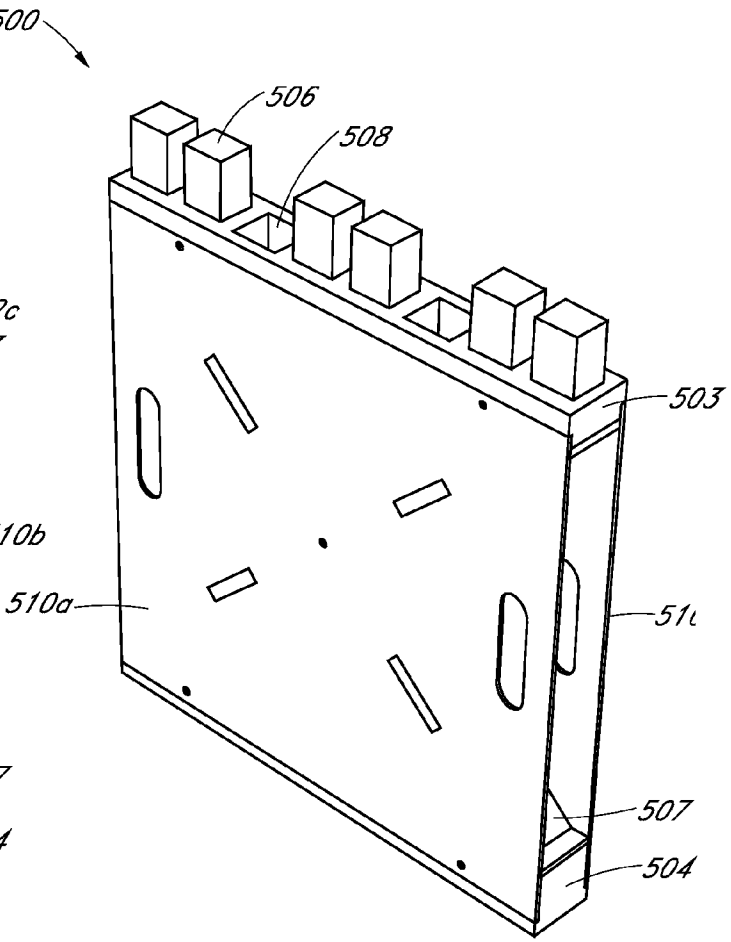
FIGS. 37A, 37B, and 37C illustrate additional embodiments of a wall module of varying sizes and configurations.
Figure 37B:
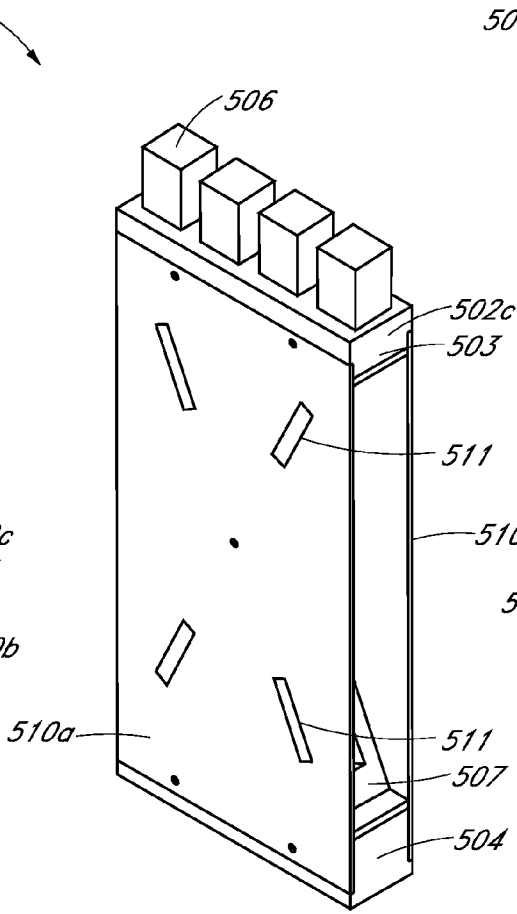
Figure 37A:
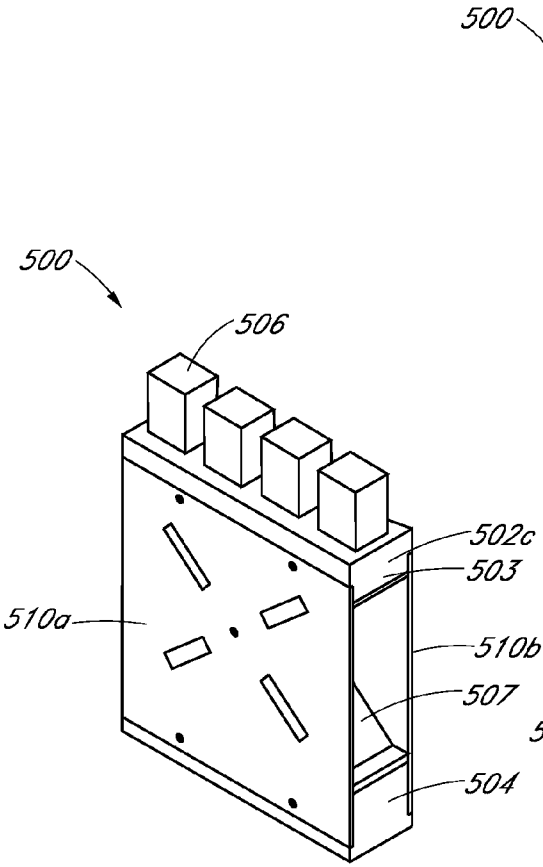
Figure 41:
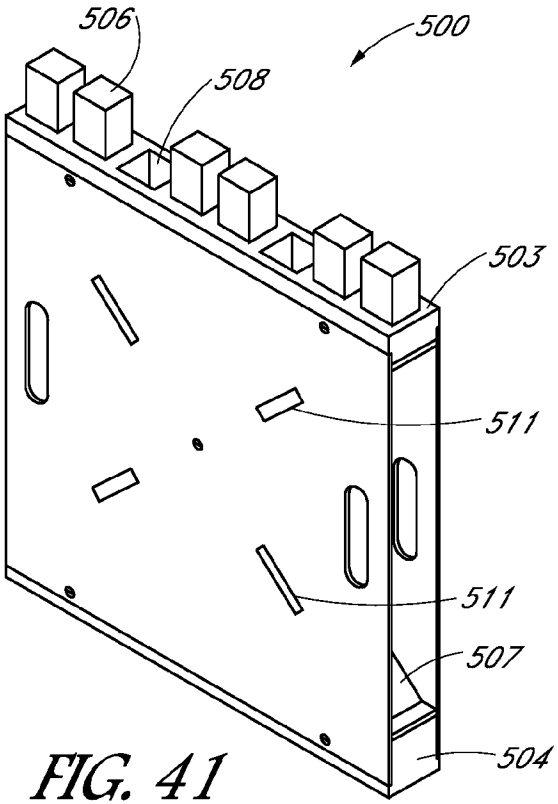
FIGS. 38, 39, 40, and 41, are a top view, front view, side view, and isometric view, respectively, of the embodiment of the wall module illustrated in FIG. 37C.
Figure 40:
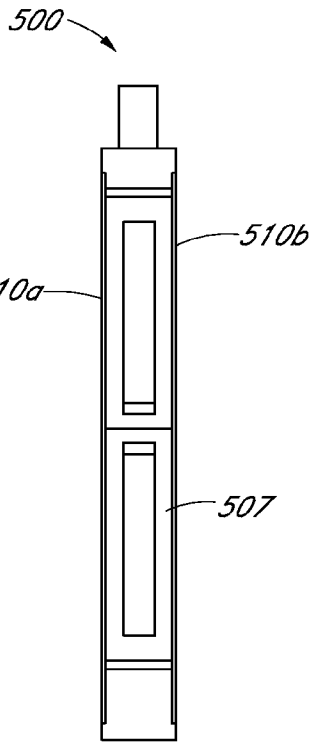
Figure 38:
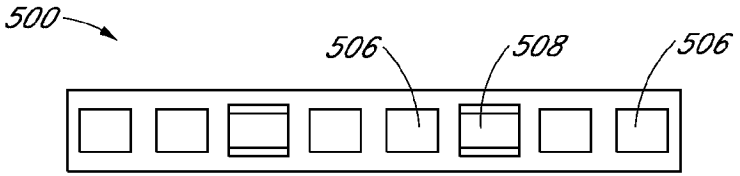
Figure 39:
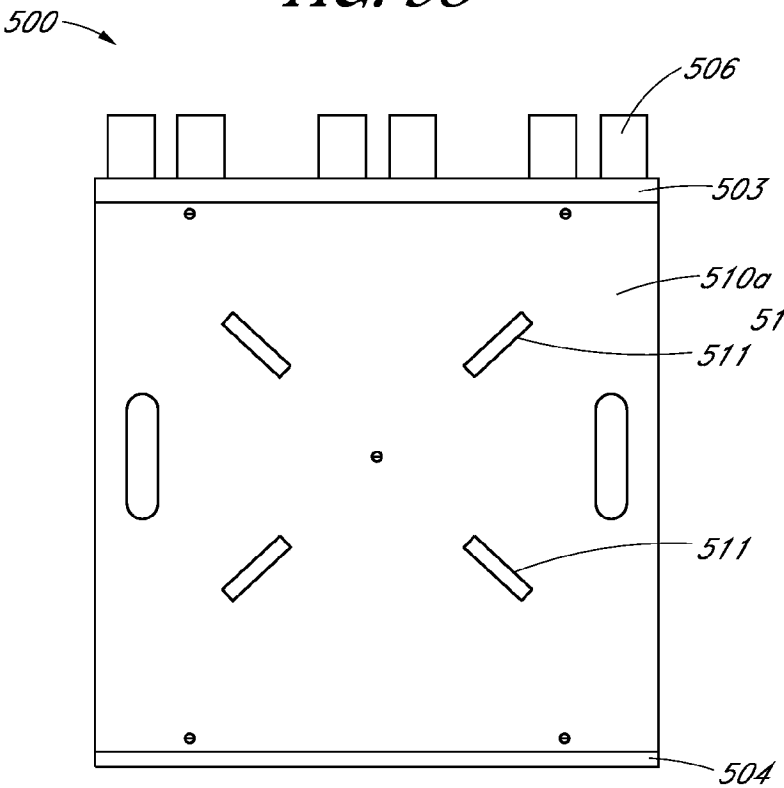
Figure 42:
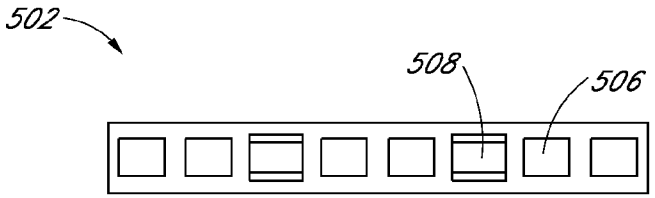
FIGS. 42, 43, 44, and 45, are a top view, front view, side view, and isometric view, respectively, of the embodiment of the support member of the wall module embodiment illustrated in FIG. 37C.
Figure 43:
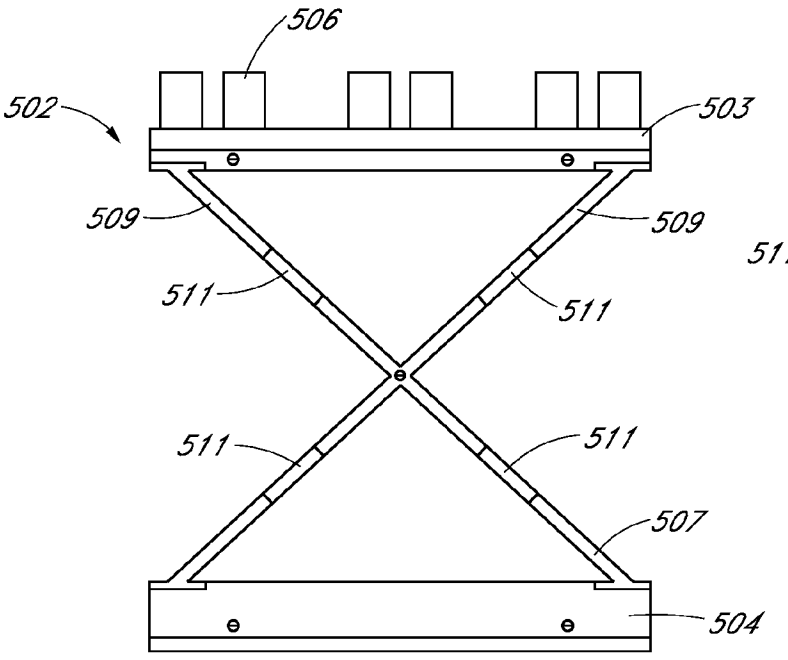
Figure 44:
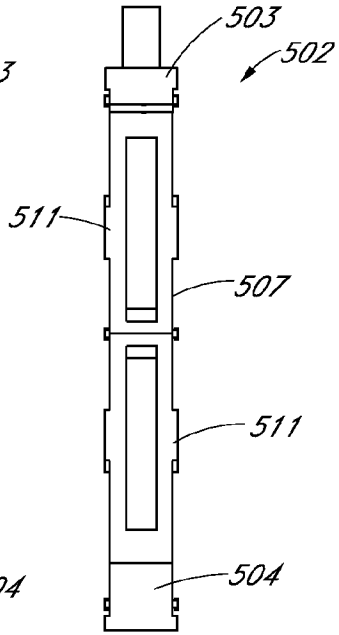
Figure 45:
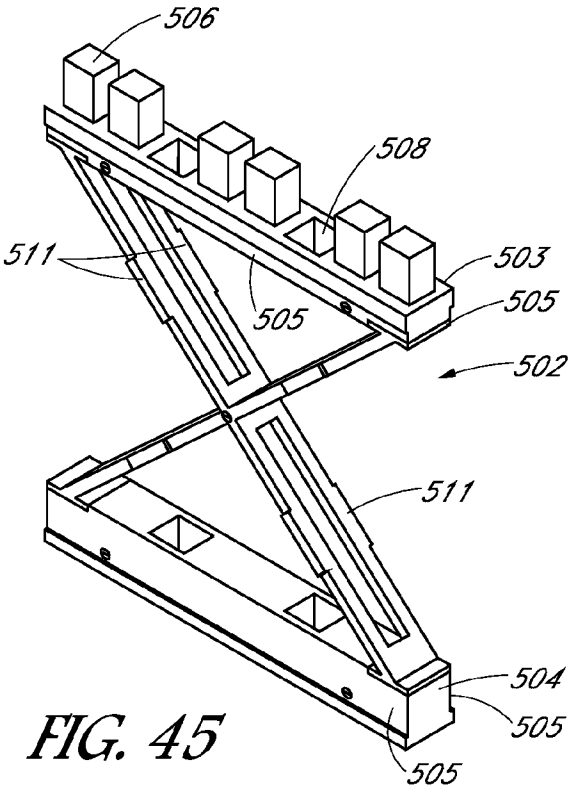

FIGS. 37A, 37B, and 37C illustrate additional embodiments of a wall module 500 of varying sizes and configurations. FIGS. 38, 39, 40, and 41, are a top view, front view, side view, and isometric view, respectively, of the embodiment of the wall module 500 illustrated in FIG. 37C. FIGS. 42, 43, 44, and 45, are a top view, front view, side view, and isometric view, respectively, of the embodiment of the support member 502 of the wall module embodiment illustrated in FIG. 37C.

Figure 46:
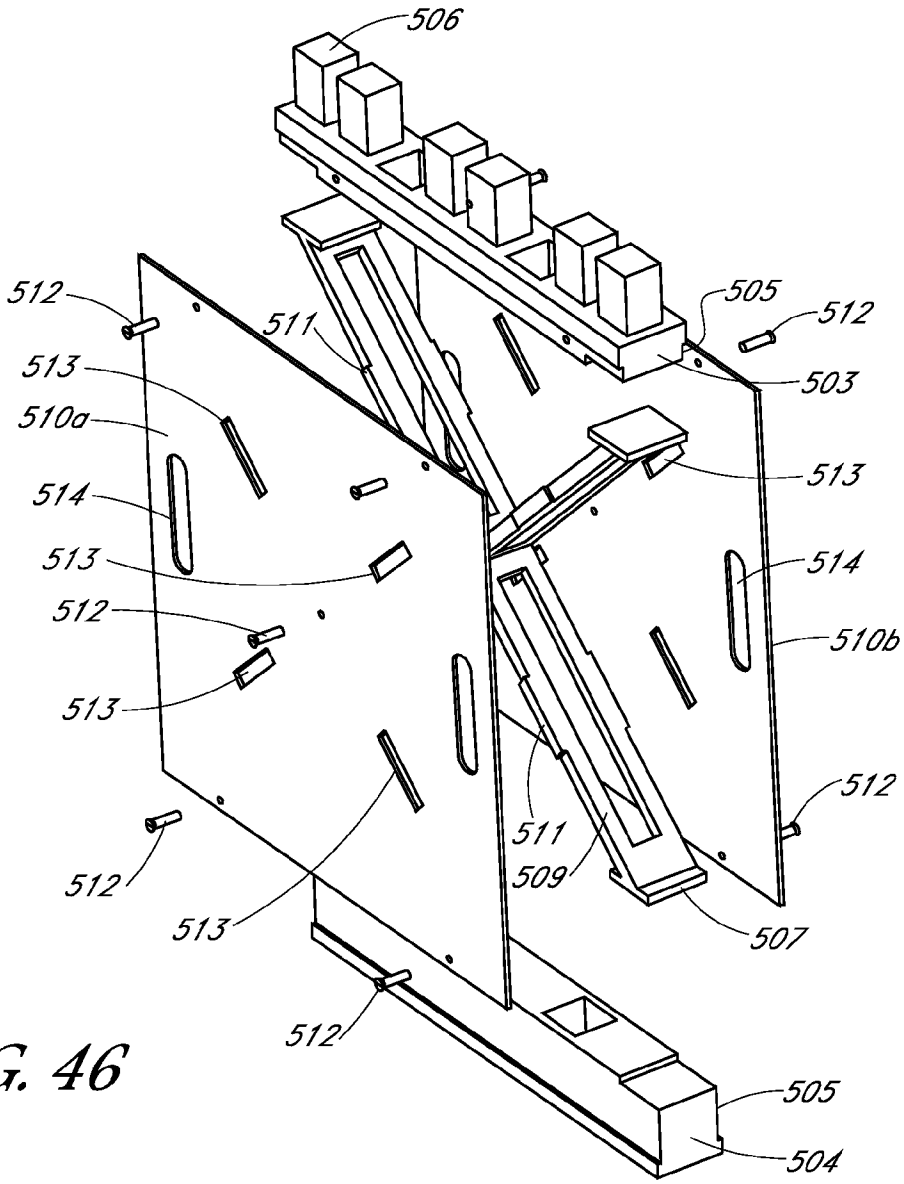
FIG. 46 is an exploded assembly view of the embodiment of the wall module illustrated in FIG. 37C.

FIG. 46 is an exploded assembly view of the embodiment of the wall module 500 illustrated in FIG. 37C. Any embodiments of the wall modules disclosed herein, including without limitation 500 illustrated in FIGS. 37A, 37B, and 37C, can have any of the same features, materials, components, sizes, or other details or configurations of any other wall module embodiments disclosed herein, including without limitation the wall modules 200, 300, or 400 discussed above.

In any embodiments, the wall modules 500 in any of FIGS. 37A, 37B, and 37C can have the same features and components, but can have a varying size. For example, the wall module embodiment 500 illustrated in FIG. 37A can be approximately 1.5 feet by approximately 1.5 feet, the wall module embodiment 500 illustrated in FIG. 37B can be approximately 3 feet tall by 1.5 feet wide, and the wall module embodiment 500 illustrated in FIG. 37C can be approximately 3 feet tall by 3 feet wide. Additionally, any wall module embodiments disclosed herein can have any of the combination of the foregoing sizes, or any other desired size either greater than or less than the aforementioned values.

The wall module 500 can have a support member 502, one or more connector members 506, and one or more cover members 510 (also referred to herein as panels or panel members) supported by the support member 502. The connector members 506 can be configured to be supported by the support member 502 on an upper surface or portion 502*a* of the support member 502. Any number of connector members 506 can be used, depending on the size of the wall module, and the size and/or number of connector members 506 can be used. For example, the wall module embodiment 500 illustrated in FIG. 37A can have four connector members 506, or from two to six connector members 506. The wall module embodiment 500 illustrated in FIG. 37C can have six connector members 506, or between two or three and ten or more connector members 506. In some embodiments, the connector member 506 can be positioned at both of the two end portions of the support member 502. Additionally, a connector member 506 can be positioned near the middle of the support member 502.

The connector members 506 can be configured to be received within complementary sized openings 508 formed in or positioned at a lower edge 502*b* of the support member 502 so that a plurality of support members 502 can be interconnected to form a larger wall structure. As with any of the embodiments described above, the support members 502 can be used to support display panels (such as, but not limited to, cover members 510), facades, or other aesthetic components. As will be described in greater detail below, any of the support members 502 can have recesses, cuts, openings, weight relief features, or other similar features formed therein to reduce the weight of the support members without unacceptably compromising the stiffness of the support members.

Additionally, in any embodiments, any number of connector members 506 can be positioned on or supported by one or more of the side surfaces 502*c* of the support member 502 so that the support members 502 can be interconnected in a lateral direction as well to provide removable connections between a plurality of laterally arranged wall modules 500. For example, openings can be formed in the side portions 502*c* of any of the support members 502, wherein the connector members 506 can be slidably or otherwise removably supported within the openings. When it is desired to interconnect one or more wall modules 500, one or more connector members 506 can be inserted within the openings formed in an upper surface, lower surface, and/or either of the side surfaces of the support member 502, to interconnect two or more wall modules.

As described above, in any embodiments, the connector members 506 can be removably supported within openings 508 or otherwise formed in the support member 502. Additionally or alternatively, one or more of the connector members 506 can be non-removably supported by the support member 502, or can be integrally formed with the support member 502. Additionally, any embodiments of the wall module 500 wherein the connector members 506 are removably supported by the support member 502, the wall modules 500 can be configured such that the connector members 506 are inhibited from sliding out of the openings formed in the support member 502. This can be accomplished using any number of suitable features, including without limitation hook and loop fasteners, detents and complementary protrusions (depressable or otherwise), magnets, or any combination of the foregoing.

In some embodiments, the support member 502 can have an upper or first support element 503 positioned at an upper or first end of the module 500 and a lower or second support element 504 positioned at a lower or second end of the module 500. In some embodiments, the first support element 503 and the second support element 504 can be spaced apart from one another supported vertically by one or more struts 509 (also referred to herein as vertical support element, or member). In some embodiments, two struts 509 can be interconnected and used to support the first and second support elements 503, 504. The struts 509 can be positioned between the first support element 503 and the second support element 504 to provide vertical stability to the support member 502. Such vertical supports can be bolted to, integrally formed with, or otherwise supported by the first support element 503 and the second support element 504. For example, in some embodiments, the vertical support can have end portions positionable within or adjacent to recesses formed in the first support element 503 and/or the second support element 504. In any embodiments disclosed herein, any portion or any members of the support member (including, without limitation, the struts) can have recesses, cuts, openings, weight relief features, or other similar features formed therein to reduce the weight of the support members without unacceptably compromising the stiffness of the support members.

Additionally, as illustrated in FIG. 37, one or more panels 510 can be supported by the support member 502. For example, and without limitation, a first panel 510*a* can be supported on a first surface 502*d* (which can be a front facing surface) of the support member 502. Additionally, a second panel 510*b* can be supported on a second surface 502*e* (which can be a rear facing surface) of the support member 502. In some embodiments, as in the illustrated embodiment, the panels 510 can be removably attached to or supported by the support member 502 using bolts, screws, press-fit, hook and loop fasteners, or other similar fasteners 512. Additionally, in any embodiments disclosed herein, the panels 510 can be supported by the support member 502 using hook and loop fasteners, latches, hooks, nails, or any other suitable fasteners. In some embodiments, as in the illustrated embodiment, the fasteners 512 can be threadably received within threaded openings formed in the support member 502. Alternatively, as illustrated in FIG. 23, the fasteners 512 can pass through openings in the panel 510 and the support member 502 then be threadably received by one or more threaded fasteners 516, which can be threaded nuts, or other similar fasteners.

In any embodiments disclosed herein, the panels can be configured to have continuous surfaces, free of any openings therein such that the appearance of the panels or the skins or veneers attached thereto will be continuous and uninterrupted. This may improve the aesthetic quality and appearance of the wall modules and provide a more realistic looking appearance to the scene portrayed by the plurality of wall modules. The fastening mechanisms used to attach the panels to the support members can be configured to engage one or more side surfaces of the panels so that the appearance of the front of the panels will not be interrupted by fasteners or openings for the fasteners. Further, the panels and wall modules can be configured such that the panels can be removable from the support member even when the wall module is surrounded or joined on one or more sides thereof with other wall modules. For example, in any embodiments disclosed herein, the wall module can have one or more clips configured to engage and support the panel members. The clips can be, for example, metal, fiberglass, or plastic clips configured to be deflectable so that, when deflected, the panel can be removed from the support member and, when relaxed, are configured to engage the panel member and support the panel member in the desired position.

Additionally, one or more magnets can be supported within or on the surface of the panel member. The magnets can be configured to removably attach the panels to the support member sufficiently, while permitting a user to remove the panels by applying a force to the panel in a direction opposite to the direction of attraction of the magnetic force. The stage operator could use a suction cup, another magnet, or other object to allow the operator to pull the panel away from the support member.

Any of the wall module embodiments disclosed herein can be configured to have up to and including four panel surfaces that can be supported by a single support member. For example, a wall module can support a first panel member on a first side of the support member, and a second panel member on a second side of the support member. The first panel member can have a first side with a first skin, veneer, material, or appearance, a second side with a second skin, veneer, material, or appearance. The wall module, which can be any wall module embodiment disclosed herein, can be configured such that the panel member is reversible, wherein a stage operator can selectively display either the first side or the second side of the panel member, depending on the scene that is desired to be displayed. Similarly, the wall module can be configured such that the second panel member can have a first side with a first skin, veneer, material, or appearance, a second side with a second skin, veneer, material, or appearance, also reversible. Again, in this configuration, the wall module can be configured to display any one of four panel surfaces such that the wall module can display any one of four different appearances.

Figure 49:
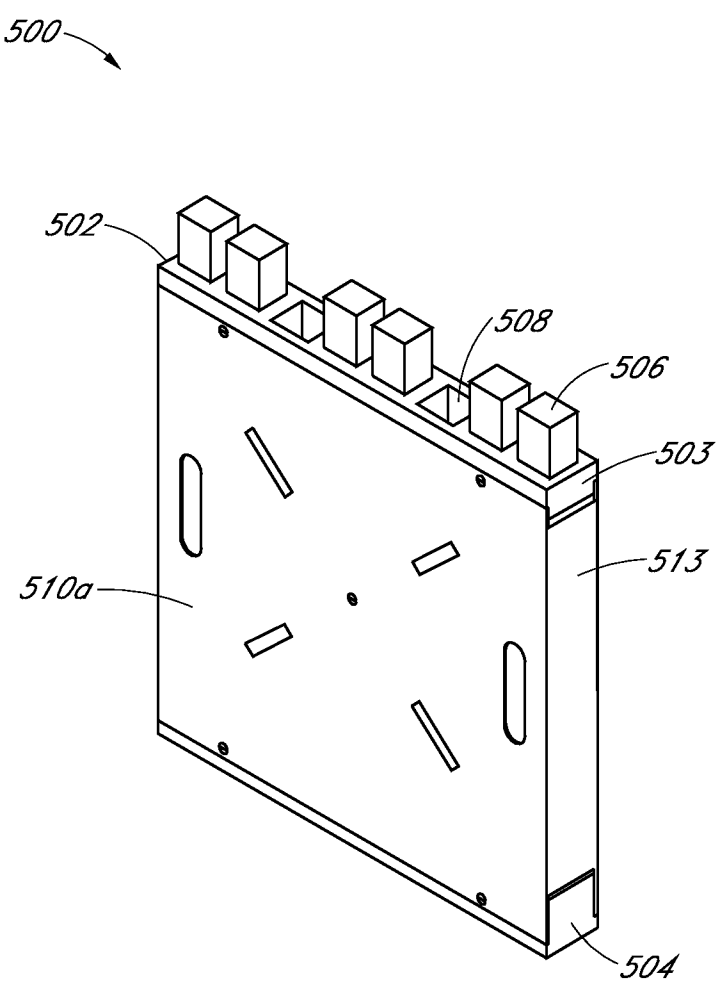

In some embodiments, with reference to FIG. 49, a side panel 513 can be supported by the support member 502. The side panel 513 can have any of the same features, finishes, or other details of any of the other panels disclosed herein, including without limitation panels 510. The side panels 513 can be used to conceal the gap between the panels 510 and to conceal the support member 502, as well as to provide another surface for the facade.

Further, in some embodiments, the struts 509 can have tabs or protrusions 511 (also referred to herein as latches) on a surface thereof, the tabs of protrusions 511 being configured to fit within openings 513 formed in the panels 510. In this arrangement, a user can lift and place a panel against the support member 502 so that the tabs 511 pass through the openings 513 formed in the panels. Once in this position, the tabs 511 can support the panels 510 in the vertical direction. The fasteners 512 can then be easily inserted through the panels 510 into the support members 502 to secure the panels to the support members. The length of the tabs 511 can be equal to a thickness of the panels 510. Finally, openings 514 can also be formed in the panels 510, the openings 514 providing handles or openings for the user's hands or fingers to pass through when handling the panels 510. In some embodiments, the support member can have one or more tabs configured to support the panels.

In some embodiments, recesses 505 can be formed in the front face 502*d* and rear face 502*e* of the support member 502 (either or both of the first support element 503 and the second support element 504) so that the panels 510 can be recessed relative to an outside surface of the support member 502. For example, in some embodiments, the recess can have a thickness approximately equal to a thickness of any panel member that may be supported by the support member 502.

Figure 47:
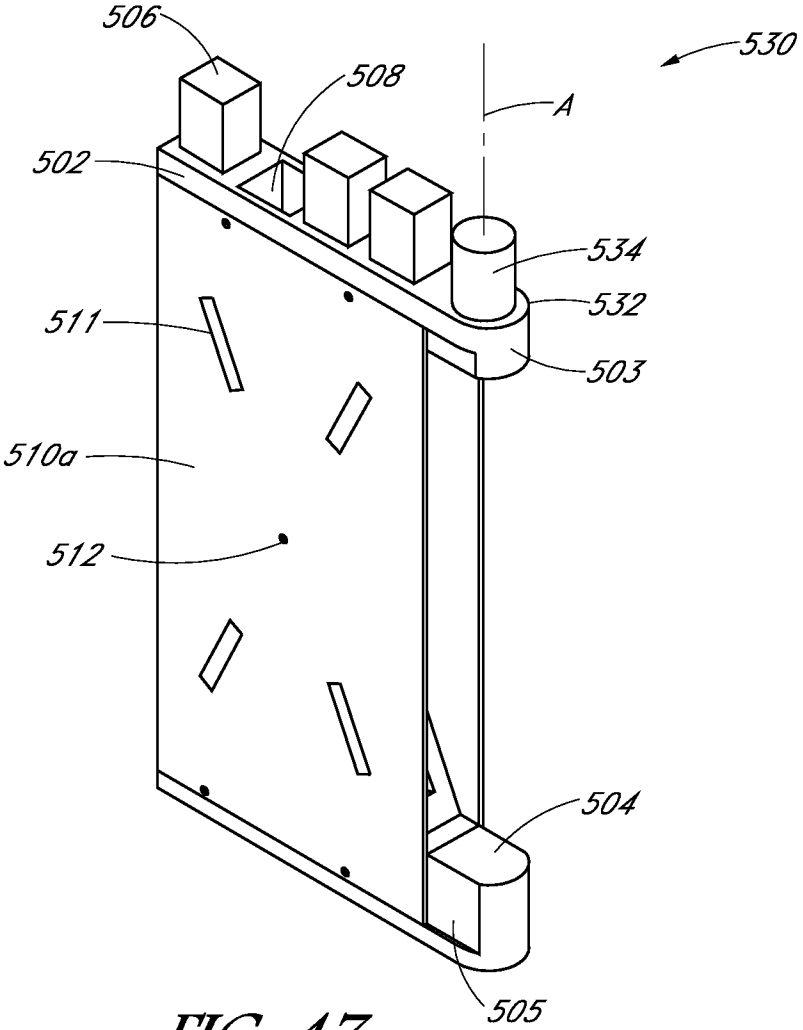
FIGS. 47-51 are isometric views of additional embodiments of a wall module.
Figure 48:
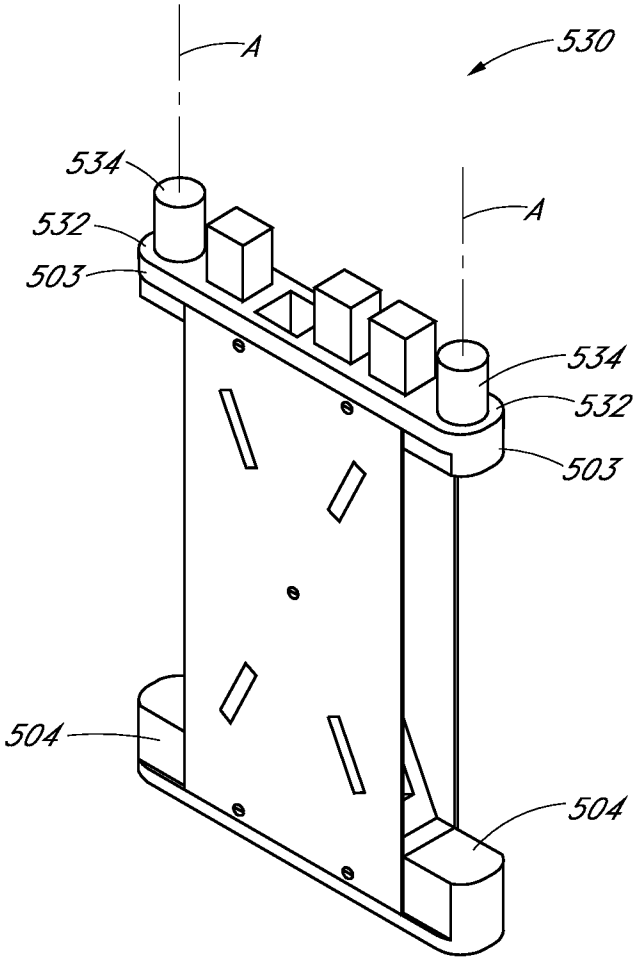

FIG. 47 is an isometric view of another embodiment of a wall module 530. With reference to FIG. 47, any of the wall module embodiments disclosed herein can be configured to have a rotation element or module 532 (also referred to herein as a rotation member) removably or non-removably attached to or integrally formed with the support member 502 configured to permit the module 530 to rotate about an axis A through a centerline of a rotation pin or shaft 534 positioned on an upper surface 532*a* of the rotation member 532. The rotation member 532 can be configured such that the rotation pin or shaft 534 can be received within a complementary shaped recess formed in or positioned at or adjacent to a bottom surface of an adjoining support member 502 of a wall module 500 or wall module 530 having a rotation element 532. In some embodiments, as illustrated in FIG. 48, any of the wall module embodiments disclosed herein can have a rotational member 532 on both sides of the module.

Figure 51:
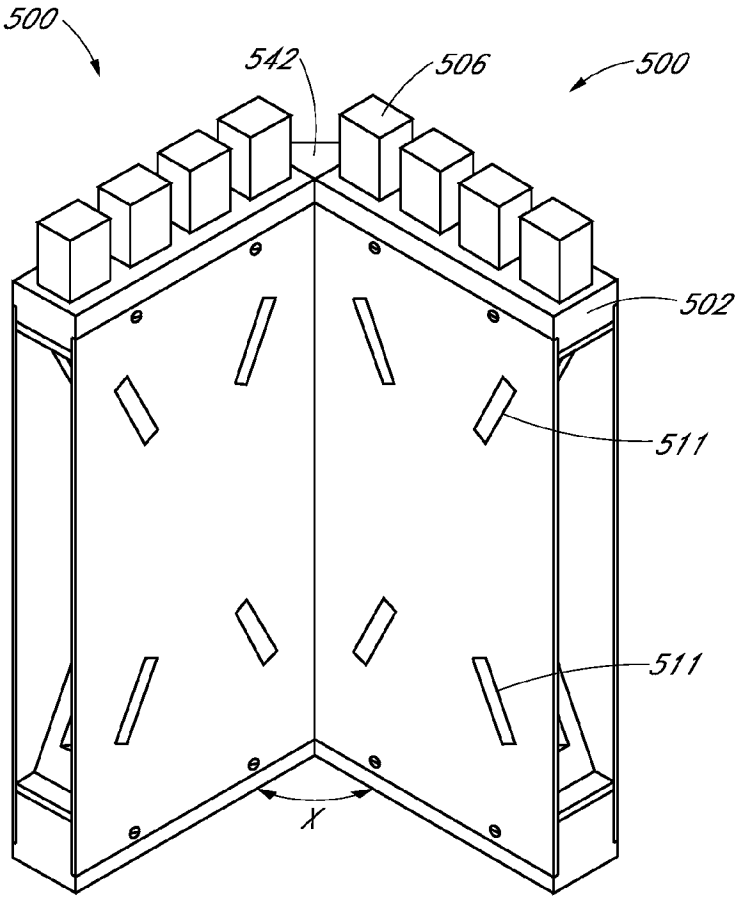
Figure 50:
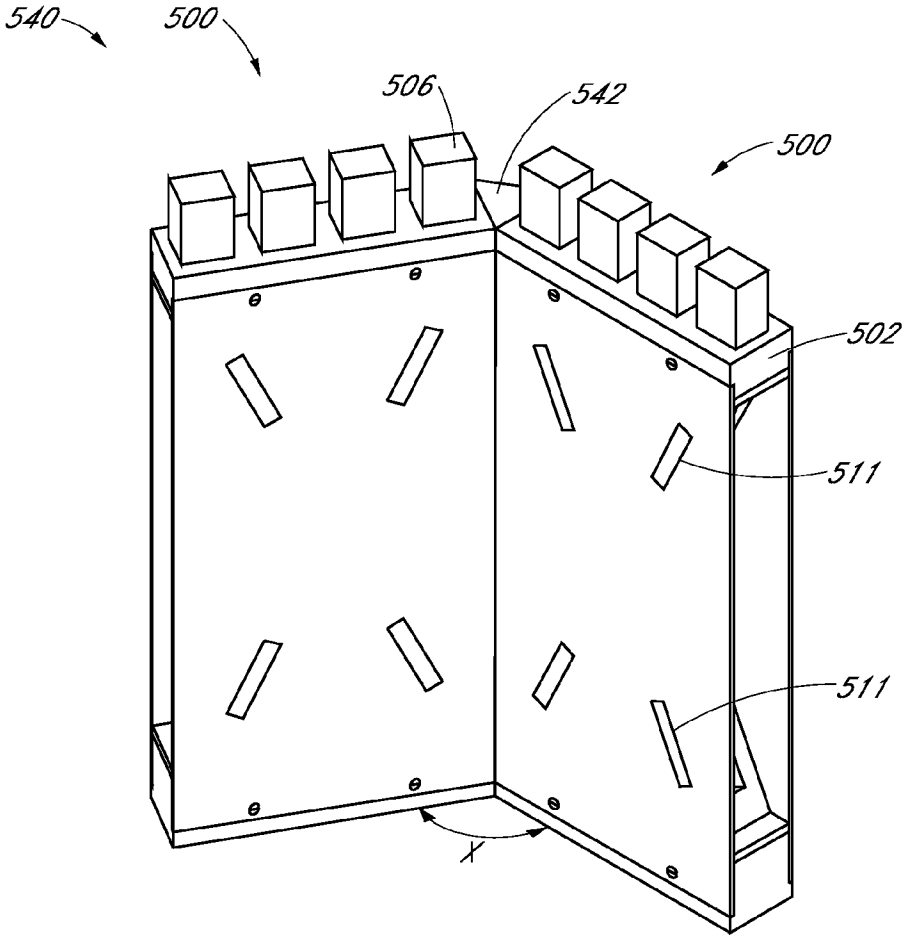

FIG. 50 is an isometric view of another embodiment of a wall module 540. Any of the wall module embodiments disclosed herein can be configured to have an angle member 542 removably or non-removably attached to or integrally formed with the support member 502 of a pair of wall modules 500 configured to support the adjacent wall modules at a set or adjustable angular orientation relative to one another. In some embodiments, the angle member can be permanently attached to the support member 502 of the adjacent wall modules, or can be integrally formed with the support member 502 of the adjacent wall modules. In some embodiments, as in the embodiment illustrated in FIG. 50, the adjacent wall modules 500 can be separated by an angle of approximately 120° by the angle member 542. In some embodiments, as in the embodiment illustrated in FIG. 51, the adjacent wall modules 500 can be separated by an angle of approximately 90° by the angle member 542. In any embodiments disclosed herein, the adjacent wall modules can be separated by an angle of from approximately 45° to approximately 135° by the angle member 542.

Figure 52:
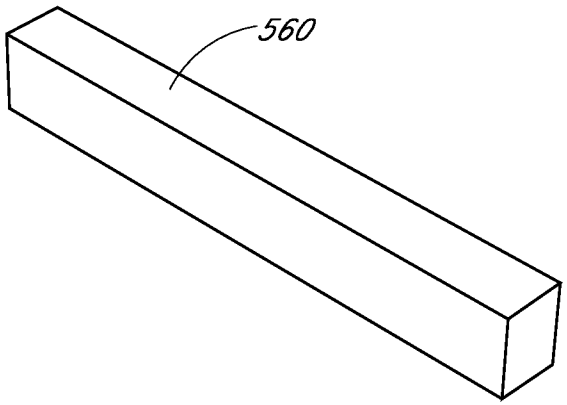
FIG. 52 is an isometric view of an embodiment of a cap member that can be supported on a top surface of any of the support member embodiments disclosed herein.

FIG. 52 is an isometric view of an embodiment of a cap member 550 that can be supported on a top surface of any of the support members 502 disclosed herein. The cap member 550 can be used to cover and/or conceal any of the connection members 506. In some embodiments, the cap member 550 can also help hold adjoining support members 502 together, bridging the gap between such support members 502.

Figure 53:
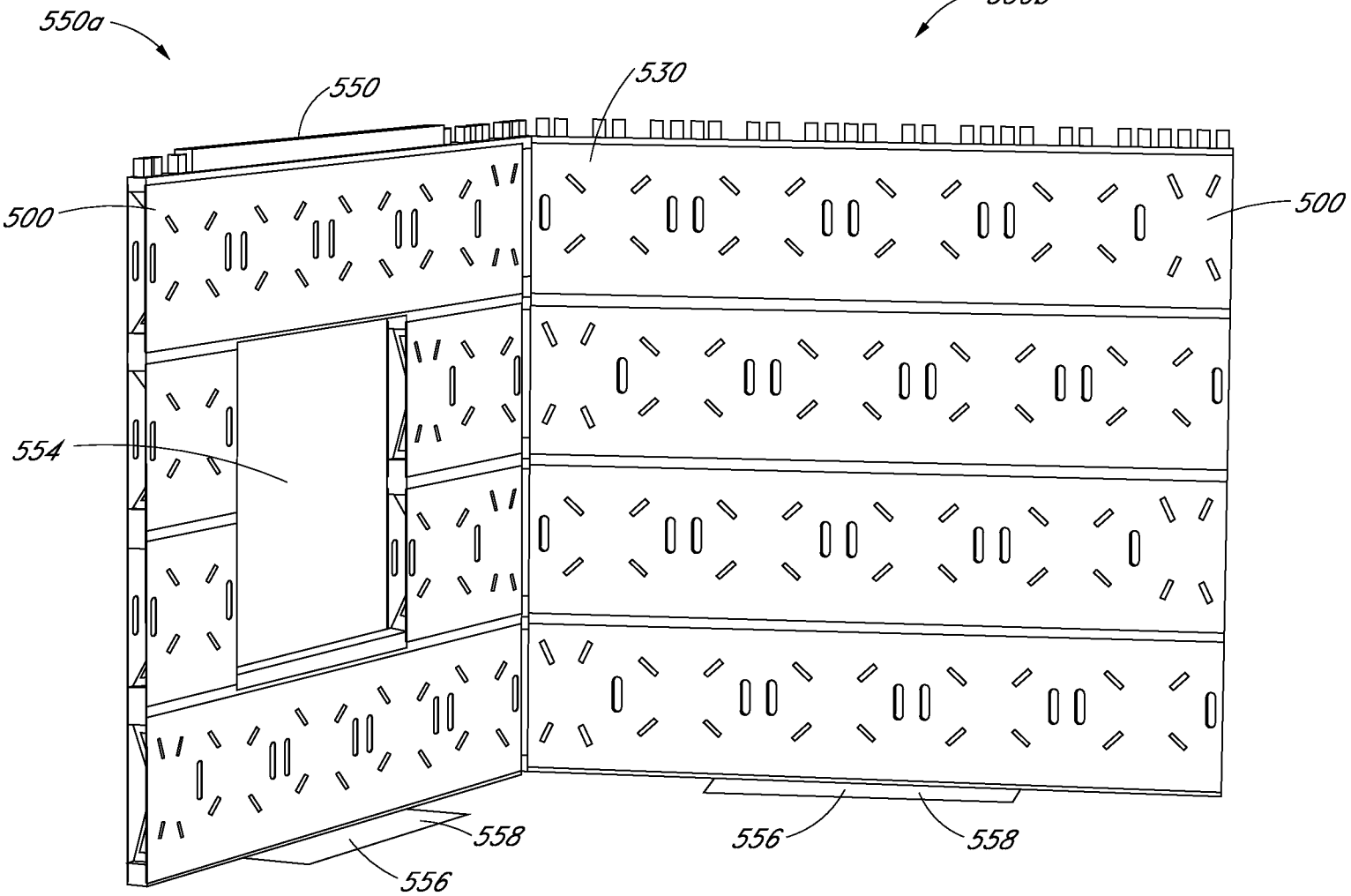
FIG. 53 is an isometric view of an embodiment of a first assembled wall structure and a second assembled wall structure that can be interconnected using the one or more embodiments of the rotation modules disclosed herein.

FIG. 53 is an isometric view of a first assembled wall structure 550*a* and a second assembled wall structure 550*b*, that can be interconnected using the one or more rotation modules 532. The assembled wall structures 550 can be comprised of any combination of the wall modules 500, 530 (or any other wall modules disclosed herein) or otherwise, interconnected to form a structurally stable wall structure. In some embodiments, the wall modules 500, 530 (or any other wall modules disclosed herein) can be positioned and interconnected so as to form an opening or window 554 in the wall structure 550, such as the first wall structure 550*a*.

Additionally, in some embodiments, one or more floor support members 556 can be used to support the wall structures 550 in a vertical position or orientation, or at any suitable angular orientation. In some embodiments, the floor support members 556 can engage or attach to the support members 502 of any of the wall modules to provide a stable connection to the wall module. The floor support members 556 can have a base portion 558 that can be wider than a width of the wall modules, and can have a vertical portion (not shown) that can overlap and/or engage with the support members 502. The vertical portions may form a slot in which the wall structures 550 may rest. In addition or instead, the floor support members 556 may be affixed to the wall structures 550 using bolts, screws, rivets, and/or otherwise Further, any wall module embodiments or wall structure embodiments disclosed herein can be configured to support one or more casters, bi-directional rollers, or wheels (collectively referred to as a wheel or wheels) for portability of the wall module or wall structure. For example and without limitation, one or more wheels can be positioned at a bottom end of the wall module 500 or the wall structure 550. The one or more wheels can be used to roll the wall module or wall structure in any desired direction. The one or more wheels can be removably or non-removably supported by the wall modules or wall structures, or by the support member of any of the wall modules.

For example and without limitation, with reference to FIG. 54, the one or more wheels can be supported within respective recesses formed in the wall module or support member thereof and be configured such that only a portion of the wheel projects below the bottom surface of the wall module when supported by the wall module. The one or more wheels can be selectively supported by any number of the wall modules, for example, the wall modules located at the bottom portion of the wall structure.

In any embodiments, the one or more wheels can be configured to be used in conjunction with the floor support members (such as, without limitation, the floor support members 556) such that the wall structures can be stabilized by the floor support members when the wall structure is desired to be stationary, and such that the wall structures can be rolled on the one or more wheels when the wall structure is desired to be moved. Further, in any embodiments disclosed herein, one or more sliders can be used in addition to or in the alternative to any of the wall modules or wall structures.

Figure 54:
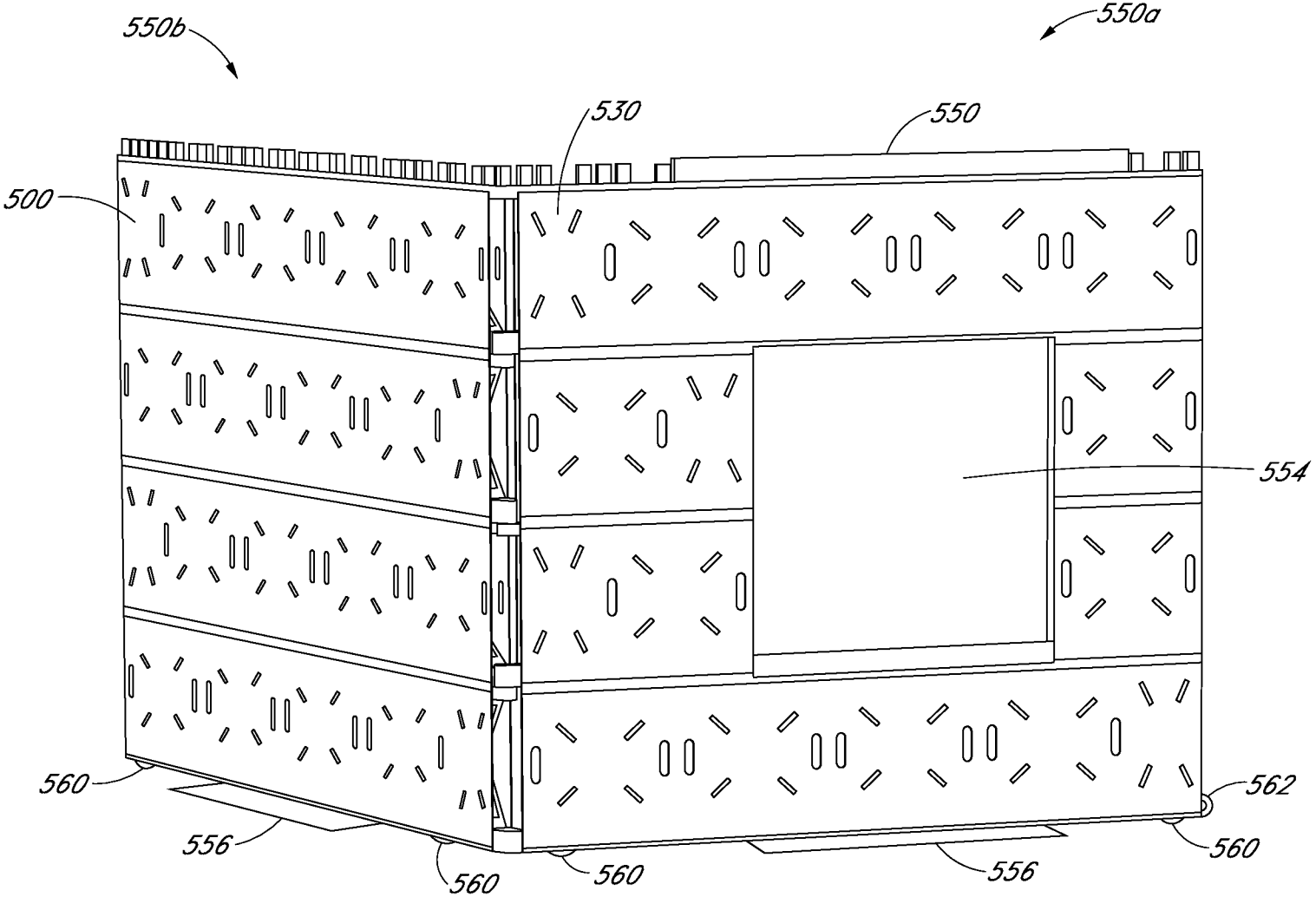
FIG. 54 is an isometric view of a backside of an embodiment of a first assembled wall structure and a second assembled wall structure that can be interconnected using the one or more embodiments of the rotation modules disclosed herein.

With reference to FIG. 54, in any wall module or wall structure embodiments disclosed herein, one or more wheels, sliders, or rollers (collectively referred to herein as wheel) can be positioned on a side surface of the wall module or wall structure adjacent to a bottom edge of the wall module or wall structure. In this arrangement, the wheel (such as wheel 562) can be configured such that, when the wall structure is in a horizontal orientation relative to a floor or other support surface, the wheel will be positioned out of contact with the floor or support surface. To engage the wheel to support at least a portion of the weight of the wall, an end of the wall structure opposite the end having the wheel supported thereon can be lifted to tilt the wall structure in an orientation (such as at an angle of 15 degrees) to engage the wheel 562 with the ground surface for mobility. Any of the embodiments of the wheel 560 or wheel 562 can be retractably supported by the wall module so that the wheel can be retracted when in a stowed position so that the wheel is not visible, or is less visible, when in the stowed state. Additionally or alternatively, a cover member, flap, or other similar object can be positioned over the wheel to partially or fully conceal the wheel.

Figure 55:
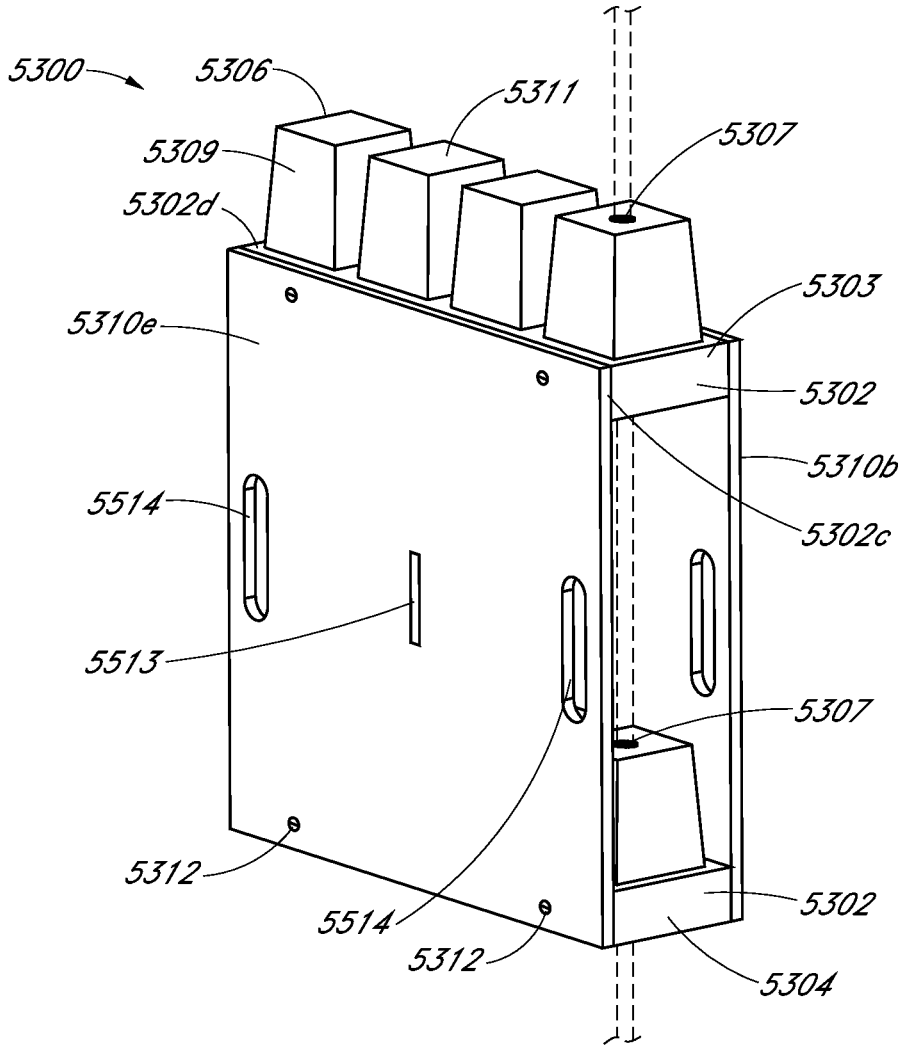
FIG. 55 illustrates an additional embodiment of a wall module.
Figure 56:
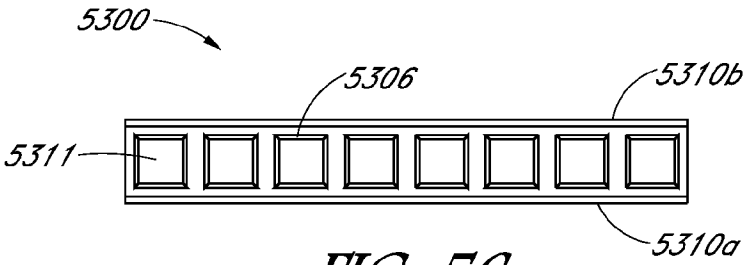
FIGS. 56, 57, 58, and 59, are a top view, front view, side view, and isometric view, respectively, of the embodiment of the wall module illustrated in FIG. 55.
Figure 57:
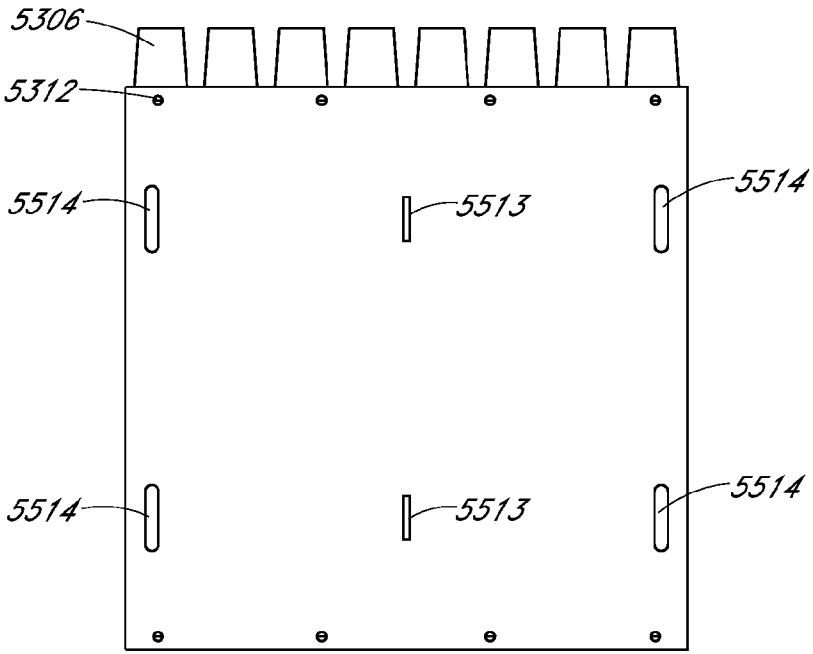
Figure 58:
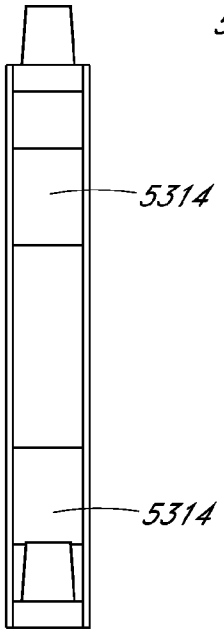
Figure 59:
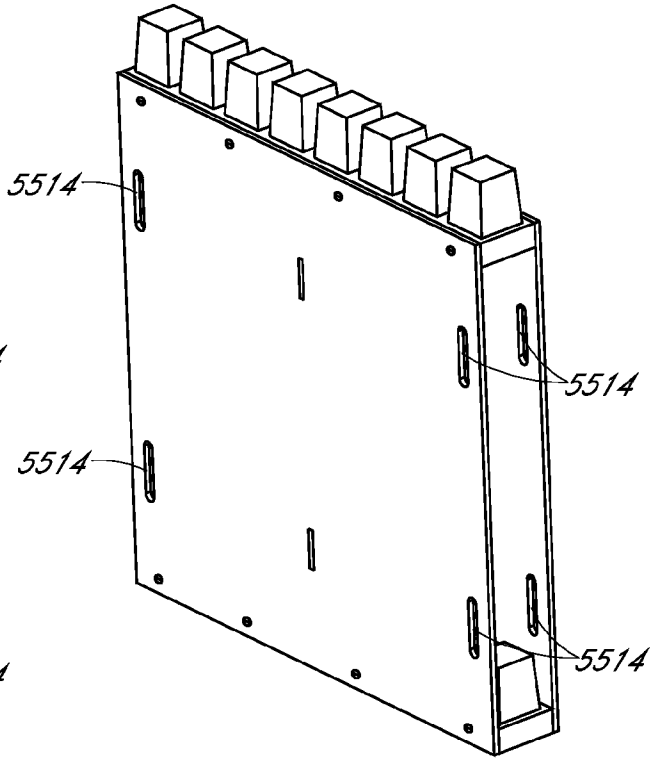
Figures 60, 61:
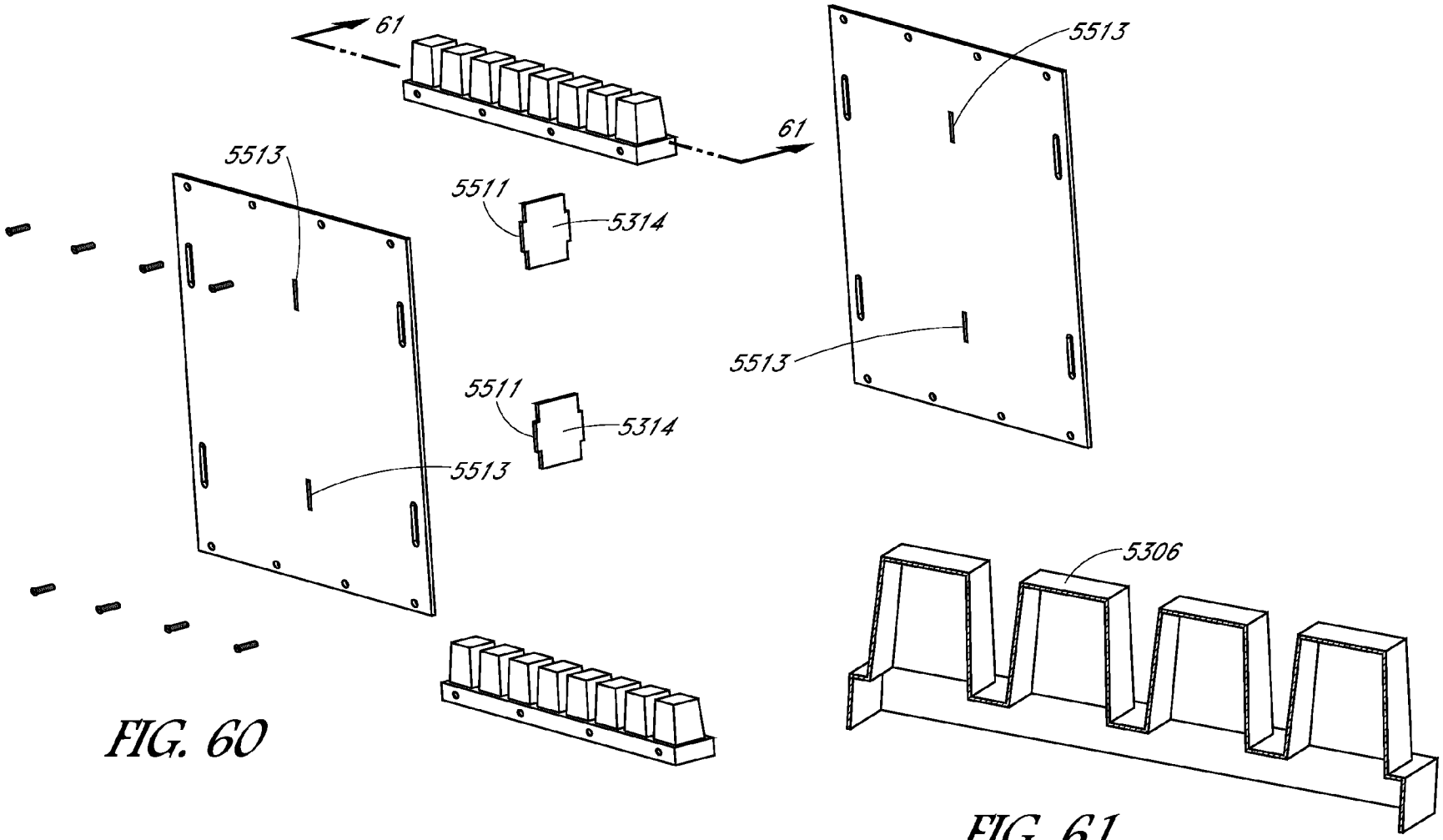
FIG. 60 is an exploded assembly view of the embodiment of the wall module illustrated in FIG. 55.
FIG. 61 is a cutaway view of the embodiment of the support member, including a plurality of connector members, illustrated in FIG. 55.

FIG. 55 illustrates still an additional embodiments of a wall module 5300, which may be of varying sizes and configurations. FIGS. 56, 57, 58, and 59, are a top view, front view, side view, and isometric view, respectively, of the embodiment of the wall module 5300 illustrated in FIG. 55. FIG. 60 is an exploded assembly view of the embodiment of the wall module 5300 illustrated in FIG. 55. In any embodiments, the wall module 5300 in FIG. 55 can have the same features and components, but can have a varying size and a varying number of connector members. For example, the wall module embodiment 5300 illustrated in FIG. 55 can be approximately 1.5 feet by approximately 1.5 feet, approximately 3 feet tall by 1.5 feet wide, approximately 3 feet tall by 3 feet wide, approximately 8 feet tall by 10 feet wide, or approximately 10 feet tall by 10 feet wide. Additionally, any wall module embodiments disclosed herein can have any of the combination of the foregoing sizes, or any other desired size either greater than or less than the aforementioned ranges. By way of further example, a given wall module or support element may have 1, 2, 3, 4, 5, 6, 7, 8, 9, or other number of connector members. The components, including the panels, disclosed herein can optionally be comprises of water-resistant or waterproofed materials for use in wet, exterior environments.

The wall module 5300 can have a support member 5302, one or more connector members 5306, and one or more cover members 5310 (also referred to herein as panels or panel members) supported by the support member 5302. The support member 5302 and the connector members may be integrally formed as a single component. The connector members 5306 can be configured to be supported by the support member 5302 on an upper surface or portion 5302*a* of the support member 5302. A given support member 5302 (including its connector members) may optionally be hollow or may be solid. A given connector member may have an orifice and passageway 5307 via which cables, conduit, piping, and/or poles may be routed. For example, the cables may be electrical cables, the piping may be for liquids, and the poles may be configured to support a roof member, such as a tarp, over one or more wall modules (e.g., over wall modules assembled to form a two, three, or four walled room or stall). Any number of connector members 5306 can be used, depending on the size of the wall module, and the size and/or number of connector members 5306 can be used. For example, the wall module embodiment 5300 illustrated in FIG. 55 can have one connector member 5306, or from two to ten (or other number) connector members 5306. In some embodiments, the connector member 5306 can be positioned at both of the two end portions of the support member 5302. Additionally, a connector member 5306 can be positioned near the middle of the support member 5302.

The connector members 5306 may optionally have tapered walls 5309 with a flat or domed square or rectangular top surface 5311 and/or bottom surface or orifice to thereby facilitate the engagement of male and female connector members or support members. For example, the connector members 5306 may be in the form of a square based pyramid with a truncated top. Other shapes, such as a truncated or non-truncated cone or triangular based pyramid or other pyramidal frustum may be used for one or more of the connector members.

The connector members 5306 can be configured to be received within complementary sized openings 5308 formed in or positioned at a lower edge 5302 of the support member 5302 so that a plurality of support members 5302 can be interconnected to form a larger wall structure. In embodiments where the connector members 5306 of a support member are hollow, a support member can be used as either male support member or as a female support member, depending on whether the support member is installed so that its connector member protrusions are extending from the wall module 5300 (to be used as a male) or are extending into the interior of the wall module 5300 (to be used as a female connector member configured to receive a male connector member).

As with any of the embodiments described above, the support members 5302 can be used to support display panels (such as, but not limited to, cover members 5310), facades, or other aesthetic components. Further, any of the support members 5302 can have recesses, cuts, openings, weight relief features, or other similar features formed therein to reduce the weight of the support members without unacceptably compromising the stiffness of the support members.

Additionally, in any embodiments, any number of connector members 5306 can be positioned on or supported by one or more of the side surfaces 5302*c* of the support member 5302 so that the support members 5302 can be interconnected in a lateral direction as well to provide removable connections between a plurality of laterally arranged wall modules 5300. For example, openings can be formed in the side portions 5302*c* of any of the support members 5302, wherein the connector members 5306 can be slidably or otherwise removably supported within the openings. When it is desired to interconnect one or more wall modules 5300, one or more connector members 5306 can be inserted within the openings formed in an upper surface, lower surface, and/or either of the side surfaces of the support member 5302, to interconnect two or more wall modules. As noted above, the openings may be formed and defined by hollow connector members 5306 positioned to face the interior of the wall 5300. Advantageously, an assembled wall unit 5300 may be disassembled, and where the connector members 5306 are hollow, the support members 5302 may be stacked one on top of the other in nested fashion, where a given connector member of a support member is inserted into the bottom opening of a corresponding connector member of second support member and at least a portion of the support member nests within the second support member. The two or more of the support members, including the connector members 5306, may have the same configuration and dimensions and may be manufactured using the same mold or other fabrication machining.

With reference to FIGS. 55-60, in some embodiments, the support member 5302 can have an upper or first support element 5303 positioned at an upper or first end of the module 5300 and a lower or second support element 5304 positioned at a lower or second end of the module 5300. In some embodiments, the first support element 303 and the second support element 5304 can be spaced apart from one another and only be interconnected by the panels 5310. However, in some embodiments, one or more internal support elements 5314 can be positioned between the first support element 303 and the second support element 304 to provide addition support and rigidity. The internal support elements 5314 may have one or more tabs or protrusions 5511 on a surface thereof, the tabs of protrusions 5511 being configured to fit within openings 5513 formed in the cover members 5310. In this arrangement, a user can lift and place a panel against the support element 5314 so that the tabs 5511 pass through the openings 5513 formed in the panels. Once in this position, the tabs 5511 can support the panels 5310 in the vertical and/or horizontal direction. The length of the tabs 5511 can be equal to a thickness of the cover members 5310. Finally, openings 5514 can also be formed in the cover members 5310, the openings 5514 providing handles or openings for the user's hands or fingers to pass through when handling the cover members 5310. In some embodiments, the support member can have one or more tabs configured to support the panels.

Additionally, as illustrated in FIG. 55, one or more panels 5310 can be supported by the support member 5302. For example, and without limitation, a first panel 5310*a* can be supported on a first surface (which can be a front facing surface) of the support member 5302. Additionally, a second panel 5310*b* can be supported on a second surface (which can be a rear facing surface) of the support member 5302. In some embodiments, as in the illustrated embodiment, the panels 5310 can be removably attached to or supported by the support member 5302 using bolts, screws, press-fit, hook and loop fasteners, or other similar fasteners 5312. The fasteners 5312 may be inserted into countersunk receiving openings in the panels 5310 so as not to protrude outside of the outward facing side of the panels 5310. Additionally, in any embodiments disclosed herein, the panels 5310 can be supported by the support member 5302 using hook and loop fasteners, latches, hooks, nails, or any other suitable fasteners.

In some embodiments, the fasteners 5312 can be threadably received within threaded openings formed in the support member 5302 (where the threaded openings may be provided via a threaded metal insert). Alternatively, as illustrated in FIG. 60, the fasteners 5312 can pass through openings in the panel 5310 and the support member 302 then be threadably received by one or more threaded fasteners, which can be threaded nuts, or other similar fasteners.

FIG. 61 is a cutaway view of the embodiment of the support member 5302, including a plurality of connector members 5306, illustrated in FIG. 55. As can be seen, the support member 5302 and connector members 5306 are hollow, enabling them to be used as either a male or female component, and enabling the support members to be stacked for storage, when not being used in a panel.

Figure 63:
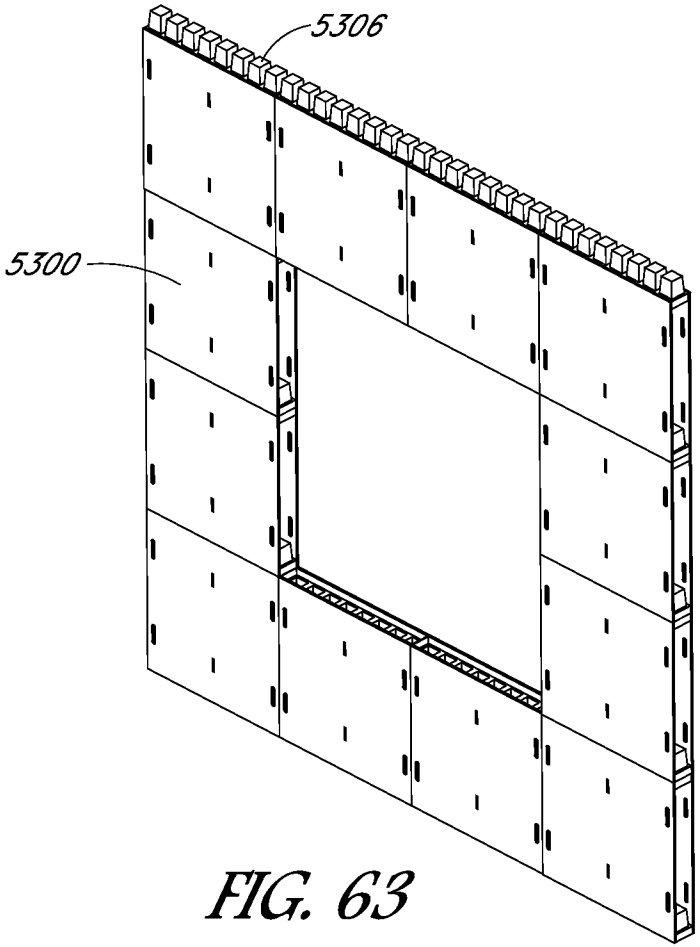
FIGS. 62 and 63 illustrate several of the wall modules of FIG. 55 interconnected to define an opening configured to receive a window module.
Figure 62:
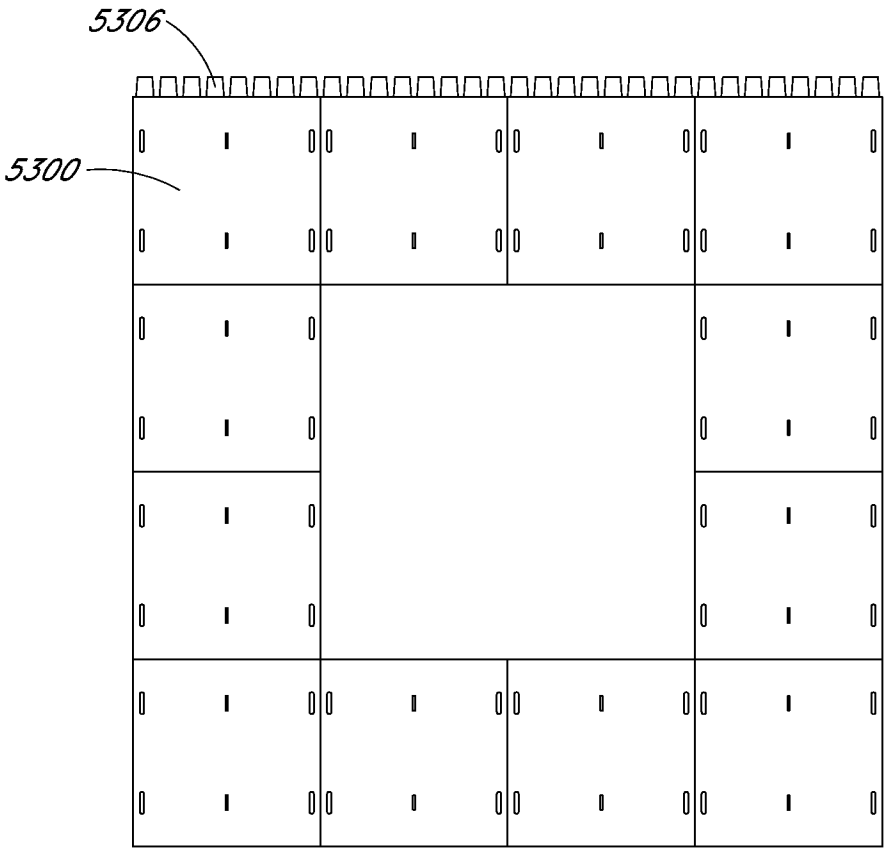

FIGS. 62 and 63 illustrate several of the wall modules of FIG. 55 interconnected to define an opening configured to receive a window module. In this example, the support members of the panels 5300 forming the opening are oriented to that the connector members are facing into the interior of the panel 5300, and not into the opening where the window is to be positioned.

There is disclosed in the above description and the drawings, an improved system and method for constructing a stage which overcomes the disadvantages associated with the prior art. However, it will be apparent that variations and modifications of the disclosed embodiments can be made without departing from the principles of the present disclosure. The presentation of the preferred embodiments herein is offered by way of example only and not limitation, with a true scope and spirit of the disclosure being indicated by the following claims.

Additionally, in any embodiments disclosed herein, the wall modules can be configured to support and include water and gas conduit(s), piping and/or fixtures to enable the passage of fluids and/or gases through the wall modules. Such conduit or fixtures can be configured, for example, to supply gas or fluids to sinks, showers, bathtubs, faucets, fountains, any water features, fireplaces or other flame sources, or any combination of the foregoing, that can also be positioned on, in, or otherwise supported by the wall modules. For example, the conduit can be configured to removably pass through openings or channels in the wall modules, or can be integrated directly into the wall modules and have sealable connections (e.g., quick release connections) between the wall modules so that the conduit can be quickly interconnected when the wall modules are interconnected.

Additionally, any embodiments disclosed herein can also support electrical conduit, lighting, or other electrical fixtures. As with the plumbing or gas conduit, the wall modules can have electrical connections at the interfaces of the wall modules for quick connection. Or, in addition or instead, the wall modules can be configured such that the electrical conduit can be passed through openings, passages, or through or over other features positioned about the wall modules to permit the electrical conduit to be quickly and easily advanced through the wall modules. Lights and other electrical features can be positioned about the wall modules in any desired positions. Spuds or other metal fasteners can be positioned about the wall modules for supporting lights, electrical conduit or other similar components. Optionally, the wall modules can have one or more stubs on an upper surface (or other surface) therefor to support lights. For example, the lights may be equipped with clamps or the like which may be clamped on to or otherwise removably attached to the stubs. The lights may include a cylindrical mount or other mount that mates with a stub having a receiving/mating configuration (e.g., a cylindrical opening configured to receive the cylindrical mount). The lights can be used for decoration purposes or can be used to illuminate the wall modules and/or a space defined by the wall modules. For example, the lights may be used to illuminate actors and/or props positioned in a set defined in whole or in part by one or more wall modules.

Although the various embodiments were disclosed herein as being full size or scale, any embodiments disclosed herein can be made or formed at any desired height or size. For example and without limitation, scaled models or toy versions of any of the embodiments disclosed herein can be made having any combination of the features disclosed herein. Such scaled models can be useful for mockups, demonstrations, or simply as toys. The scaled models can be from approximately 1/10th size, or approximately 1/12th sized scaled models, and can be made from any suitable materials such as plastic, wood, metal, or any combination of the foregoing. Although the foregoing discussion may, for purposes of illustration, discuss various embodiments in the context of stages or sets, the use of such embodiments are not so limited. For example, certain embodiments may be utilized as temporary structures, emergency structures, tradeshow structures, etc.

Features, materials, characteristics, or groups described in conjunction with a particular aspect, embodiment, or example are to be understood to be applicable to any other aspect, embodiment or example described herein unless incompatible therewith. All of the features disclosed in this specification (including any accompanying claims, abstract and drawings), and/or all of the steps of any method or process so disclosed, can be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

While certain embodiments have been described, these embodiments have been presented by way of example only, and are not intended to limit the scope of protection. Indeed, the novel methods and systems described herein can be embodied in a variety of other forms. Furthermore, various omissions, substitutions and changes in the form of the methods and systems described herein can be made. Those skilled in the art will appreciate that in some embodiments, the actual steps taken in the processes illustrated and/or disclosed can differ from those shown in the figures. Depending on the embodiment, certain of the steps described above can be removed, others can be added. Furthermore, the features and attributes of the specific embodiments disclosed above can be combined in different ways to form additional embodiments, all of which fall within the scope of the present disclosure.

Although the present disclosure includes certain embodiments, examples and applications, it will be understood by those skilled in the art that the present disclosure extends beyond the specifically disclosed embodiments to other alternative embodiments and/or uses and obvious modifications and equivalents thereof, including embodiments which do not provide all of the features and advantages set forth herein. Accordingly, the scope of the present disclosure is not intended to be limited by the specific disclosures of preferred embodiments herein, and may be defined by claims as presented herein or as presented in the future.

What is claimed is:

1. A wall module assembly usable to make interchangeable scenery for a theater or entertainment stage or set, the wall module assembly comprising:

a first support member having a first end, a second end, a first main surface, and a second main surface;

a second support member having a first end, a second end, a first main surface, and a second main surface;

wherein the first main surface of the first support member and the first main surface of the second support member are configured to removably receive a first panel for simulating an environment, and the second main surface of the first support member and the second main surface of the second support member are configured to removably receive a second panel;

a plurality of connection members positioned at the first end of the first support member and configured to be removably received within openings of a third support member of another wall module assembly; and an internal support member having a first protrusion configured to support the first panel in at least a first direction and a second protrusion configured to support the second panel in at least the first direction, the first protrusion being configured to be received within an opening formed in the first panel and the second protrusion being configured to be received within an opening formed in the second panel.

2. The assembly of claim 1, wherein the first support member and the second support member have the same configuration and dimensions.

3. The assembly of claim 1, wherein the first support member and the second support member are substantially hollow, and the interior of the first support member is configured to receive connection members of the second support member so that the first support member may be stacked for storage in nested fashion on the second support member when the wall module assembly is in an unassembled state.

4. The assembly of claim 1, wherein the first support member and the plurality of connection members positioned at the first end of the first support member comprise medium-density fibreboard.

5. The assembly of claim 1, wherein a top surface of at least one of the plurality of connection members positioned at the first end of the first support member and a top surface of at least one of a plurality of connection members positioned at the first end of the second support member each have an orifice configured to receive a cable, conduit, pole, or piping.

6. The assembly of claim 1, wherein the first support member and the plurality of connection members positioned at the first end of the first support member are integrally formed.

7. The assembly of claim 1, wherein the plurality of connection members positioned at the first end of the first support member comprise one or more connection members having a pyramidal frustum shape.

8. The assembly of claim 1, wherein the first support member comprises a first support element positioned at an upper portion of the wall module assembly and the second support member comprises a second support element positioned at a lower portion of the wall module assembly, first and second support elements being configured to support the first and second panels in at least a vertical direction.

9. The assembly of claim 1, further comprising fastener mechanisms configured to attach the first panel to at least one of the first support member and the second support member.

10. The assembly of claim 1, wherein at least one of the first panel and the second panel comprise openings extending therethrough, the openings providing handles for a user's hands or fingers to pass through when handling the respective panels.

11. The assembly of claim 1, further comprising one or more floor stands configured to support the wall module assembly in a vertical orientation.

12. A wall module assembly usable to make interchangeable scenery for a theater or entertainment stage or set, the wall module assembly comprising:

a first support member having a first end, a second end, a first main surface, and a second main surface;

a second support member having a first end, a second end, a first main surface, and a second main surface;

wherein the first main surface of the first support member and the first main surface of the second support member are configured to removably receive a first panel for simulating an environment, and the second main surface of the first support member and the second main surface of the second support member are configured to removably receive a second panel; and a plurality of connection members positioned at the first end of the first support member and configured to be removably received within openings of a third support member of another wall module assembly, wherein a first main surface and a second main surface of at least one of the first panel and the second panel is painted, textured or covered, the second main surface being opposite to the first main surface.

13. A wall module assembly usable to make interchangeable scenery for a theater or entertainment stage or set, the wall module assembly comprising:

a first support member having a first end, a second end, a first main surface, and a second main surface;

a second support member having a first end, a second end, a first main surface, and a second main surface;

wherein the first main surface of the first support member and the first main surface of the second support member are configured to receive a first panel for simulating an environment;

a plurality of connection members positioned at the first end of the first support member and configured to be removably received within openings of a third support member of another wall module assembly; and an internal support member having a first protrusion configured to support the first panel in at least a first direction and a second protrusion configured to support the second panel in at least the first direction, the first protrusion being configured to be received within an opening formed in the first panel and the second protrusion being configured to be received within an opening formed in the second panel.

14. The assembly of claim 13, wherein the first support member and the second support member have the same configuration and dimensions.

15. The assembly of claim 13, wherein the first support member is substantially hollow, and the interior of the first support member is configured to receive connection members of another support member when the wall module assembly is in an unassembled state.

16. The assembly of claim 13, wherein a top surface of at least one of the plurality of connection members positioned at the first end of the first support member and a top surface of at least one of a plurality of connection members positioned at the first end of the second support member each have an orifice configured to receive a cable, conduit, pole, or piping.

17. The assembly of claim 13, wherein the first support member and the plurality of connection members positioned at the first end of the first support member are integrally formed.

18. The assembly of claim 13, wherein the plurality of connection members positioned at the first end of the first support member comprise one or more connection members having a pyramidal frustum shape.

19. The assembly of claim 13, further comprising fastener mechanisms configured to attach the first panel to at least one of the first support member and the second support member.

20. The assembly of claim 13, further comprising one or more floor stands configured to support the wall module assembly in a vertical orientation.

21. A wall module assembly usable to make interchangeable scenery for a theater or entertainment stage or set, the wall module assembly comprising:

a first support member having a first end, a second end, a first main surface, and a second main surface;

a second support member having a first end, a second end, a first main surface, and a second main surface;

wherein the first main surface of the first support member and the first main surface of the second support member are configured to receive a first panel for simulating an environment; and a plurality of connection members positioned at the first end of the first support member and configured to be removably received within openings of a third support member of another wall module assembly, wherein a first main surface and a second main surface of at least one of the first panel and the second panel is painted, textured or covered, the second main surface being opposite to the first main surface.

* * * * *